US009955841B2

(12) United States Patent
Won et al.

(10) Patent No.: US 9,955,841 B2
(45) Date of Patent: May 1, 2018

(54) REMOVING DEBRIS FROM CLEANING ROBOTS

(71) Applicant: iRobot Corporation, Bedford, MA (US)

(72) Inventors: Chikyung Won, Tewksbury, MA (US); Stephen A. Hickey, Somerville, MA (US); Mark Steven Schnittman, Somerville, MA (US); Zivthan A. Dubrovsky, Waltham, MA (US); Selma Svendsen, Andover, MA (US); Jed Lowry, Duxbury, MA (US); David Swett, Waltham, MA (US); John Devlin, Tewksbury, MA (US)

(73) Assignee: iRobot Corporation, Bedford, MA (US)

( * ) Notice: Subject to any disclaimer, the term of this patent is extended or adjusted under 35 U.S.C. 154(b) by 1050 days.

(21) Appl. No.: 14/042,882

(22) Filed: Oct. 1, 2013

(65) Prior Publication Data

US 2014/0130272 A1 May 15, 2014

Related U.S. Application Data

(63) Continuation of application No. 12/301,263, filed as application No. PCT/US2007/069389 on May 21, 2007, now Pat. No. 8,572,799.

(Continued)

(51) Int. Cl.
*A47L 9/28* (2006.01)
*A47L 11/40* (2006.01)

(Continued)

(52) U.S. Cl.
CPC ..... *A47L 11/4091* (2013.01); *A47L 9/106* (2013.01); *A47L 9/108* (2013.01); *A47L 11/24* (2013.01);

(Continued)

(58) Field of Classification Search
CPC ..... A47L 2201/02; A47L 2201/04; A47L 2201/024; A47L 2201/028; A47L 9/28

(Continued)

(56) References Cited

U.S. PATENT DOCUMENTS 1,417,768 A 5/1922 Radimak
1,755,054 A 4/1930 Darst (Continued)

FOREIGN PATENT DOCUMENTS

AU 2003275566 6/2004
DE 2128842 C3 12/1980

(Continued)

OTHER PUBLICATIONS

European Search Report in Application No. 1520143.0, dated Jul. 18, 2016, 8 pages.

(Continued)

*Primary Examiner* — David Redding
(74) *Attorney, Agent, or Firm* — Fish & Richardson P.C.

(57) ABSTRACT

A cleaning robot system includes a robot and a robot maintenance station. The robot includes a chassis, a drive system configured to maneuver the robot as directed by a controller, and a cleaning assembly including a cleaning assembly housing and a driven cleaning roller. The robot maintenance station includes a station housing and a docking platform configured to support the robot when docked. A mechanical agitator engages the roller of the robot with the robot docked. The agitator includes an agitator comb having multiple teeth configured to remove accumulated debris from the roller as the agitator comb and roller are moved relative to one another. The robot maintenance station includes a collection bin arranged to receive and hold debris removed by the mechanical agitator.

18 Claims, 21 Drawing Sheets

Related U.S. Application Data

(60) Provisional application No. 60/747,791, filed on May 19, 2006, provisional application No. 60/803,504, filed on May 30, 2006, provisional application No. 60/807,442, filed on Jul. 14, 2006.

(51) Int. Cl.
*A47L 9/10* (2006.01)
*A47L 11/33* (2006.01)
*A47L 11/24* (2006.01)

(52) U.S. Cl.
CPC ..... *A47L 11/33* (2013.01); *A47L 11/4002* (2013.01); *A47L 11/4008* (2013.01); *A47L 11/4011* (2013.01); *A47L 11/4013* (2013.01); *A47L 11/4025* (2013.01); *A47L 11/4041* (2013.01); *A47L 11/4044* (2013.01); *A47L 11/4066* (2013.01); *A47L 11/4069* (2013.01); *A47L 2201/02* (2013.01); *A47L 2201/024* (2013.01); *A47L 2201/028* (2013.01); *A47L 2201/04* (2013.01)

(58) Field of Classification Search
USPC ..... 15/319, 339
See application file for complete search history.

(56) References Cited

U.S. PATENT DOCUMENTS 1,780,221 A 11/1930 Buchmann
1,970,302 A 8/1934 Gerhardt
2,136,324 A 11/1938 John
2,302,111 A 11/1942 Dow et al.
2,353,621 A 7/1944 Sav et al.
2,770,825 A 11/1956 Pullen
2,868,321 A 1/1959 Kelly
2,892,511 A 6/1959 Gall et al.
2,930,055 A 3/1960 Fallen et al.
3,119,369 A 1/1964 Harland et al.
3,166,138 A 1/1965 Dunn
3,333,564 A 8/1967 Waters
3,375,375 A 3/1968 Robert et al.
3,381,652 A 5/1968 Schaefer et al.
3,457,575 A 7/1969 Bienek
3,550,714 A 12/1970 Bellinger
3,569,727 A 3/1971 Aggarwal et al.
3,649,981 A 3/1972 Woodworth
3,674,316 A 7/1972 De Bray
3,678,882 A 7/1972 Kinsella
3,690,559 A 9/1972 Rudloff
3,744,586 A 7/1973 Leinauer
3,756,667 A 9/1973 Bombardier et al.
3,809,004 A 5/1974 Leonheart
3,816,004 A 6/1974 Bignardi
3,845,831 A 11/1974 James
RE28,268 E 12/1974 Autrand
3,851,349 A 12/1974 Lowder
3,853,086 A 12/1974 Asplund
3,863,285 A 2/1975 Hukuba
3,888,181 A 6/1975 Kups
3,937,174 A 2/1976 Haaga
3,952,361 A 4/1976 Wilkins
3,989,311 A 11/1976 Debrey
3,989,931 A 11/1976 Phillips
4,004,313 A 1/1977 Capra
4,012,681 A 3/1977 Finger et al.
4,070,170 A 1/1978 Leinfelt
4,099,284 A 7/1978 Shinozaki et al.
4,119,900 A 10/1978 Kremnitz
4,175,589 A 11/1979 Nakamura et al.
4,175,892 A 11/1979 De bray
4,196,727 A 4/1980 Verkaart et al.
4,198,727 A 4/1980 Farmer
4,199,838 A 4/1980 Simonsson
4,209,254 A 6/1980 Reymond et al.
D258,901 S 4/1981 Keyworth
4,297,578 A 10/1981 Carter
4,305,234 A 12/1981 Pichelman
4,306,329 A 12/1981 Yokoi
4,309,758 A 1/1982 Halsall et al.
4,328,545 A 5/1982 Halsall et al.
4,367,403 A 1/1983 Miller
4,369,543 A 1/1983 Chen et al.
4,401,909 A 8/1983 Gorsek
4,416,033 A 11/1983 Specht
4,445,245 A 5/1984 Lu
4,465,370 A 8/1984 Yuasa et al.
4,477,998 A 10/1984 You
4,481,692 A 11/1984 Kurz
4,482,960 A 11/1984 Pryor
4,492,058 A 1/1985 Goldfarb et al.
4,513,469 A 4/1985 Godfrey et al.
D278,732 S 5/1985 Ohkado
4,518,437 A 5/1985 Sommer
4,534,637 A 8/1985 Suzuki et al.
4,556,313 A 12/1985 Miller et al.
4,575,211 A 3/1986 Matsumura et al.
4,580,311 A 4/1986 Kurz
4,601,082 A 7/1986 Kurz
4,618,213 A 10/1986 Chen
4,620,285 A 10/1986 Perdue
4,624,026 A 11/1986 Olson et al.
4,626,995 A 12/1986 Lofgren et al.
4,628,454 A 12/1986 Ito
4,638,445 A 1/1987 Mattaboni
4,644,156 A 2/1987 Takahashi et al.
4,649,504 A 3/1987 Krouglicof et al.
4,652,917 A 3/1987 Miller
4,654,492 A 3/1987 Koerner et al.
4,654,924 A 4/1987 Getz et al.
4,660,969 A 4/1987 Sorimachi et al.
4,662,854 A 5/1987 Fang
4,674,048 A 6/1987 Okumura
4,679,152 A 7/1987 Perdue
4,680,827 A 7/1987 Hummel
4,696,074 A 9/1987 Cavalli
D292,223 S 10/1987 Trumbull
4,700,301 A 10/1987 Dyke
4,700,427 A 10/1987 Knepper
4,703,820 A 11/1987 Reinaud
4,709,773 A 12/1987 Clement et al.
4,710,020 A 12/1987 Maddox et al.
4,712,740 A 12/1987 Duncan et al.
4,716,621 A 1/1988 Zoni
4,728,801 A 3/1988 O'Connor
4,733,343 A 3/1988 Yoneda et al.
4,733,430 A 3/1988 Westergren
4,733,431 A 3/1988 Martin
4,735,136 A 4/1988 Lee et al.
4,735,138 A 4/1988 Gawler et al.
4,748,336 A 5/1988 Fujie et al.
4,748,833 A 6/1988 Nagasawa
4,756,049 A 7/1988 Uehara
4,767,213 A 8/1988 Hummel
4,769,700 A 9/1988 Pryor
4,777,416 A 10/1988 George et al.
D298,766 S 11/1988 Tanno et al.
4,782,550 A 11/1988 Jacobs
4,796,198 A 1/1989 Boultinghouse et al.
4,806,751 A 2/1989 Abe et al.
4,811,228 A 3/1989 Hyyppa
4,813,906 A 3/1989 Matsuyama et al.
4,815,157 A 3/1989 Tsuchiya
4,817,000 A 3/1989 Eberhardt
4,818,875 A 4/1989 Weiner
4,829,442 A 5/1989 Kadonoff et al.
4,829,626 A 5/1989 Harkonen et al.
4,832,098 A 5/1989 Palinkas et al.
4,851,661 A 7/1989 Everett
4,854,000 A 8/1989 Takimoto
4,854,006 A 8/1989 Nishimura et al.
4,855,915 A 8/1989 Dallaire
4,857,912 A 8/1989 Everett et al.

(56) References Cited

U.S. PATENT DOCUMENTS 4,858,132 A 8/1989 Holmquist
4,867,570 A 9/1989 Sorimachi et al.
4,880,474 A 11/1989 Koharagi et al.
4,887,415 A 12/1989 Martin
4,891,762 A 1/1990 Chotiros
4,893,025 A 1/1990 Lee
4,901,394 A 2/1990 Nakamura et al.
4,905,151 A 2/1990 Weiman et al.
4,909,972 A 3/1990 Britz
4,912,643 A 3/1990 Beirne
4,918,441 A 4/1990 Bohman
4,919,224 A 4/1990 Shyu et al.
4,919,489 A 4/1990 Kopsco
4,920,060 A 4/1990 Parrent et al.
4,920,605 A 5/1990 Takashima
4,933,864 A 6/1990 Evans et al.
4,937,912 A 7/1990 Kurz
4,953,253 A 9/1990 Fukuda et al.
4,954,962 A 9/1990 Evans et al.
4,955,714 A 9/1990 Stotler et al.
4,956,891 A 9/1990 Wulff
4,961,303 A 10/1990 McCarty et al.
4,961,304 A 10/1990 Ovsborn et al.
4,962,453 A 10/1990 Pong et al.
4,967,862 A 11/1990 Pong et al.
4,971,591 A 11/1990 Raviv et al.
4,973,912 A 11/1990 Kaminski et al.
4,974,283 A 12/1990 Holsten et al.
4,977,618 A 12/1990 Allen
4,977,639 A 12/1990 Takahashi et al.
4,986,663 A 1/1991 Cecchi et al.
5,001,635 A 3/1991 Yasutomi et al.
5,002,145 A 3/1991 Wakaumi et al.
5,012,886 A 5/1991 Jonas et al.
5,018,240 A 5/1991 Holman
5,020,186 A 6/1991 Lessig et al.
5,022,812 A 6/1991 Coughlan et al.
5,023,788 A 6/1991 Kitazume et al.
5,024,529 A 6/1991 Svetkoff et al.
D318,500 S 7/1991 Malewicki et al.
5,032,775 A 7/1991 Mizuno et al.
5,033,151 A 7/1991 Kraft et al.
5,033,291 A 7/1991 Podoloff et al.
5,040,116 A 8/1991 Evans et al.
5,045,769 A 9/1991 Everett
5,049,802 A 9/1991 Mintus et al.
5,051,906 A 9/1991 Evans et al.
5,062,819 A 11/1991 Mallory
5,070,567 A 12/1991 Holland
5,084,934 A 2/1992 Lessig et al.
5,086,535 A 2/1992 Grossmeyer et al.
5,090,321 A 2/1992 Abouav
5,093,955 A 3/1992 Blehert et al.
5,094,311 A 3/1992 Akeel
5,098,262 A 3/1992 Wecker et al.
5,105,502 A 4/1992 Takashima
5,105,550 A 4/1992 Shenoha
5,109,566 A 5/1992 Kobayashi et al.
5,111,401 A 5/1992 Everett, Jr. et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mori et al.
5,144,715 A 9/1992 Matsuyo et al.
5,152,028 A 10/1992 Hirano
5,152,202 A 10/1992 Strauss
5,154,617 A 10/1992 Suman et al.
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 McTamaney et al.
5,173,881 A 12/1992 Sindle
5,182,833 A 2/1993 Yamaguchi et al.
5,187,662 A 2/1993 Kamimura et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,222,786 A 6/1993 Sovis et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,276,618 A 1/1994 Everett
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,331,713 A 7/1994 Tipton
5,341,186 A 8/1994 Kato
5,341,540 A 8/1994 Soupert et al.
5,341,549 A 8/1994 Wirtz et al.
5,345,649 A 9/1994 Whitlow
5,352,901 A 10/1994 Poorman
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,454,129 A 10/1995 Kell
5,455,982 A 10/1995 Armstrong et al.
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber
5,497,529 A 3/1996 Boesi
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel-Malek
5,515,572 A 5/1996 Hoekstra et al.
5,534,762 A 7/1996 Kim
5,535,476 A 7/1996 Kresse et al.
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon

(56) References Cited

U.S. PATENT DOCUMENTS 5,548,511 A 8/1996 Bancroft
5,551,119 A 9/1996 Worwag
5,551,525 A 9/1996 Pack et al.
5,553,349 A 9/1996 Kilstrom et al.
5,555,587 A 9/1996 Guha
5,560,077 A 10/1996 Crotchett
5,568,589 A 10/1996 Hwang
D375,592 S 11/1996 Ljunggren
5,608,306 A 3/1997 Rybeck et al.
5,608,894 A 3/1997 Kawakami et al.
5,608,944 A 3/1997 Gordon
5,610,488 A 3/1997 Miyazawa
5,611,106 A 3/1997 Wulff
5,611,108 A 3/1997 Knowlton et al.
5,613,261 A 3/1997 Kawakami et al.
5,613,269 A 3/1997 Miwa
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kubo et al.
5,642,299 A 6/1997 Hardin et al.
5,646,494 A 7/1997 Han
5,647,554 A 7/1997 Ikegami et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,698,861 A 12/1997 Oh
5,709,007 A 1/1998 Chiang
5,710,506 A 1/1998 Broell et al.
5,714,119 A 2/1998 Kawagoe et al.
5,717,169 A 2/1998 Liang et al.
5,717,484 A 2/1998 Hamaguchi et al.
5,720,077 A 2/1998 Nakamura et al.
5,732,401 A 3/1998 Conway
5,735,017 A 4/1998 Barnes et al.
5,735,959 A 4/1998 Kubo et al.
5,742,975 A 4/1998 Knowlton et al.
5,745,235 A 4/1998 Vercammen et al.
5,752,871 A 5/1998 Tsuzuki
5,756,904 A 5/1998 Oreper et al.
5,761,762 A 6/1998 Kubo
5,764,888 A 6/1998 Bolan et al.
5,767,437 A 6/1998 Rogers
5,767,960 A 6/1998 Orman
5,770,936 A 6/1998 Hirai et al.
5,777,596 A 7/1998 Herbert
5,778,486 A 7/1998 Kim
5,781,697 A 7/1998 Jeong
5,781,960 A 7/1998 Kilstrom et al.
5,784,755 A 7/1998 Karr et al.
5,786,602 A 7/1998 Pryor et al.
5,787,545 A 8/1998 Colens
5,793,900 A 8/1998 Nourbakhsh et al.
5,794,297 A 8/1998 Muta
5,802,665 A 9/1998 Knowlton et al.
5,812,267 A 9/1998 Everett et al.
5,814,808 A 9/1998 Takada et al.
5,815,880 A 10/1998 Nakanishi
5,815,884 A 10/1998 Imamura et al.
5,819,008 A 10/1998 Asama et al.
5,819,360 A 10/1998 Fujii
5,819,936 A 10/1998 Saveliev et al.
5,820,821 A 10/1998 Kawagoe et al.
5,821,730 A 10/1998 Drapkin
5,825,981 A 10/1998 Matsuda
5,828,770 A 10/1998 Leis et al.
5,831,597 A 11/1998 West et al.
5,836,045 A 11/1998 Anthony et al.
5,839,156 A 11/1998 Park et al.
5,839,532 A 11/1998 Yoshiji et al.
5,841,259 A 11/1998 Kim et al.
5,867,800 A 2/1999 Leif
5,867,861 A 2/1999 Kasen et al.
5,869,910 A 2/1999 Colens
5,894,621 A 4/1999 Kubo
5,896,611 A 4/1999 Haaga
5,903,124 A 5/1999 Kawakami
5,905,209 A 5/1999 Oreper
5,907,886 A 6/1999 Buscher
5,910,700 A 6/1999 Crotzer
5,911,260 A 6/1999 Suzuki
5,916,008 A 6/1999 Wong
5,924,167 A 7/1999 Wright et al.
5,926,909 A 7/1999 McGee
5,933,102 A 8/1999 Miller et al.
5,933,913 A 8/1999 Wright et al.
5,935,179 A 8/1999 Kleiner et al.
5,935,333 A 8/1999 Davis
5,940,346 A 8/1999 Sadowsky et al.
5,940,927 A 8/1999 Haegermarck et al.
5,940,930 A 8/1999 Oh et al.
5,942,869 A 8/1999 Katou et al.
5,943,730 A 8/1999 Boomgaarden
5,943,733 A 8/1999 Tagliaferri
5,943,933 A 8/1999 Evans et al.
5,947,225 A 9/1999 Kawakami et al.
5,950,408 A 9/1999 Schaedler
5,959,423 A 9/1999 Nakanishi et al.
5,968,281 A 10/1999 Wright et al.
5,974,348 A 10/1999 Rocks
5,974,365 A 10/1999 Mitchell
5,983,448 A 11/1999 Wright et al.
5,984,880 A 11/1999 Lander et al.
5,987,383 A 11/1999 Keller et al.
5,989,700 A 11/1999 Krivopal
5,991,951 A 11/1999 Kubo et al.
5,995,883 A 11/1999 Nishikado
5,995,884 A 11/1999 Allen et al.
5,996,167 A 12/1999 Close
5,998,953 A 12/1999 Nakamura et al.
5,998,971 A 12/1999 Corbridge
6,000,088 A 12/1999 Wright et al.
6,009,358 A 12/1999 Angott et al.
6,012,618 A 1/2000 Matsuo et al.
6,021,545 A 2/2000 Delgado et al.
6,023,813 A 2/2000 Thatcher et al.
6,023,814 A 2/2000 Imamura
6,025,687 A 2/2000 Himeda et al.
6,026,539 A 2/2000 Mouw et al.
6,030,464 A 2/2000 Azevedo
6,030,465 A 2/2000 Marcussen et al.
6,032,327 A 3/2000 Oka et al.
6,032,542 A 3/2000 Warnick et al.
6,036,572 A 3/2000 Sze
6,038,501 A 3/2000 Kawakami
6,040,669 A 3/2000 Hog
6,041,471 A 3/2000 Charky et al.
6,041,472 A 3/2000 Kasen et al.
6,046,800 A 4/2000 Ohtomo et al.
6,049,620 A 4/2000 Dickinson et al.
6,050,648 A 4/2000 Keleny
6,052,821 A 4/2000 Chouly et al.
6,055,042 A 4/2000 Sarangapani
6,055,702 A 5/2000 Imamura et al.
6,061,868 A 5/2000 Moritsch et al.
6,065,182 A 5/2000 Wright et al.
6,070,290 A 6/2000 Schwarze et al.
6,073,432 A 6/2000 Schaedler
6,076,025 A 6/2000 Ueno et al.
6,076,026 A 6/2000 Jambhekar et al.
6,076,226 A 6/2000 Reed
6,076,227 A 6/2000 Schallig et al.
6,081,257 A 6/2000 Zeller
6,088,020 A 7/2000 Mor
6,094,775 A 8/2000 Behmer
6,099,091 A 8/2000 Campbell
6,101,670 A 8/2000 Song
6,101,671 A 8/2000 Wright et al.
6,108,031 A 8/2000 King et al.
6,108,067 A 8/2000 Okamoto
6,108,076 A 8/2000 Hanseder

(56) References Cited

U.S. PATENT DOCUMENTS

| | | | |
|---|---|---|---|
| 6,108,269 | A | 8/2000 | Kabel |
| 6,108,597 | A | 8/2000 | Kirchner et al. |
| 6,108,859 | A | 8/2000 | Burgoon |
| 6,112,143 | A | 8/2000 | Allen et al. |
| 6,112,996 | A | 9/2000 | Matsuo |
| 6,119,057 | A | 9/2000 | Kawagoe |
| 6,122,798 | A | 9/2000 | Kobayashi et al. |
| 6,124,694 | A | 9/2000 | Bancroft et al. |
| 6,125,498 | A | 10/2000 | Roberts et al. |
| 6,131,237 | A | 10/2000 | Kasper et al. |
| 6,138,063 | A | 10/2000 | Himeda |
| 6,142,252 | A | 11/2000 | Kinto et al. |
| 6,146,041 | A | 11/2000 | Chen et al. |
| 6,146,278 | A | 11/2000 | Kobayashi |
| 6,154,279 | A | 11/2000 | Thayer |
| 6,154,694 | A | 11/2000 | Aoki et al. |
| 6,160,479 | A | 12/2000 | Ahlen et al. |
| 6,167,332 | A | 12/2000 | Kurtzberg et al. |
| 6,167,587 | B1 | 1/2001 | Kasper et al. |
| 6,192,548 | B1 | 2/2001 | Huffman |
| 6,192,549 | B1 | 2/2001 | Kasen et al. |
| 6,202,243 | B1 | 3/2001 | Beaufoy et al. |
| 6,216,307 | B1 | 4/2001 | Kaleta et al. |
| 6,220,865 | B1 | 4/2001 | Macri et al. |
| 6,226,830 | B1 | 5/2001 | Hendriks et al. |
| 6,230,362 | B1 | 5/2001 | Kasper et al. |
| 6,237,741 | B1 | 5/2001 | Guidetti |
| 6,240,342 | B1 | 5/2001 | Fiegert et al. |
| 6,243,913 | B1 | 6/2001 | Frank et al. |
| 6,255,793 | B1 | 7/2001 | Peless et al. |
| 6,259,979 | B1 | 7/2001 | Holmquist |
| 6,261,379 | B1 | 7/2001 | Conrad et al. |
| 6,263,539 | B1 | 7/2001 | Baig |
| 6,263,989 | B1 | 7/2001 | Won |
| 6,272,712 | B1 | 8/2001 | Gockel et al. |
| 6,272,936 | B1 | 8/2001 | Oreper et al. |
| 6,276,478 | B1 | 8/2001 | Hopkins et al. |
| 6,278,918 | B1 | 8/2001 | Dickson et al. |
| 6,279,196 | B2 | 8/2001 | Kasen et al. |
| 6,282,526 | B1 | 8/2001 | Ganesh |
| 6,283,034 | B1 | 9/2001 | Miles |
| 6,285,778 | B1 | 9/2001 | Nakajima et al. |
| 6,285,930 | B1 | 9/2001 | Dickson et al. |
| 6,286,181 | B1 | 9/2001 | Kasper et al. |
| 6,300,737 | B1 | 10/2001 | Bergvall et al. |
| 6,321,337 | B1 | 11/2001 | Reshef et al. |
| 6,321,515 | B1 | 11/2001 | Colens |
| 6,323,570 | B1 | 11/2001 | Nishimura et al. |
| 6,324,714 | B1 | 12/2001 | Walz et al. |
| 6,327,741 | B1 | 12/2001 | Reed |
| 6,332,400 | B1 | 12/2001 | Meyer |
| 6,339,735 | B1 | 1/2002 | Peless et al. |
| 6,362,875 | B1 | 3/2002 | Burkley |
| 6,370,453 | B2 | 4/2002 | Sommer |
| 6,374,155 | B1 | 4/2002 | Wallach et al. |
| 6,374,157 | B1 | 4/2002 | Takamura |
| 6,381,802 | B2 | 5/2002 | Park |
| 6,385,515 | B1 | 5/2002 | Dickson et al. |
| 6,388,013 | B1 | 5/2002 | Saraf et al. |
| 6,389,329 | B1 | 5/2002 | Colens |
| 6,397,429 | B1 | 6/2002 | Legatt et al. |
| 6,400,048 | B1 | 6/2002 | Nishimura et al. |
| 6,401,294 | B2 | 6/2002 | Kasper |
| 6,408,226 | B1 | 6/2002 | Byrne et al. |
| 6,412,141 | B2 | 7/2002 | Kasper et al. |
| 6,415,203 | B1 | 7/2002 | Inoue et al. |
| 6,418,586 | B2 | 7/2002 | Fulghum |
| 6,421,870 | B1 | 7/2002 | Basham et al. |
| 6,427,285 | B1 | 8/2002 | Legatt et al. |
| 6,430,471 | B1 | 8/2002 | Kintou et al. |
| 6,431,296 | B1 | 8/2002 | Won |
| 6,437,227 | B1 | 8/2002 | Theimer |
| 6,437,465 | B1 | 8/2002 | Nishimura et al. |
| 6,438,456 | B1 | 8/2002 | Feddema et al. |
| 6,438,793 | B1 | 8/2002 | Miner et al. |
| 6,442,476 | B1 | 8/2002 | Poropat |
| 6,442,789 | B1 | 9/2002 | Legatt et al. |
| 6,443,509 | B1 | 9/2002 | Levin et al. |
| 6,444,003 | B1 | 9/2002 | Sutcliffe |
| 6,446,302 | B1 | 9/2002 | Kasper et al. |
| 6,454,036 | B1 | 9/2002 | Airey et al. |
| D464,091 | S | 10/2002 | Christianson |
| 6,457,206 | B1 | 10/2002 | Judson |
| 6,459,955 | B1 | 10/2002 | Bartsch et al. |
| 6,463,368 | B1 | 10/2002 | Feiten et al. |
| 6,465,982 | B1 | 10/2002 | Bergvall et al. |
| 6,473,167 | B1 | 10/2002 | Odell |
| 6,480,762 | B1 | 11/2002 | Uchikubo et al. |
| 6,481,515 | B1 | 11/2002 | Kirkpatrick et al. |
| 6,482,252 | B1 | 11/2002 | Conrad et al. |
| 6,490,539 | B1 | 12/2002 | Dickson et al. |
| 6,491,127 | B1 | 12/2002 | Holmberg et al. |
| 6,493,612 | B1 | 12/2002 | Bisset et al. |
| 6,493,613 | B2 | 12/2002 | Peless et al. |
| 6,496,754 | B2 | 12/2002 | Song et al. |
| 6,496,755 | B2 | 12/2002 | Wallach et al. |
| 6,502,657 | B2 | 1/2003 | Kerrebrock et al. |
| 6,504,610 | B1 | 1/2003 | Bauer et al. |
| 6,507,773 | B2 | 1/2003 | Parker et al. |
| 6,519,808 | B2 | 2/2003 | Legatt et al. |
| 6,525,509 | B1 | 2/2003 | Petersson et al. |
| D471,243 | S | 3/2003 | Cioffi et al. |
| 6,530,102 | B1 | 3/2003 | Pierce et al. |
| 6,530,117 | B2 | 3/2003 | Peterson |
| 6,532,404 | B2 | 3/2003 | Colens |
| 6,535,793 | B2 | 3/2003 | Allard |
| 6,540,424 | B1 | 4/2003 | Hall et al. |
| 6,540,607 | B2 | 4/2003 | Mokris et al. |
| 6,548,982 | B1 | 4/2003 | Papanikolopoulos et al. |
| 6,553,612 | B1 | 4/2003 | Dyson et al. |
| 6,556,722 | B1 | 4/2003 | Russell et al. |
| 6,556,892 | B2 | 4/2003 | Kuroki et al. |
| 6,557,104 | B2 | 4/2003 | Vu et al. |
| D474,312 | S | 5/2003 | Stephens et al. |
| 6,563,130 | B2 | 5/2003 | Dworkowski et al. |
| 6,571,415 | B2 | 6/2003 | Gerber et al. |
| 6,571,422 | B1 | 6/2003 | Gordon et al. |
| 6,572,711 | B2 | 6/2003 | Sclafani et al. |
| 6,574,536 | B1 | 6/2003 | Kawagoe et al. |
| 6,580,246 | B2 | 6/2003 | Jacobs |
| 6,584,376 | B1 | 6/2003 | Van Kommer |
| 6,586,908 | B2 | 7/2003 | Petersson et al. |
| 6,587,573 | B1 | 7/2003 | Stam et al. |
| 6,590,222 | B1 | 7/2003 | Bisset et al. |
| 6,594,551 | B2 | 7/2003 | McKinney et al. |
| 6,594,844 | B2 | 7/2003 | Jones |
| 6,597,076 | B2 | 7/2003 | Scheible et al. |
| D478,884 | S | 8/2003 | Slipy et al. |
| 6,601,265 | B1 | 8/2003 | Burlington |
| 6,604,021 | B2 | 8/2003 | Imai et al. |
| 6,604,022 | B2 | 8/2003 | Parker et al. |
| 6,605,156 | B1 | 8/2003 | Clark et al. |
| 6,609,269 | B2 | 8/2003 | Kasper |
| 6,611,120 | B2 | 8/2003 | Song et al. |
| 6,611,734 | B2 | 8/2003 | Parker et al. |
| 6,611,738 | B2 | 8/2003 | Ruffner |
| 6,615,108 | B1 | 9/2003 | Peless et al. |
| 6,615,434 | B1 | 9/2003 | Davis et al. |
| 6,615,885 | B1 | 9/2003 | Ohm |
| 6,622,465 | B2 | 9/2003 | Jerome et al. |
| 6,624,744 | B1 | 9/2003 | Wilson et al. |
| 6,625,843 | B2 | 9/2003 | Kim et al. |
| 6,629,028 | B2 | 9/2003 | Paromtchik et al. |
| 6,633,150 | B1 | 10/2003 | Wallach et al. |
| 6,637,546 | B1 | 10/2003 | Wang |
| 6,639,659 | B2 | 10/2003 | Granger |
| 6,658,325 | B2 | 12/2003 | Zweig |
| 6,658,354 | B2 | 12/2003 | Lin |
| 6,658,692 | B2 | 12/2003 | Lenkiewicz et al. |
| 6,658,693 | B1 | 12/2003 | Reed |
| 6,661,239 | B1 | 12/2003 | Ozick |
| 6,662,889 | B2 | 12/2003 | De Fazio et al. |
| 6,668,951 | B2 | 12/2003 | Won |
| 6,670,817 | B2 | 12/2003 | Fournier et al. |

(56) References Cited

U.S. PATENT DOCUMENTS

| | | | |
|---|---|---|---|
| 6,671,592 | B1 | 12/2003 | Bisset et al. |
| 6,671,925 | B2 | 1/2004 | Field et al. |
| 6,677,938 | B1 | 1/2004 | Maynard |
| 6,687,571 | B1 | 2/2004 | Byrne et al. |
| 6,690,134 | B1 | 2/2004 | Jones et al. |
| 6,690,993 | B2 | 2/2004 | Foulke et al. |
| 6,697,147 | B2 | 2/2004 | Ko et al. |
| 6,705,332 | B2 | 3/2004 | Field et al. |
| 6,711,280 | B2 | 3/2004 | Stafsudd et al. |
| 6,732,826 | B2 | 5/2004 | Song et al. |
| 6,735,811 | B2 | 5/2004 | Field et al. |
| 6,735,812 | B2 | 5/2004 | Hekman et al. |
| 6,737,591 | B1 | 5/2004 | Lapstun et al. |
| 6,741,054 | B2 | 5/2004 | Koselka et al. |
| 6,741,364 | B2 | 5/2004 | Lange et al. |
| 6,748,297 | B2 | 6/2004 | Song et al. |
| 6,756,703 | B2 | 6/2004 | Chang |
| 6,760,647 | B2 | 7/2004 | Nourbakhsh et al. |
| 6,764,373 | B1 | 7/2004 | Osawa et al. |
| 6,769,004 | B2 | 7/2004 | Barrett |
| 6,774,596 | B1 | 8/2004 | Bisset |
| 6,779,380 | B1 | 8/2004 | Nieuwkamp |
| 6,781,338 | B2 | 8/2004 | Jones et al. |
| 6,809,490 | B2 | 10/2004 | Jones et al. |
| 6,810,305 | B2 | 10/2004 | Kirkpatrick |
| 6,810,350 | B2 | 10/2004 | Blakley |
| 6,830,120 | B1 | 12/2004 | Yashima et al. |
| 6,832,407 | B2 | 12/2004 | Salem et al. |
| 6,836,701 | B2 | 12/2004 | McKee |
| 6,841,963 | B2 | 1/2005 | Song et al. |
| 6,845,297 | B2 | 1/2005 | Allard |
| 6,848,146 | B2 | 2/2005 | Wright et al. |
| 6,854,148 | B1 | 2/2005 | Rief et al. |
| 6,856,811 | B2 | 2/2005 | Burdue et al. |
| 6,859,010 | B2 | 2/2005 | Jeon et al. |
| 6,859,682 | B2 | 2/2005 | Naka et al. |
| 6,860,206 | B1 | 3/2005 | Rudakevych et al. |
| 6,865,447 | B2 | 3/2005 | Lau et al. |
| 6,870,792 | B2 | 3/2005 | Chiappetta |
| 6,871,115 | B2 | 3/2005 | Huang et al. |
| 6,883,201 | B2 | 4/2005 | Jones et al. |
| 6,886,651 | B1 | 5/2005 | Slocum et al. |
| 6,888,333 | B2 | 5/2005 | Laby |
| 6,901,624 | B2 | 6/2005 | Mori et al. |
| 6,906,702 | B1 | 6/2005 | Tanaka et al. |
| 6,914,403 | B2 | 7/2005 | Tsurumi |
| 6,917,854 | B2 | 7/2005 | Bayer |
| 6,925,357 | B2 | 8/2005 | Wang et al. |
| 6,925,679 | B2 | 8/2005 | Wallach et al. |
| 6,929,548 | B2 | 8/2005 | Wang |
| D510,066 | S | 9/2005 | Hickey et al. |
| 6,938,298 | B2 | 9/2005 | Aasen |
| 6,940,291 | B1 | 9/2005 | Ozick |
| 6,941,199 | B1 | 9/2005 | Bottomley et al. |
| 6,956,348 | B2 | 10/2005 | Landry et al. |
| 6,957,712 | B2 | 10/2005 | Song et al. |
| 6,960,986 | B2 | 11/2005 | Asama et al. |
| 6,965,209 | B2 | 11/2005 | Jones et al. |
| 6,965,211 | B2 | 11/2005 | Tsurumi |
| 6,968,592 | B2 | 11/2005 | Takeuchi et al. |
| 6,971,140 | B2 | 12/2005 | Kim |
| 6,975,246 | B1 | 12/2005 | Trudeau |
| 6,980,229 | B1 | 12/2005 | Ebersole |
| 6,985,556 | B2 | 1/2006 | Shanmugavel et al. |
| 6,993,954 | B1 | 2/2006 | George et al. |
| 6,999,850 | B2 | 2/2006 | McDonald |
| 7,013,527 | B2 | 3/2006 | Thomas et al. |
| 7,024,278 | B2 | 4/2006 | Chiappetta et al. |
| 7,024,280 | B2 | 4/2006 | Parker et al. |
| 7,027,893 | B2 | 4/2006 | Perry et al. |
| 7,030,768 | B2 | 4/2006 | Wanie |
| 7,031,805 | B2 | 4/2006 | Lee et al. |
| 7,032,469 | B2 | 4/2006 | Bailey |
| 7,040,869 | B2 | 5/2006 | Beenker |
| 7,041,029 | B2 | 5/2006 | Fulghum et al. |
| 7,051,399 | B2 | 5/2006 | Field et al. |
| 7,053,578 | B2 | 5/2006 | Diehl et al. |
| 7,054,716 | B2 | 5/2006 | McKee et al. |
| 7,055,210 | B2 | 6/2006 | Keppler et al. |
| 7,057,120 | B2 | 6/2006 | Ma et al. |
| 7,057,643 | B2 | 6/2006 | Iida et al. |
| 7,059,012 | B2 | 6/2006 | Song et al. |
| 7,065,430 | B2 | 6/2006 | Naka et al. |
| 7,066,291 | B2 | 6/2006 | Martins et al. |
| 7,069,124 | B1 | 6/2006 | Whittaker et al. |
| 7,079,923 | B2 | 7/2006 | Abramson et al. |
| 7,085,623 | B2 | 8/2006 | Siegers |
| 7,085,624 | B2 | 8/2006 | Aldred et al. |
| 7,113,847 | B2 | 9/2006 | Chmura et al. |
| 7,133,746 | B2 | 11/2006 | Abramson et al. |
| 7,142,198 | B2 | 11/2006 | Lee |
| 7,148,458 | B2 | 12/2006 | Schell et al. |
| 7,155,308 | B2 | 12/2006 | Jones |
| 7,167,775 | B2 | 1/2007 | Abramson et al. |
| 7,171,285 | B2 | 1/2007 | Kim et al. |
| 7,173,391 | B2 | 2/2007 | Jones et al. |
| 7,174,238 | B1 | 2/2007 | Zweig |
| 7,188,000 | B2 | 3/2007 | Chiappetta et al. |
| 7,193,384 | B1 | 3/2007 | Norman et al. |
| 7,196,487 | B2 | 3/2007 | Jones et al. |
| 7,201,786 | B2 | 4/2007 | Wegelin et al. |
| 7,206,677 | B2 | 4/2007 | Hulden |
| 7,211,980 | B1 | 5/2007 | Bruemmer et al. |
| 7,225,500 | B2 | 6/2007 | Diehl et al. |
| 7,246,405 | B2 | 7/2007 | Yan |
| 7,248,951 | B2 | 7/2007 | Hulden |
| 7,275,280 | B2 | 10/2007 | Haegermarck et al. |
| 7,283,892 | B1 | 10/2007 | Boillot et al. |
| 7,288,912 | B2 | 10/2007 | Landry et al. |
| 7,318,248 | B1 | 1/2008 | Yan |
| 7,320,149 | B1 | 1/2008 | Huffman et al. |
| 7,321,807 | B2 | 1/2008 | Laski |
| 7,324,870 | B2 | 1/2008 | Lee |
| 7,328,196 | B2 | 2/2008 | Peters |
| 7,332,890 | B2 | 2/2008 | Cohen et al. |
| 7,346,428 | B1 | 3/2008 | Huffman et al. |
| 7,352,153 | B2 | 4/2008 | Yan |
| 7,359,766 | B2 | 4/2008 | Jeon et al. |
| 7,360,277 | B2 | 4/2008 | Moshenrose et al. |
| 7,363,108 | B2 | 4/2008 | Noda et al. |
| 7,388,343 | B2 | 6/2008 | Jones et al. |
| 7,388,879 | B2 | 6/2008 | Sabe et al. |
| 7,389,156 | B2 | 6/2008 | Ziegler et al. |
| 7,389,166 | B2 | 6/2008 | Harwig et al. |
| 7,408,157 | B2 | 8/2008 | Yan |
| 7,418,762 | B2 | 9/2008 | Arai et al. |
| 7,430,455 | B2 | 9/2008 | Casey et al. |
| 7,430,462 | B2 | 9/2008 | Chiu et al. |
| 7,441,298 | B2 | 10/2008 | Svendsen et al. |
| 7,444,206 | B2 | 10/2008 | Abramson et al. |
| 7,448,113 | B2 | 11/2008 | Jones et al. |
| 7,459,871 | B2 | 12/2008 | Landry et al. |
| 7,467,026 | B2 | 12/2008 | Sakagami et al. |
| 7,474,941 | B2 | 1/2009 | Kim et al. |
| 7,503,096 | B2 | 3/2009 | Lin |
| 7,513,007 | B2 | 4/2009 | Chernoff |
| 7,515,991 | B2 | 4/2009 | Egawa et al. |
| 7,539,557 | B2 | 5/2009 | Yamauchi |
| 7,555,363 | B2 | 6/2009 | Augenbraun et al. |
| 7,557,703 | B2 | 7/2009 | Yamada et al. |
| 7,568,259 | B2 | 8/2009 | Yan |
| 7,571,511 | B2 | 8/2009 | Jones et al. |
| 7,578,020 | B2 | 8/2009 | Jaworski et al. |
| 7,600,521 | B2 | 10/2009 | Woo |
| 7,603,744 | B2 | 10/2009 | Reindle |
| 7,611,583 | B2 | 11/2009 | Buckley et al. |
| 7,617,557 | B2 | 11/2009 | Reindle |
| 7,620,476 | B2 | 11/2009 | Morse et al. |
| 7,636,928 | B2 | 12/2009 | Uno |
| 7,636,982 | B2 | 12/2009 | Jones et al. |
| 7,647,144 | B2 | 1/2010 | Haegermarck |
| 7,650,666 | B2 | 1/2010 | Jang |
| 7,660,650 | B2 | 2/2010 | Kawagoe et al. |
| 7,663,333 | B2 | 2/2010 | Jones et al. |

(56) References Cited

U.S. PATENT DOCUMENTS 7,693,605 B2 4/2010 Park
7,706,917 B1 4/2010 Chiappetta et al.
7,761,954 B2 7/2010 Ziegler et al.
7,765,635 B2 8/2010 Park
7,784,147 B2 8/2010 Burkholder et al.
7,801,645 B2 9/2010 Taylor et al.
7,805,220 B2 9/2010 Taylor et al.
7,809,944 B2 10/2010 Kawamoto
7,832,048 B2 11/2010 Harwig et al.
7,849,555 B2 12/2010 Hahm et al.
7,853,645 B2 12/2010 Brown et al.
7,860,680 B2 12/2010 Arms et al.
7,920,941 B2 4/2011 Park et al.
7,937,800 B2 5/2011 Yan
7,957,836 B2 6/2011 Myeong et al.
8,087,117 B2 1/2012 Kapoor et al.
2001/0004719 A1 6/2001 Sommer
2001/0013929 A1 8/2001 Torsten
2001/0020200 A1 9/2001 Das et al.
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De Fazio et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0015232 A1 1/2003 Nguyen
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0159232 A1 8/2003 Hekman et al.
2003/0168081 A1 9/2003 Lee et al.
2003/0175138 A1 9/2003 Beenker
2003/0192144 A1 10/2003 Song et al.
2003/0193657 A1 10/2003 Uomori et al.
2003/0216834 A1 11/2003 Allard
2003/0221114 A1 11/2003 Hino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Wosewick et al.
2004/0049877 A1 3/2004 Jones et al.
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0083570 A1 5/2004 Song et al.
2004/0085037 A1 5/2004 Jones et al.
2004/0088079 A1 5/2004 Lavarec et al.
2004/0093122 A1 5/2004 Galibraith
2004/0098167 A1 5/2004 Yi et al.
2004/0111184 A1 6/2004 Chiappetta et al.
2004/0111821 A1 6/2004 Lenkiewicz et al.
2004/0113777 A1 6/2004 Matsuhira et al.
2004/0117064 A1 6/2004 McDonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.
2004/0187249 A1 9/2004 Jones et al.
2004/0187457 A1 9/2004 Colens
2004/0196451 A1 10/2004 Aoyama
2004/0200505 A1 10/2004 Taylor et al.
2004/0201361 A1 10/2004 Koh et al.
2004/0204792 A1 10/2004 Taylor et al.
2004/0204804 A1 10/2004 Lee et al.
2004/0207355 A1 10/2004 Jones et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.
2005/0010331 A1 1/2005 Taylor et al.
2005/0015920 A1 1/2005 Kim et al.
2005/0015921 A1 1/2005 Pullins
2005/0021181 A1 1/2005 Kim et al.
2005/0028316 A1 2/2005 Thomas et al.
2005/0053912 A1 3/2005 Roth et al.
2005/0055796 A1 3/2005 Wright et al.
2005/0067994 A1 3/2005 Jones et al.
2005/0081782 A1 4/2005 Buckley et al.
2005/0085947 A1 4/2005 Aldred et al.
2005/0091782 A1 5/2005 Gordon et al.
2005/0091786 A1 5/2005 Wright et al.
2005/0132680 A1 6/2005 Wegelin et al.
2005/0137749 A1 6/2005 Jeon et al.
2005/0144751 A1 7/2005 Kegg et al.
2005/0150074 A1 7/2005 Diehl et al.
2005/0150519 A1 7/2005 Keppler et al.
2005/0154795 A1 7/2005 Kuz et al.
2005/0156562 A1 7/2005 Cohen et al.
2005/0162119 A1 7/2005 Landry et al.

(56) References Cited

U.S. PATENT DOCUMENTS

| | | | |
|---|---|---|---|
| 2005/0163119 | A1 | 7/2005 | Ito et al. |
| 2005/0165508 | A1 | 7/2005 | Kanda et al. |
| 2005/0166354 | A1 | 8/2005 | Uehigashi |
| 2005/0166355 | A1 | 8/2005 | Tani |
| 2005/0172445 | A1 | 8/2005 | Diehl et al. |
| 2005/0183229 | A1 | 8/2005 | Uehigashi |
| 2005/0183230 | A1 | 8/2005 | Uehigashi |
| 2005/0187678 | A1 | 8/2005 | Myeong et al. |
| 2005/0192707 | A1 | 9/2005 | Park et al. |
| 2005/0204717 | A1 | 9/2005 | Colens |
| 2005/0209736 | A1 | 9/2005 | Kawagoe |
| 2005/0211880 | A1 | 9/2005 | Schell et al. |
| 2005/0212929 | A1 | 9/2005 | Schell et al. |
| 2005/0213082 | A1 | 9/2005 | DiBernardo et al. |
| 2005/0213109 | A1 | 9/2005 | Schell et al. |
| 2005/0217042 | A1 | 10/2005 | Reindle |
| 2005/0218852 | A1 | 10/2005 | Landry et al. |
| 2005/0222933 | A1 | 10/2005 | Wesby |
| 2005/0229340 | A1 | 10/2005 | Sawalski et al. |
| 2005/0229355 | A1 | 10/2005 | Crouch et al. |
| 2005/0235451 | A1 | 10/2005 | Yan |
| 2005/0251292 | A1 | 11/2005 | Casey et al. |
| 2005/0255425 | A1 | 11/2005 | Pierson |
| 2005/0258154 | A1 | 11/2005 | Blankenship et al. |
| 2005/0273967 | A1 | 12/2005 | Taylor et al. |
| 2005/0287038 | A1 | 12/2005 | Dubrovsky et al. |
| 2005/0288819 | A1 | 12/2005 | De Guzman |
| 2006/0000050 | A1 | 1/2006 | Cipolla et al. |
| 2006/0009879 | A1 | 1/2006 | Lynch et al. |
| 2006/0010638 | A1 | 1/2006 | Shimizu et al. |
| 2006/0020369 | A1 | 1/2006 | Taylor et al. |
| 2006/0020370 | A1 | 1/2006 | Abramson |
| 2006/0021168 | A1 | 2/2006 | Nishikawa |
| 2006/0025134 | A1 | 2/2006 | Cho et al. |
| 2006/0037170 | A1 | 2/2006 | Shimizu |
| 2006/0042042 | A1 | 3/2006 | Mertes et al. |
| 2006/0044546 | A1 | 3/2006 | Lewin et al. |
| 2006/0060216 | A1 | 3/2006 | Woo |
| 2006/0061657 | A1 | 3/2006 | Rew et al. |
| 2006/0064828 | A1 | 3/2006 | Stein et al. |
| 2006/0087273 | A1 | 4/2006 | Ko et al. |
| 2006/0089765 | A1 | 4/2006 | Pack et al. |
| 2006/0100741 | A1 | 5/2006 | Jung |
| 2006/0107894 | A1 | 5/2006 | Buckley et al. |
| 2006/0119839 | A1 | 6/2006 | Bertin et al. |
| 2006/0143295 | A1 | 6/2006 | Costa-Requena et al. |
| 2006/0146776 | A1 | 7/2006 | Kim |
| 2006/0150361 | A1 | 7/2006 | Aldred et al. |
| 2006/0184293 | A1 | 8/2006 | Konandreas et al. |
| 2006/0185690 | A1 | 8/2006 | Song et al. |
| 2006/0190133 | A1 | 8/2006 | Konandreas et al. |
| 2006/0190134 | A1 | 8/2006 | Ziegler et al. |
| 2006/0190146 | A1 | 8/2006 | Morse et al. |
| 2006/0196003 | A1 | 9/2006 | Song et al. |
| 2006/0200281 | A1 | 9/2006 | Ziegler et al. |
| 2006/0220900 | A1 | 10/2006 | Ceskutti et al. |
| 2006/0229774 | A1 | 10/2006 | Park et al. |
| 2006/0259194 | A1 | 11/2006 | Chiu |
| 2006/0259494 | A1 | 11/2006 | Watson et al. |
| 2006/0278161 | A1 | 12/2006 | Burkholder et al. |
| 2006/0288519 | A1 | 12/2006 | Jaworski et al. |
| 2006/0293787 | A1 | 12/2006 | Kanda et al. |
| 2006/0293808 | A1 | 12/2006 | Qian |
| 2007/0006404 | A1 | 1/2007 | Cheng et al. |
| 2007/0016328 | A1 | 1/2007 | Ziegler et al. |
| 2007/0017061 | A1 | 1/2007 | Yan |
| 2007/0028574 | A1 | 2/2007 | Yan |
| 2007/0032904 | A1 | 2/2007 | Kawagoe et al. |
| 2007/0042716 | A1 | 2/2007 | Goodall et al. |
| 2007/0043459 | A1 | 2/2007 | Abbott et al. |
| 2007/0061041 | A1 | 3/2007 | Zweig |
| 2007/0061043 | A1 | 3/2007 | Seaburg |
| 2007/0114975 | A1 | 5/2007 | Cohen et al. |
| 2007/0142964 | A1 | 6/2007 | Abramson |
| 2007/0150096 | A1 | 6/2007 | Yeh et al. |
| 2007/0156286 | A1 | 7/2007 | Yamauchi |
| 2007/0157415 | A1 | 7/2007 | Lee et al. |
| 2007/0157420 | A1 | 7/2007 | Lee et al. |
| 2007/0179670 | A1 | 8/2007 | Chiappetta et al. |
| 2007/0226949 | A1 | 10/2007 | Hahm et al. |
| 2007/0234492 | A1 | 10/2007 | Svendsen et al. |
| 2007/0244610 | A1 | 10/2007 | Ozick et al. |
| 2007/0245511 | A1 | 10/2007 | Hahm et al. |
| 2007/0250212 | A1 | 10/2007 | Halloran et al. |
| 2007/0261193 | A1 | 11/2007 | Gordon et al. |
| 2007/0266508 | A1 | 11/2007 | Jones et al. |
| 2008/0007203 | A1 | 1/2008 | Cohen et al. |
| 2008/0039974 | A1 | 2/2008 | Sandin et al. |
| 2008/0052846 | A1 | 3/2008 | Kapoor et al. |
| 2008/0091304 | A1 | 4/2008 | Ozick et al. |
| 2008/0109126 | A1 | 5/2008 | Sandin et al. |
| 2008/0134458 | A1 | 6/2008 | Ziegler et al. |
| 2008/0140255 | A1 | 6/2008 | Ziegler et al. |
| 2008/0155768 | A1 | 7/2008 | Ziegler et al. |
| 2008/0161969 | A1 | 7/2008 | Lee et al. |
| 2008/0184518 | A1 | 8/2008 | Taylor et al. |
| 2008/0266748 | A1 | 10/2008 | Lee |
| 2008/0276407 | A1 | 11/2008 | Schnittman et al. |
| 2008/0281470 | A1 | 11/2008 | Gilbert et al. |
| 2008/0282494 | A1 | 11/2008 | Won et al. |
| 2008/0294288 | A1 | 11/2008 | Yamauchi |
| 2008/0302586 | A1 | 12/2008 | Yan |
| 2008/0307590 | A1 | 12/2008 | Jones et al. |
| 2009/0007366 | A1 | 1/2009 | Svendsen et al. |
| 2009/0038089 | A1 | 2/2009 | Landry et al. |
| 2009/0048727 | A1 | 2/2009 | Hong et al. |
| 2009/0049640 | A1 | 2/2009 | Lee et al. |
| 2009/0055022 | A1 | 2/2009 | Casey et al. |
| 2009/0102296 | A1 | 4/2009 | Greene et al. |
| 2009/0292393 | A1 | 11/2009 | Casey et al. |
| 2010/0006028 | A1 | 1/2010 | Buckley et al. |
| 2010/0011529 | A1 | 1/2010 | Won et al. |
| 2010/0049365 | A1 | 2/2010 | Jones et al. |
| 2010/0063628 | A1 | 3/2010 | Landry et al. |
| 2010/0082193 | A1 | 4/2010 | Chiappetta |
| 2010/0107355 | A1 | 5/2010 | Won et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2010/0268384 | A1 | 10/2010 | Jones et al. |
| 2010/0293742 | A1 | 11/2010 | Chung et al. |
| 2010/0312429 | A1 | 12/2010 | Jones et al. |

FOREIGN PATENT DOCUMENTS

| | | | |
|---|---|---|---|
| DE | 3317376 | C2 | 12/1987 |
| DE | 3536907 | C2 | 2/1989 |
| DE | 3404202 | C2 | 12/1992 |
| DE | 199311014 | U1 | 10/1993 |
| DE | 4338841 | A1 | 5/1995 |
| DE | 4414683 | A1 | 10/1995 |
| DE | 19849978 | | 2/2001 |
| DE | 102004038074 | | 6/2005 |
| DE | 10357636 | | 7/2005 |
| DE | 102004041021 | B3 | 8/2005 |
| DE | 102005046813 | A1 | 4/2007 |
| DK | 338988 | A | 12/1988 |
| EP | 0265542 | A1 | 5/1988 |
| EP | 0281085 | A2 | 9/1988 |
| EP | 0286328 | A1 | 10/1988 |
| EP | 0294101 | A2 | 12/1988 |
| EP | 0352045 | A2 | 1/1990 |
| EP | 0307381 | | 7/1990 |
| EP | 0358628 | | 5/1991 |
| EP | 0433697 | A2 | 6/1991 |
| EP | 0437024 | A1 | 7/1991 |
| EP | 0479273 | | 5/1993 |
| EP | 0554978 | A2 | 8/1993 |
| EP | 0615719 | A1 | 9/1994 |
| EP | 0792726 | A1 | 9/1997 |
| EP | 0930040 | A2 | 7/1999 |
| EP | 0845237 | B1 | 4/2000 |
| EP | 0861629 | B1 | 9/2001 |
| EP | 1172719 | | 1/2002 |

(56) References Cited

FOREIGN PATENT DOCUMENTS

| | | | |
|---|---|---|---|
| EP | 1228734 | A2 | 8/2002 |
| EP | 1243218 | A1 | 9/2002 |
| EP | 1331537 | | 7/2003 |
| EP | 1380245 | A1 | 1/2004 |
| EP | 1380246 | A2 | 1/2004 |
| EP | 1018315 | B1 | 11/2004 |
| EP | 1553472 | A1 | 7/2005 |
| EP | 1557730 | A1 | 7/2005 |
| EP | 1642522 | A2 | 4/2006 |
| EP | 1836941 | A2 | 9/2007 |
| ES | 2238196 | A1 | 8/2005 |
| FR | 722755 | | 3/1932 |
| FR | 2601443 | A1 | 1/1988 |
| FR | 2828589 | A1 | 2/2003 |
| GB | 702426 | | 1/1954 |
| GB | 2128842 | A | 5/1984 |
| GB | 2213047 | | 8/1989 |
| GB | 2225221 | A | 5/1990 |
| GB | 2267360 | A | 12/1993 |
| GB | 2283838 | A | 5/1995 |
| GB | 2284957 | A | 6/1995 |
| GB | 2300082 | A | 10/1996 |
| GB | 2404330 | A | 2/2005 |
| GB | 2417354 | A | 2/2006 |
| JP | 53021869 | | 2/1978 |
| JP | 53110257 | A2 | 9/1978 |
| JP | 57014726 | | 1/1982 |
| JP | 57064217 | | 4/1982 |
| JP | 59005315 | | 2/1984 |
| JP | 59033511 | U | 3/1984 |
| JP | 59094005 | | 5/1984 |
| JP | 59099308 | | 6/1984 |
| JP | 59112311 | | 6/1984 |
| JP | 59120124 | | 7/1984 |
| JP | 59131668 | | 9/1984 |
| JP | 59164973 | | 9/1984 |
| JP | 59184917 | A | 10/1984 |
| JP | 2283343 | A2 | 11/1984 |
| JP | 59212924 | | 12/1984 |
| JP | 59226909 | | 12/1984 |
| JP | 60089213 | A | 5/1985 |
| JP | 60211510 | A | 10/1985 |
| JP | 60259895 | | 12/1985 |
| JP | 61023221 | | 1/1986 |
| JP | 61097712 | A | 5/1986 |
| JP | 61160366 | | 7/1986 |
| JP | 62070709 | | 4/1987 |
| JP | 62074018 | A | 4/1987 |
| JP | 62120510 | A | 6/1987 |
| JP | 62154008 | | 7/1987 |
| JP | 62164431 | | 7/1987 |
| JP | 62263507 | A | 11/1987 |
| JP | 62263508 | A | 11/1987 |
| JP | 62189057 | U | 12/1987 |
| JP | 63079623 | A | 4/1988 |
| JP | 63158032 | | 7/1988 |
| JP | 63183032 | | 7/1988 |
| JP | 63203483 | A | 8/1988 |
| JP | 63241610 | A | 10/1988 |
| JP | 1118752 | | 8/1989 |
| JP | 206312 | U | 1/1990 |
| JP | 2026312 | | 6/1990 |
| JP | 3051023 | A | 3/1991 |
| JP | 4019586 | | 1/1992 |
| JP | 4074285 | A | 3/1992 |
| JP | 4084921 | A | 3/1992 |
| JP | 5023269 | A | 2/1993 |
| JP | 5042076 | A | 2/1993 |
| JP | 5046246 | | 2/1993 |
| JP | 5091604 | A | 4/1993 |
| JP | 5095879 | A | 4/1993 |
| JP | 5150827 | A | 6/1993 |
| JP | 5150829 | A | 6/1993 |
| JP | 5054620 | U | 7/1993 |
| JP | 5040519 | Y2 | 10/1993 |
| JP | 05257527 | A | 10/1993 |
| JP | 5257533 | | 10/1993 |
| JP | 05285861 | A | 11/1993 |
| JP | 5302836 | A | 11/1993 |
| JP | 5312514 | A | 11/1993 |
| JP | 05046239 | Y2 | 12/1993 |
| JP | 5341904 | A | 12/1993 |
| JP | 6003251 | U | 1/1994 |
| JP | 6038912 | | 2/1994 |
| JP | 6026312 | | 4/1994 |
| JP | 6137828 | A | 5/1994 |
| JP | 6154143 | A | 6/1994 |
| JP | 6293095 | A | 10/1994 |
| JP | 6327598 | A | 11/1994 |
| JP | 06327598 | A | 11/1994 |
| JP | 6105781 | A | 12/1994 |
| JP | 7047046 | A | 2/1995 |
| JP | 07129239 | A | 5/1995 |
| JP | 7059702 | B | 6/1995 |
| JP | 7222705 | A2 | 8/1995 |
| JP | 7270518 | A | 10/1995 |
| JP | 7281742 | | 10/1995 |
| JP | 7281752 | | 10/1995 |
| JP | 7295636 | | 11/1995 |
| JP | 7311041 | | 11/1995 |
| JP | 7313417 | A | 12/1995 |
| JP | 7319542 | | 12/1995 |
| JP | 8000393 | | 1/1996 |
| JP | 8016241 | | 1/1996 |
| JP | 8016776 | A | 1/1996 |
| JP | 8063229 | | 3/1996 |
| JP | 8083125 | | 3/1996 |
| JP | 8084696 | A | 4/1996 |
| JP | 8089449 | A | 4/1996 |
| JP | 08089451 | A | 4/1996 |
| JP | 2520732 | | 5/1996 |
| JP | 8123548 | A | 5/1996 |
| JP | 8152916 | A | 6/1996 |
| JP | 8256960 | | 10/1996 |
| JP | 8263137 | A | 10/1996 |
| JP | 8286741 | | 11/1996 |
| JP | 8286744 | | 11/1996 |
| JP | 8322774 | | 12/1996 |
| JP | 8335112 | A | 12/1996 |
| JP | 8339297 | A | 12/1996 |
| JP | 9043901 | | 2/1997 |
| JP | 9044240 | A | 2/1997 |
| JP | 9047413 | | 2/1997 |
| JP | 9066855 | A | 3/1997 |
| JP | 9145309 | A | 6/1997 |
| JP | 9160644 | A | 6/1997 |
| JP | 09179625 | A | 7/1997 |
| JP | 9179685 | | 7/1997 |
| JP | 09185410 | | 7/1997 |
| JP | 9192069 | A | 7/1997 |
| JP | 2555263 | Y2 | 8/1997 |
| JP | 9204223 | | 8/1997 |
| JP | 09206258 | A | 8/1997 |
| JP | 9233712 | A | 9/1997 |
| JP | 9251318 | | 9/1997 |
| JP | 9265319 | A | 10/1997 |
| JP | 9269807 | A | 10/1997 |
| JP | 9269810 | A | 10/1997 |
| JP | 9319431 | A1 | 12/1997 |
| JP | 9319432 | A | 12/1997 |
| JP | 9319434 | A | 12/1997 |
| JP | 9325812 | A | 12/1997 |
| JP | 10055215 | A | 2/1998 |
| JP | 10117973 | A | 5/1998 |
| JP | 10118963 | A | 5/1998 |
| JP | 10165738 | A | 6/1998 |
| JP | 10177414 | A | 6/1998 |
| JP | 10214114 | | 8/1998 |
| JP | 10228316 | | 8/1998 |
| JP | 10240342 | | 9/1998 |
| JP | 10260727 | | 9/1998 |
| JP | 10295595 | A | 11/1998 |
| JP | 10314088 | | 12/1998 |
| JP | 11015941 | A | 1/1999 |

(56) References Cited

FOREIGN PATENT DOCUMENTS

| | | | |
|---|---|---|---|
| JP | 11065655 | | 3/1999 |
| JP | 11085269 | | 3/1999 |
| JP | 11102219 | | 4/1999 |
| JP | 11102220 | A | 4/1999 |
| JP | 11162454 | A | 6/1999 |
| JP | 11174145 | A | 7/1999 |
| JP | 11175149 | A | 7/1999 |
| JP | 11178764 | A | 7/1999 |
| JP | 11178765 | A | 7/1999 |
| JP | 11212642 | A | 8/1999 |
| JP | 11213157 | A | 8/1999 |
| JP | 11508810 | | 8/1999 |
| JP | 11248806 | | 9/1999 |
| JP | 11510935 | | 9/1999 |
| JP | 11282532 | A | 10/1999 |
| JP | 11282533 | A | 10/1999 |
| JP | 11295412 | A | 10/1999 |
| JP | 11346964 | | 12/1999 |
| JP | 2000047728 | | 2/2000 |
| JP | 2000056006 | A | 2/2000 |
| JP | 2000056831 | A | 2/2000 |
| JP | 2000060782 | A | 2/2000 |
| JP | 2000066722 | A | 3/2000 |
| JP | 2000075925 | A | 3/2000 |
| JP | 2000102499 | A | 4/2000 |
| JP | 10240343 | | 5/2000 |
| JP | 2000275321 | | 10/2000 |
| JP | 2000279353 | A | 10/2000 |
| JP | 2000353014 | A | 12/2000 |
| JP | 2001022443 | A | 1/2001 |
| JP | 2001067588 | | 3/2001 |
| JP | 2001087182 | | 4/2001 |
| JP | 2001121455 | | 5/2001 |
| JP | 2001125641 | | 5/2001 |
| JP | 2001508572 | A | 6/2001 |
| JP | 2001197008 | A | 7/2001 |
| JP | 3197758 | B2 | 8/2001 |
| JP | 3201903 | B2 | 8/2001 |
| JP | 2001212052 | | 8/2001 |
| JP | 2001216482 | A | 8/2001 |
| JP | 2001258807 | | 9/2001 |
| JP | 2001265437 | A | 9/2001 |
| JP | 2001275908 | A | 10/2001 |
| JP | 2001289939 | | 10/2001 |
| JP | 2001306170 | A | 11/2001 |
| JP | 2001320781 | | 11/2001 |
| JP | 2001321308 | | 11/2001 |
| JP | 2001525567 | | 12/2001 |
| JP | 2002073170 | A | 3/2002 |
| JP | 2002078650 | A | 3/2002 |
| JP | 2002204768 | A | 7/2002 |
| JP | 2002204769 | A | 7/2002 |
| JP | 2002247510 | A | 8/2002 |
| JP | 3356170 | | 10/2002 |
| JP | 2002532178 | | 10/2002 |
| JP | 2002532180 | A | 10/2002 |
| JP | 2002323925 | | 11/2002 |
| JP | 2002333920 | A | 11/2002 |
| JP | 2002345706 | A | 12/2002 |
| JP | 2002355206 | | 12/2002 |
| JP | 2002360471 | A | 12/2002 |
| JP | 2002360479 | | 12/2002 |
| JP | 2002360482 | A | 12/2002 |
| JP | 2002366227 | | 12/2002 |
| JP | 2002369778 | | 12/2002 |
| JP | 2003005296 | A | 1/2003 |
| JP | 2003010076 | A | 1/2003 |
| JP | 2003010088 | A | 1/2003 |
| JP | 2003015740 | | 1/2003 |
| JP | 3375843 | | 2/2003 |
| JP | 2003036116 | A | 2/2003 |
| JP | 2003038401 | A | 2/2003 |
| JP | 2003038402 | A | 2/2003 |
| JP | 2003047579 | | 2/2003 |
| JP | 2003052596 | | 2/2003 |
| JP | 2003505127 | | 2/2003 |
| JP | 2003061882 | A | 3/2003 |
| JP | 2003084994 | | 3/2003 |
| JP | 2003167628 | A | 6/2003 |
| JP | 2003180586 | A | 7/2003 |
| JP | 2003180587 | A | 7/2003 |
| JP | 2003190064 | A | 7/2003 |
| JP | 2003241836 | A | 8/2003 |
| JP | 2003262520 | A | 9/2003 |
| JP | 2003285288 | | 10/2003 |
| JP | 2003304992 | A | 10/2003 |
| JP | 2003310489 | | 11/2003 |
| JP | 2003310509 | A | 11/2003 |
| JP | 2003330543 | A | 11/2003 |
| JP | 2004123040 | A | 4/2004 |
| JP | 2004148021 | A | 5/2004 |
| JP | 2004160102 | A | 6/2004 |
| JP | 2004166968 | A | 6/2004 |
| JP | 2004174228 | | 6/2004 |
| JP | 2004198330 | A | 7/2004 |
| JP | 2004219185 | | 8/2004 |
| JP | 2004283327 | | 10/2004 |
| JP | 2004351234 | A | 12/2004 |
| JP | 2005118354 | A | 5/2005 |
| JP | 2005124753 | | 5/2005 |
| JP | 2005135400 | | 5/2005 |
| JP | 2005204909 | | 8/2005 |
| JP | 2005211360 | A | 8/2005 |
| JP | 2005224265 | A | 8/2005 |
| JP | 2005230032 | A | 9/2005 |
| JP | 2005245916 | A | 9/2005 |
| JP | 2005296511 | | 10/2005 |
| JP | 2005346700 | | 12/2005 |
| JP | 2005352707 | A | 12/2005 |
| JP | 2006043071 | A | 2/2006 |
| JP | 2006155274 | A | 6/2006 |
| JP | 2006164223 | A | 6/2006 |
| JP | 2006227673 | A | 8/2006 |
| JP | 2006247467 | A | 9/2006 |
| JP | 2006260161 | A | 9/2006 |
| JP | 2006293662 | A | 10/2006 |
| JP | 2006296697 | A | 11/2006 |
| JP | 2007034866 | A | 2/2007 |
| JP | 2007213180 | A | 8/2007 |
| JP | 2009015611 | A | 1/2009 |
| JP | 2010198552 | A | 9/2010 |
| KR | 2003016807 | | 3/2003 |
| KR | 657736 | | 12/2006 |
| KR | 2007103248 | | 10/2007 |
| KR | 2007112908 | | 11/2007 |
| WO | 199526512 | A1 | 10/1995 |
| WO | 199530887 | A1 | 11/1995 |
| WO | 199617258 | A1 | 6/1996 |
| WO | 199715224 | A1 | 5/1997 |
| WO | 199740734 | A1 | 11/1997 |
| WO | 199741451 | A1 | 11/1997 |
| WO | 199853456 | A1 | 11/1998 |
| WO | 199905580 | A2 | 2/1999 |
| WO | 199916078 | A1 | 4/1999 |
| WO | 199928800 | | 6/1999 |
| WO | 199938056 | A1 | 7/1999 |
| WO | 199938237 | A1 | 7/1999 |
| WO | 199943250 | A1 | 9/1999 |
| WO | 1999059042 | | 11/1999 |
| WO | 200036962 | | 6/2000 |
| WO | 200038026 | A1 | 6/2000 |
| WO | 200038028 | A1 | 6/2000 |
| WO | 200038029 | A1 | 6/2000 |
| WO | 200004430 | A1 | 10/2000 |
| WO | 200078410 | A1 | 12/2000 |
| WO | 200106904 | A1 | 2/2001 |
| WO | 200106905 | A1 | 2/2001 |
| WO | 2001080703 | A1 | 11/2001 |
| WO | 200191623 | A2 | 12/2001 |
| WO | 2002024292 | A1 | 3/2002 |
| WO | 200239864 | A1 | 5/2002 |
| WO | 200239868 | A1 | 5/2002 |
| WO | 2002058527 | A1 | 8/2002 |
| WO | 2002062194 | A1 | 8/2002 |

(56) References Cited

FOREIGN PATENT DOCUMENTS

| | | | |
|---|---|---|---|
| WO | 2002067744 | A1 | 9/2002 |
| WO | 2002067745 | A1 | 9/2002 |
| WO | 2002067752 | A1 | 9/2002 |
| WO | 2002069774 | A1 | 9/2002 |
| WO | 2002069775 | A2 | 9/2002 |
| WO | 2002071175 | A1 | 9/2002 |
| WO | 2002074150 | A1 | 9/2002 |
| WO | 2002075356 | A1 | 9/2002 |
| WO | 2002075469 | A1 | 9/2002 |
| WO | 2002075470 | A1 | 9/2002 |
| WO | 2002081074 | A1 | 10/2002 |
| WO | 2002101477 | A2 | 12/2002 |
| WO | 2003015220 | A1 | 2/2003 |
| WO | 2003024292 | A2 | 3/2003 |
| WO | 2003026474 | | 4/2003 |
| WO | 2003040546 | A1 | 5/2003 |
| WO | 2003040845 | A1 | 5/2003 |
| WO | 2003040846 | A1 | 5/2003 |
| WO | 2003062850 | A2 | 7/2003 |
| WO | 2003062852 | A1 | 7/2003 |
| WO | 2004004533 | A1 | 1/2004 |
| WO | 2004004534 | A1 | 1/2004 |
| WO | 2004005956 | | 1/2004 |
| WO | 2004006034 | A2 | 1/2004 |
| WO | 2004025947 | A2 | 3/2004 |
| WO | 2004043215 | | 5/2004 |
| WO | 2004058028 | A2 | 7/2004 |
| WO | 2004059409 | A1 | 7/2004 |
| WO | 2005006935 | A1 | 1/2005 |
| WO | 2005036292 | | 4/2005 |
| WO | 2005037496 | A1 | 4/2005 |
| WO | 2005055795 | A1 | 6/2005 |
| WO | 2005055796 | A2 | 6/2005 |
| WO | 2005076545 | A1 | 8/2005 |
| WO | 2005077243 | A1 | 8/2005 |
| WO | 2005077244 | A1 | 8/2005 |
| WO | 2005081074 | A1 | 9/2005 |
| WO | 2005083541 | A1 | 9/2005 |
| WO | 2005098475 | A1 | 10/2005 |
| WO | 2005098476 | A1 | 10/2005 |
| WO | 2006046400 | A1 | 5/2006 |
| WO | 2006061133 | A1 | 6/2006 |
| WO | 2006068403 | A1 | 6/2006 |
| WO | 2006073248 | A1 | 7/2006 |
| WO | 2006089307 | A2 | 8/2006 |
| WO | 2007028049 | A2 | 3/2007 |
| WO | 2007036490 | A2 | 4/2007 |
| WO | 2007065033 | A2 | 6/2007 |
| WO | 2007088192 | | 8/2007 |
| WO | 2007137234 | A2 | 11/2007 |
| WO | 2002075350 | A1 | 1/2012 |

OTHER PUBLICATIONS

Schenker et al., "Lightweight rovers for Mars science exploration and sample return," Intelligent Robots and Computer Vision XVI, *SPIE* Proc. 3208, pp. 24-36, 1997.

Schofield, "Neither Master nor slave—A Practical Study in the Development and Employment of Cleaning Robots, Emerging Technologies and Factory Automation," 1999 Proceedings ETFA '99 1999 7th IEEE International Conference on Barcelona, Spain, pp. 1427-1434, Oct. 1999.

Shimoga et al., "Touch and Force Reflection for Telepresence Surgery," Engineering in Medicine and Biology Society, 1994. Engineering Advances: New Opportunities for Biomedical Engineers. Proceedings of the 16th Annual International Conference of the IEEE, Baltimore, MD, pp. 1049-1050, 1994.

Sim et al, "Learning Visual Landmarks for Pose Estimation," IEEE International Conference on Robotics and Automation, vol. 3, Detroit, MI, pp. 1972-1978, May 1999.

Sobh et al., "Case Studies in Web-Controlled Devices and Remote Manipulation," Automation Congress, 2002 Proceedings of the 5th Biannual World, pp. 435-440, Dec. 2002.

Special Reports, "Vacuum Cleaner Robot Operated in Conjunction with 3G Celluar Phone," 59(9): 3 pages, Retrieved from the Internet: URL<http://www.toshiba.co.jp/tech/review/2004/09/59_0>. 2004.

Stella et al., "Self-Location for Indoor Navigation of Autonomous Vehicles," Part of the SPIE conference on Enhanced and Synthetic Vision SPIE vol. 3364, pp. 298-302, 1998.

Summet, "Tracking Locations of Moving Hand-held Displays Using Projected Light," Pervasive 2005, LNCS 3468, pp. 37-46, 2005.

Svedman et al., "Structure from Stereo Vision using Unsynchronized Cameras for Simultaneous Localization and Mapping," 2005 IEEE/RSJ International Conference on Intelligent Robots and Systems, pp. 2993-2998, 2005.

SVET Computers—New Technologies—Robot Vacuum Cleaner, Oct. 1999, available at http://www.sk.rs/1999/10/sknt01.html, 1 page, accessed Nov. 1, 2011.

Taipei Times, "Robotic vacuum by Matsuhita about to undergo testing," Retrieved from the Internet: URL<http://www.taipeitimes.com/News/worldbiz/archives/2002/03/26/0000129338>. accessed Mar. 2002, 2 pages.

Takio et al., "Real-Time Position and Pose Tracking Method of Moving Object Using Visual Servo System," 47th IEEE International Symposium on Circuits and Systems, pp. 167-170, 2004.

Teller, "Pervasive pose awareness for people, Objects and Robots," http://www.ai.mit.edu/lab/dangerous-ideas/Spring2003/teller-pose.pdf, 6 pages, Apr. 2003.

Terada et al., "An Acquisition of the Relation between Vision and Action using Self-Organizing Map and Reinforcement Learning," 1998 Second International Conference on Knowledge-Based Intelligent Electronic Systems, Adelaide, Australia, pp. 429-434, Apr. 1998.

The Sharper Image, eVac Robotic Vacuum—Product Details, www.sharperiamge.com/us/en/templates/products/pipmorework1printable.jhtml, 1 page, Mar. 2005.

TheRobotStore.com, "Friendly Robotics Robotic Vacuum RV400—The Robot Store," www.therobotstore.com/s.nl/sc.9/category.-109/it.A/id.43/.f, 1 page, Apr. 2005.

Thrun, Sebastian, "Learning Occupancy Grid Maps With Forward Sensor Models," Autonomous Robots 15, 28 pages, Sep. 1, 2003.

TotalVac.com, RC3000 RoboCleaner website, Mar. 2005, 3 pages.

Trebi-Ollennu et al., "Mars Rover Pair Cooperatively Transporting a Long Payload," Proceedings of the 2002 IEEE International Conference on Robotics & Automation, Washington, D.C. pp. 3136-3141, May 2002.

Tribelhorn et al., "Evaluating the Roomba: A low-cost, ubiquitous platform for robotics research education," *IEEE*, pp. 1393-1399, 2007.

Tse et al., "Design of a Navigation System for a Household Mobile Robot Using Neural Networks," Department of Manufacturing Engg. & Engg. Management, City University of Hong Kong, pp. 2151-2156, 1998.

UAMA (Asia) Industrial Co., Ltd., "RobotFamily," 2005, 1 page.

Ubot, cleaning robot capable of wiping with a wet duster, Retrieved from the Internet: URL<http://us.aving.net/news/view.php?articleId=23031>. 4 pages, accessed Nov. 2011.

Watanabe et al., "Position Estimation of Mobile Robots With Internal and External Sensors Using Uncertainty Evolution Technique," 1990 IEEE International Conference on Robotics and Automation, Cincinnati, OH, pp. 2011-2016, May 1990.

Watts, "Robot, boldly goes where no man can," The Times—pp. 20, Jan. 1985.

Wijk et al., "Triangulation-Based Fusion of Sonar Data with Application in Robot Pose Tracking," *IEEE Transactions on Robotics and Automation*, 16(6):740-752, Dec. 2000.

Wolf et al., "Robust Vision-Based Localization by Combining an Image-Retrieval System with Monte Carol Localization,", *IEEE Transactions on Robotics*, 21(2):208-216, Apr. 2005.

Wolf et al., "Robust Vision-based Localization for Mobile Robots Using an Image Retrieval System Based on Invariant Features," Proceedings of the 2002 IEEE International Conference on Robotics & Automation, Washington, D.C., pp. 359-365, May 2002.

(56) References Cited

OTHER PUBLICATIONS

Wong, "EIED Online>> Robot Business", ED Online ID# 13114, 17 pages, Jul. 2006.
Yamamoto et al., "Optical Sensing for Robot Perception and Localization," 2005 IEEE Workshop on Advanced Robotics and its Social Impacts, pp. 14-17, 2005.
Yata et al., "Wall Following Using Angle Information Measured by a Single Ultrasonic Transducer," Proceedings of the 1998 IEEE, International Conference on Robotics & Automation, Leuven, Belgium, pp. 1590-1596, May 1998.
Yujin Robotics,"An intelligent cleaning robot," Retrieved from the Internet: URL<http://us.aving.net/news/view.php?articleId=7257>. 8 pages, accessed Nov. 2011.
Yun et al., "Image-Based Absolute Positioning System for Mobile Robot Navigation," IAPR International Workshops SSPR, Hong Kong, pp. 261-269, Aug. 2006.
Yun et al., "Robust Positioning a Mobile Robot with Active Beacon Sensors," *Lecture Notes in Computer Science*, 2006, vol. 4251, pp. 890-897, 2006.
Yuta et al., "Implementation of an Active Optical Range sensor Using Laser Slit for In-Door Intelligent Mobile Robot," IEE/RSJ International Workshop on Intelligent Robots and Systems (IROS 91) vol. 1, Osaka, Japan, pp. 415-420, Nov. 3-5, 1991.
Zha et al., "Mobile Robot Localization Using Incomplete Maps for Change Detection in a Dynamic Environment," Advanced Intelligent Mechatronics '97. Final Program and Abstracts., IEEE/ASME International Conference, pp. 110, Jun. 1997.
Zhang et al., "A Novel Mobile Robot Localization Based on Vision," *SPIE* vol. 6279, 6 pages, Jan. 2007.
International Search Report and Written Opinion issued in International Application No. PCT/US2007/069389, dated Feb. 14, 2008, 9 pages.
International Preliminary Report on Patentability issued in International Application No. PCT/US2007/069389, report completed Nov. 4, 2008, 9 pages.
Favre-Bulle, "Efficient tracking of 3D—Robot Position by Dynamic Triangulation," IEEE Instrumentation and Measurement Technology Conference IMTC 98 Session on Instrumentation and Measurement in Robotics, vol. 1, pp. 446-449, May 1998.
Fayman, "Exploiting Process Integration and Composition in the context of Active Vision," IEEE Transactions on Systems, Man, and Cybernetics—Part C: Application and reviews, vol. 29, No. 1, pp. 73-86, Feb. 1999.
Florbot GE Plastics, 1989-1990, 2 pages, available at http://www.fuseid.com/, accessed Sep. 27, 2012.
Franz et al., "Biomimetric robot navigation", Robotics and Autonomous Systems, vol. 30 pp. 133-153, 2000.
Friendly Robotics, "Friendly Robotics—Friendly Vac, Robotic Vacuum Cleaner," Retrieved from the Internet: URL< www.friendlyrobotics.com/vac.htm > 5 pages, Apr. 2005.
Fuentes et al., "Mobile Robotics 1994," University of Rochester. Computer Science Department, TR 588, 44 pages, Dec. 1994.
Fukuda et al., "Navigation System based on Ceiling Landmark Recognition for Autonomous mobile robot," 1995 IEEE/RSJ International Conference on Intelligent Robots and Systems 95. 'Human Robot Interaction and Cooperative Robots', Pittsburgh, PA, pp. 1466/1471, Aug. 1995.
Gat, "Robust Low-Computation Sensor-driven Control for Task-Directed Navigation," Proc of IEEE International Conference on Robotics and Automation , Sacramento, CA pp. 2484-2489, Apr. 1991.
Gionis, "A hand-held optical surface scanner for environmental Modeling and Virtual Reality," Virtual Reality World, 16 pages, 1996.
Goncalves et al., "A Visual Front-End for Simultaneous Localization and Mapping", Proceedings of the 2005 IEEE International Conference on Robotics and Automation, Barcelona, Spain, pp. 44-49, Apr. 2005.
Gregg et al., "Autonomous Lawn Care Applications," 2006 Florida Conference on Recent Advances in Robotics, Miami, Florida, May 25-26, 2006, Florida International University, 5 pages.
Grumet, "Robots Clean House," Popular Mechanics, Nov. 2003, 3 pages.
Hamamatsu "SI PIN Diode S5980, S5981 S5870- Multi-element photodiodes for surface mounting," Hamatsu Photonics, 2 pages, Apr. 2004.
Hammacher Schlemmer , "Electrolux Trilobite Robotic Vacuum," Retrieved from the Internet: URL< www.hammacher.com/publish/71579.asp?promo=xsells>. 3 pages, Mar. 2005.
Haralick et al. "Pose Estimation from Corresponding Point Data", *IEEE Transactions on Systems, Man, and Cybernetics*, 19(6):1426-1446, Nov. 1989.
Hausler, "About the Scaling Behaviour of Optical Range Sensors," Fringe '97, Proceedings of the 3rd International Workshop on Automatic Processing of Fringe Patterns, Bremen, Germany, pp. 147-155, Sep. 1997.
Hitachi: News release: "The home cleaning robot of the autonomous movement type (experimental machine)," Retrieved from the Internet: URL< www.i4u.com./japanreleases/hitachirobot.htm>. 5 pages, Mar. 2005.
Hoag et al., "Navigation and Guidance in interstellar space," ACTA Astronautica, vol. 2, pp. 513-533 , Feb. 1975.
Home Robot—UBOT; Microbotusa.com, retrieved from the WWW at www.microrobotusa.com, accessed Dec. 2, 2008, 2 pages.
Huntsberger et al., "CAMPOUT: A Control Architecture for Tightly Coupled Coordination of Multirobot Systems for Planetary Surface Exploration," *IEEE Transactions on Systems, Man, and Cybernetics—Part A: Systems and Humans*, 33(5):550-559, Sep. 2003.
Iirobotics.com, "Samsung Unveils Its Multifunction Robot Vacuum," Retrieved from the Internet: URL<.www.iirobotics.com/webpages/hotstuff.php?ubre=111>. 3 pages, Mar. 2005.
InMach "Intelligent Machines," Retrieved from the Internet: URL<www.inmach.de/inside.html>. 1 page, Nov. 2008.
Innovation First, "2004 EDU Robot Controller Reference Guide," Retrieved from the Internet: URL<http://www.ifirobotics.com>. 13 pages, Mar. 2004.
IT media, Retrieved from the Internet: URL<http://www.itmedia.co.jp/news/0111/16/robofesta_m.html>. Accessed Nov. 1, 2011, 4 pages.
Jarosiewicz et al., "Final Report—Lucid," University of Florida, Departmetn of Electrical and Computer Engineering, EEL 5666—Intelligent Machine Design Laboratory, 50 pages, Aug. 1999.
Jensfelt et al., "Active Global Localization for a mobile robot using multiple hypothesis tracking," *IEEE Transactions on Robots and Automation*, 17(5): 748-760, Oct. 2001.
Jeong et al., "An intelligent map-building system for indoor mobile robot using low cost photo sensors,"*SPIE*, vol. 6042, 6 pages, 2005.
Kahney, "Robot Vacs are in the House," Retrieved from the Internet: URL<www.wired.com/news/technology/o,1282,59237,00.html>. 6 pages, Jun. 2003.
Karcher "Karcher RoboCleaner RC 3000," Retrieved from the Internet: URL<www.robocleaner.de/english/screen3.html>. 4 pages, Dec. 2003.
Karcher Product Manual Download webpage: Retrieved from the Internet: URL<http://www.karcher.com/bta/download.en.shtml?ACTION=SELECTTEILENR&ID=rc3000 &submitButtonName+Select+Product+Manual and associated .pdf file "5959-915en.pdf (4.7 MB) English/English," 16 pages, accessed Jan. 2004.
Karcher RC 3000 Cleaning Robot—user manual Manufacturer: Alfred-Karcher GmbH & Co, Cleaning Systems, Alfred Karcher-Str 28-40, PO Box 160, D-71349 Winnenden, Germany, Dec. 2002.
Karcher USA "RC 3000 Robotics cleaner," : Retrieved from the Internet: URL<www.karcher-usa.com, 3 pages, Mar. 2005.
Karcher USA, RC3000 Robotic Cleaner, website: http://www.karcher-usa.com/showproducts.php?op=view prod&paraml=143 &param2=&param3=, 6 pages, accessed Mar. 2005.
Karcher, "Product Manual Download Karch", available at www.karcher.com, 17 pages, 2004.

(56) References Cited

OTHER PUBLICATIONS

Karlsson et al., "Core Technologies for service Robotics," IEEE/RSJ International Conference on Intelligent Robots and Systems (IROS 2004), vol. 3, pp. 2979-2984, Sep. 2004.
Karlsson et al., The vSLAM Algorithm for Robust Localization and Mapping, Proceedings of the 2005 IEEE International Conference on Robotics and Automation, Barcelona, Spain, pp. 24-29, Apr. 2005.
King and Weiman, "HelpmateTM Autonomous Mobile Robots Navigation Systems," SPIE vol. 1388 Mobile Robots, pp. 190-198, 1990.
Kleinberg, The Localization Problem for Mobile Robots, Laboratory for Computer Science, Massachusetts Institute of Technology, 1994 IEEE, pp. 521-531, 1994.
Knights, et al., "Localization and Identification of Visual Landmarks," *Journal of Computing Sciences in Colleges*, 16(4):312-313, May 2001.
Kolodko et al., "Experimental System for Real-Time Motion Estimation," Proceedings of the 2003 IEEE/ASME International Conference on Advanced Intelligent Mechatronics (AIM 2003), pp. 981-986, 2003.
Komoriya et al., "Planning of Landmark Measurement for the Navigation of a Mobile Robot," Proceedings of the 1992 IEEE/RSJ International Cofnerence on Intelligent Robots and Systems, Raleigh, NC pp. 1476-1481, Jul. 1992.
Krotov et al., "Digital Sextant," Downloaded from the Internet at: http://www.cs.cmu.edu/~epk/ , 1 page, 1995.
Krupa et al., "Autonomous 3-D Positioning of Surgical Instruments in Robotized Laparoscopic Surgery Using Visual Servoin," *IEEE Transactions on Robotics and Automation*, 19(5):842-853, Oct. 2003.
Kuhl et al., "Self Localization in Environments using Visual Angles," VRCAI '04 Proceedings of the 2004 ACM SIGGRAPH international conference on Virtual Reality continuum and its applications in industry, pp. 472-475, 2004.
Kurs et al, Wireless Power transfer via Strongly Coupled Magnetic Resonances, Downloaded from www.sciencemag.org, Aug. 2007, 5 pages.
Kurth, "Range-Only Robot Localization and SLAM with Radio", http://www.ri.cmu.edu/pub_files/pub4/kurth_derek_2004_1/ kurth_derek_2004_1.pdf. 60 pages, May, 2004, accessed Jul. 27, 2012.
Kwon et al., "Table Recognition through Range-based Candidate Generation and Vision based Candidate Evaluation," ICAR 2007, The 13th International Conference on Advanced Robotics Aug. 21-24, 2007, Jeju, Korea, pp. 918-923, 2007.
Lambrinos et al., "A mobile robot employing insect strategies for navigation," Retrieved from the Internat: URL<http://www8.cs.umu.se/kurser/TDBD17/VT04/dl/Assignment%20Papers/ lambrinos-RAS-2000.pdf>. 38 pages, Feb. 1999.
Lang et al., "Visual Measurement of Orientation Using Ceiling Features", 1994 IEEE, pp. 552-555, 1994.
Lapin, "Adaptive position estimation for an automated guided vehicle," *SPIE*, vol. 1831 Mobile Robots VII, pp. 82-94, 1992.
LaValle et al., "Robot Motion Planning in a Changing, Partially Predictable Environment," 1994 IEEE International Symposium on Intelligent Control, Columbus, OH, pp. 261-266, Aug. 1994.
Lee et al., "Development of Indoor Navigation system for Humanoid Robot Using Multi-sensors Integration", ION NTM, San Diego, CA pp. 798-805, Jan. 2007.
Lee et al., "Localization of a Mobile Robot Using the Image of a Moving Object," *IEEE Transaction on Industrial Electronics*, 50(3):612-619, Jun. 2003.
Leonard et al., "Mobile Robot Localization by tracking Geometric Beacons," *IEEE Transaction on Robotics and Automation*, 7(3):376-382, Jun. 1991.
Andersen et al., "Landmark based navigation strategies," SPIE Conference on Mobile Robots XIII, SPIE vol. 3525, pp. 170-181, Jan. 8, 1999.
Becker et al., "Reliable Navigation Using Landmarks, " IEEE International Conference on Robotics and Automation, 0-7803-1965-6, pp. 401-406, 1995.
Benayad-Cherif et al., "Mobile Robot Navigation Sensors," SPIE vol. 1831 Mobile Robots, VII, pp. 378-387, 1992.
Bison et al., "Using a structured beacon for cooperative position estimation," *Robotics and Autonomous Systems*, 29(1):33-40, Oct. 1999.
Blaasvaer et al., "AMOR—An Autonomous Mobile Robot Navigation System," Proceedings of the IEEE International Conference on Systems, Man, and Cybernetics, pp. 2266-2271, 1994.
Borges et al., "Optimal Mobile Robot Pose Estimation Using Geometrical Maps," IEEE Transactions on Robotics and Automation, 18(1): 87-94, Feb. 2002.
Braunstingl et al., "Fuzzy Logic Wall Following of a Mobile Robot Based on the Concept of General Perception," ICAR '95, 7th International Conference on Advanced Robotics, Sant Feliu De Guixols, Spain, pp. 367-376, Sep. 1995.
Bulusu et al., "Self Configuring Localization systems: Design and Experimental Evaluation,"*ACM Transactions on Embedded Computing Systems*, 3(1):24-60, 2003.
Caccia et al., "Bottom-Following for Remotely Operated Vehicles,"5th IFAC Conference, Alaborg, Denmark, pp. 245-250, Aug. 2000.
Certified U.S. Appl. No. 60/605,066 as provided to WIPO in PCT/US2005/030422, corresponding to U.S. National Stage Entry Application No. 11/574,290, U.S.publication 2008/0184518, filed Aug. 27, 2004.
Certified U.S. Appl. No. 60/605,181 as provided to WIPO in PCT/US2005/030422, corresponding to U.S. National Stage Entry Application No. 11/574,290, U.S.publication 2008/0184518, filed Aug. 27, 2004.
Chae et al., "StarLITE: A new artificial landmark for the navigation of mobile robots," http://www.irc.atr.jp/jk-nrs2005/pdf/Starlite.pdf, 4 pages, 2005.
Chamberlin et al., "Team 1: Robot Locator Beacon System, " NASA Goddard SFC, Design Proposal, 15 pages, Feb. 2006.
Champy, "Physical management of IT assets in Data Centers using RFID technologies," RFID 2005 University, Oct. 12-14, 2005 , 19 pages.
Chiri, "Joystick Control for Tiny OS Robot," http://www.eecs.berkeley.edu/Programs/ugrad/superb/papers2002/chiri.pdf. 12 pages, Aug. 2002.
Christensen et al. "Theoretical Methods for Planning and Control in Mobile Robotics," 1997 First International Conference on Knowledge-Based Intelligent Electronic Systems, Adelaide, Australia, pp. 81-86, May 1997.
Clerentin et al., "A localization method based on two omnidirectional perception systems cooperation," *Proc of IEEE International Conference on Robotics & Automation*, San Francisco, CA vol. 2, pp. 1219-1224, Apr. 2000.
Corke, "High Performance Visual serving for robots end-point control," SPIE vol. 2056, Intelligent Robots and Computer Vision, 1993, 10 pages.
Cozman et al., "Robot Localization using a Computer Vision Sextant," IEEE International Midwest Conference on Robotics and Automation, pp. 106-111, 1995.
D'Orazio et al., "Model based Vision System for mobile robot position estimation", *SPIE*, vol. 2058 Mobile Robots VIII, pp. 38-49, 1992.
De Bakker et al., "Smart PSD-array for sheet of light range imaging", Proc. of *SPIE*, vol. 3965, pp. 1-12, May 2000.
Denning Roboscrub image (1989), 1 page.
Desaulniers et al., "An Efficient Algorithm to find a shortest path for a car-like Robot," *IEEE Transactions on robotics and Automation* , 11(6):819-828, Dec. 1995.
Dorfmüller-Ulhaas, "Optical Tracking From User Motion to 3D Interaction," http://www.cg.tuwien.ac.at/research/publications/2002/Dorfmueller-Ulhaas-thesis, 182 pages, 2002.
Dorsch et al., "Laser Triangulation: Fundamental uncertainty in distance measurement," *Applied Optics*, 33(7):1306-1314, Mar. 1994.

(56) References Cited

OTHER PUBLICATIONS

Doty et al., "Sweep Strategies for a Sensory-Driven, Behavior-Based Vacuum Cleaning Agent," AAAI 1993 Fall Symposium Series, Instantiating Real-World Agents, pp. 1-6, Oct. 22-24, 1993.
Dudek et al., "Localizing a Robot with Minimum Travel" *Proceedings of the sixth annual ACM-SIAM symposium on Discrete Algorithms*, 27(2):583-604, Apr. 1998.
Dulimarta et al., "Mobile Robot Localization in Indoor Environment", *Pattern Recognition*, 30(1):99-111, 1997.
Dyson's Robot Vacuum Cleaner—the DC06, May 2004, Retrieved from the Internet: URL< http://www.gizmag.com/go/1282/>. Accessed Nov. 2011, 3 pages.
EBay, "Roomba Timer -> Timed Cleaning—Floorvac Robotic Vacuum," Retrieved from the Internet: URL Cgi.ebay.com/ws/eBayISAPI.dll?viewitem&category=43526&item=4375198387 &rd=1, 5 pages, Apr. 2005.
Electrolux, "Designed for the well-lived home," Retrieved from the Internet: URL<http://www.electroluxusa.com/node57.as[?currentURL=node142.asp%3F >. Accessed Mar. 2005, 5 pages.
Electrolux, "Welcome to the Electrolux trilobite," Retrieved from the Internet: URL<www.electroluxusa.com/node57.asp?currentURL=node142.asp%3F>. 2 pages, Mar. 2005.
Eren et al., "Accuracy in position estimation of mobile robots based on coded infrared signal transmission," Proceedings: Integrating Intelligent Instrumentation and Control, Instrumentation and Measurement Technology Conference, 1995, IMTC/95. pp. 548-551, 1995.
Eren et al., "Operation of Mobile Robots in a Structured Infrared Environment," Proceedings 'Sensing, Processing, Networking', IEEE Instrumentation and Measurement Technology Conference, 1997 (IMTC/97), Ottawa, Canada vol. 1, pp. 20-25, May 1997.
Euroflex, Jan. 2006, Retrieved from the Internet: URL< http://www.euroflex.tv/novita_dett.php?id=15, 1 page, accessed Nov. 2011.
eVac Robotic Vacuum S1727 Instruction Manual, Sharper Image Corp, Copyright 2004, 16 pages.
Everyday Robots, "Everyday Robots: Reviews, Discussion and News for Consumers," Retrieved from the Internet: URL< www.everydayrobots.com/index.php?option=content&task=view &id=9>. 7 pages, Apr. 2005.
Evolution Robotics, "NorthStar—Low-cost Indoor Localiztion—How it Works," E Evolution Robotics , 2 pages, 2005.
Facchinetti Claudio et al., "Self-Positioning Robot Navigation Using Ceiling Images Sequences," ACCV '95, 5 pages, Dec. 1995.
Facchinetti Claudio et al., "Using and Learning Vision-Based Self-Positioning for Autonomous Robot Navigation," ICARCV '94, vol. 3, pp. 1694-1698, 1994.
Facts on Trilobite, webpage, Retrieved from the Internet: URL< http://trilobiteelectroluxse/presskit_en/model11335asp?print=yes &pressID=>. 2 pages, accessed Dec. 2003.
Fairfield et al., "Mobile Robot Localization with Sparse Landmarks," SPIE vol. 4573, pp. 148-155, 2002.
Li et al. "Robust Statistical Methods for Securing Wireless Localization in Sensor Networks," Information Processing in Sensor Networks, 2005, Fourth International Symposium on, pp. 91-98, Apr. 2005.
Li et al., "Making a Local Map of Indoor Environments by Swiveling a Camera and a Sonar," Proceedings of the 1999 IEEE/RSJ International Conference on Intelligent Robots and Systems, pp. 954-959, 1999.
Lin et al., "Mobile Robot Navigation Using Artificial Landmarks," *Journal of robotics System*, 14(2): 93-106, 1997.
Linde, Dissertation—"On Aspects of Indoor Localization," Available at: https://eldorado.tu-dortmund.de/handle/2003/22854, University of Dortmund, 138 pages, Aug. 2006.
Lumelsky et al., "An Algorithm for Maze Searching with Azimuth Input", 1994 IEEE International Conference on Robotics and Automation, San Diego, CA vol. 1, pp. 111-116, 1994.
Luo et al., "Real-time Area-Covering Operations with Obstacle Avoidance for Cleaning Robots," IEEE, pp. 2359-2364, 2002.
Ma, Thesis—"Documentation on Northstar," California Institute of Technology, 14 pages, May 2006.
Madsen et al., "Optimal landmark selection for triangulation of robot position," Journal of Robotics and Autonomous Systems, vol. 13 pp. 277-292, 1998.
Malik et al., "Virtual Prototyping for Conceptual Design of a Tracked Mobile Robot," Electrical and Computer Engineering, Canadian Conference on, IEEE, PI. pp. 2349-2352, May 2006.
Martishevcky, "The Accuracy of point light target coordinate determination by dissectoral tracking system", SPIE vol. 2591, pp. 25-30, Oct. 23, 2005.
Maschinemarkt Würzburg 105, Nr. 27, pp. 3, 30, Jul. 5, 1999.
Matsutek Enterprises Co. Ltd, "Automatic Rechargeable Vacuum Cleaner," http://matsutek.manufacturer.globalsources.com/si/6008801427181/pdtl/Home-vacuum/10 . . . , Apr. 2007, 3 pages.
McGillem et al., "Infra-red Lacation System for Navigation and Autonomous Vehicles," 1988 IEEE International Conference on Robotics and Automation, vol. 2, pp. 1236-1238, Apr. 1988.
McGillem,et al. "A Beacon Navigation Method for Autonomous Vehicles," *IEEE Transactions on Vehicular Technology*, 38(3):132-139, Aug. 1989.
McLurkin "Stupid Robot Tricks: A Behavior-based Distributed Algorithm Library for Programming Swarms of Robots," Paper submitted for requirements of BSEE at MIT, May 2004, 127 pages.
McLurkin, "The Ants: A community of Microrobots," Paper submitted for requirements of BSEE at Mit, May 1995, 60 pages.
Miro et al., "Towards Vision Based Navigation in Large Indoor Environments," Proceedings of the IEEE/RSJ International Conference on Intelligent Robots and Systems, Beijing, China, pp. 2096-2102, Oct. 2006.
MobileMag, "Samsung Unveils High-tech Robot Vacuum Cleaner," Retrieved from the Internet: URL<http://www.mobilemag.com/content/100/102/C2261/>. 4 pages, Mar. 2005.
Monteiro et al., "Visual Servoing for Fast Mobile Robot: Adaptive Estimation of Kinematic Parameters," Proceedings of the IECON '93., International Conference on Industrial Electronics, Maui, HI, pp. 1588-1593, Nov. 1993.
Moore et al., "A simple Map-bases Localization strategy using range measurements," *SPIE*, vol. 5804 pp. 612-620, 2005.
Morland,"Autonomous Lawnmower Control", Downloaded from the internet at: http://cns.bu.edu/~cjmorlan/robotics/lawnmower/report.pdf, 10 pages, Jul. 2002.
Munich et al., "ERSP: A Software Platform and Architecture for the Service Robotics Industry," Intelligent Robots and Systems, 2005. (IROS 2005), pp. 460-467, Aug. 2005.
Munich et al., "SIFT-ing Through Features with ViPR", IEEE Robotics & Automation Magazine, pp. 72-77, Sep. 2006.
Nam et al., "Real-Time Dynamic Visual Tracking Using PSD Sensors and extended Trapezoidal Motion Planning", Applied Intelligence 10, pp. 53-70, 1999.
Nitu et al., "Optomechatronic System for Position Detection of a Mobile Mini-Robot," *IEEE Ttransactions on Industrial Electronics*, 52(4):969-973, Aug. 2005.
On Robo, "Robot Reviews Samsung Robot Vacuum (VC-RP3OW)," Retrieved from the Internet: URL <www.onrobo.com/reviews/AT_Home/vacuum_cleaners/on00vcrb30rosam/index.htm>. 2 pages, 2005.
OnRobo "Samsung Unveils Its Multifunction Robot Vacuum," Retrieved from the Internet: URL <www.onrobo.com/enews/0210/samsung_vacuum.shtml>. 3 pages, Mar. 2005.
Pages et al., "A camera-projector system for robot positioning by visual serving," Proceedings of the 2006 Conference on Computer Vision and Pattern Recognition Workshop (CVPRW06), 8 pages, Jun. 2006.
Pages et al., "Optimizing Plane-to-Plane Positioning Tasks by Image-Based Visual Servoing and Structured Light," *IEEE Transactions on Robotics*, 22(5):1000-1010, Oct. 2006.
Pages et al., "Robust decoupled visual servoing based on structured light," 2005 IEEE/RSJ, Int. Conf. on Intelligent Robots and Systems, pp. 2676-2681, 2005.
Park et al., "A Neural Network Based Real-Time Robot Tracking Controller Using Position Sensitive Detectors," IEEE World Con-

(56) References Cited

OTHER PUBLICATIONS gress on Computational Intelligence., 1994 IEEE International Conference on Neutral Networks, Orlando, Florida pp. 2754-2758, Jun./Jul. 1994.
Park et al., "Dynamic Visual Servo Control of Robot Manipulators using Neutral Networks," *The Korean Institute Telematics and Electronics*, 29-B(10):771-779, Oct. 1992.
Paromtchik "Toward Optical Guidance of Mobile Robots," Proceedings of the Fourth World Multiconference on Systemics, Cybermetics and Informatics, Orlando, FL, USA, Jul. 23, 2000, vol. IX, pp. 44-49, available at http://emotion.inrialpes.fr~paromt/infos/papers/paromtchik:asama:sci:2000.ps. gz, accessed Jul. 3, 2012, 6 pages.
Paromtchik et al., "Optical Guidance System for Multiple mobile Robots," Proceedings 2001 ICRA. IEEE International Conference on Robotics and Automation, vol. 3, pp. 2935-2940, May 2001.
Penna et al., "Models for Map Building and Navigation", IEEE Transactions on Systems. Man. and Cybernetics., 23(5):1276-1301, Sep./Oct. 1993.
Pirjanian et al. "Representation and Execution of Plan Sequences for Multi-Agent Systems," Proceedings of the 2001 IEEE/RSJ International Conference on Intelligent Robots and Systems, Maui, Hawaii, pp. 2117-2123, Oct. 2001.
Pirjanian et al., "A decision-theoretic approach to fuzzy behavior coordination", 1999 IEEE International Symposium on Computational Intelligence in Robotics and Automation, 1999. CIRA '99., Monterey, CA, pp. 101-106, Nov. 1999.
Pirjanian et al., "Distributed Control for a Modular, Reconfigurable Cliff Robot," Proceedings of the 2002 IEEE International Conference on Robotics & Automation, Washington, D.C. pp. 4083-4088, May 2002.
Pirjanian et al., "Improving Task Reliability by Fusion of Redundant Homogeneous Modules Using Voting Schemes," Proceedings of the 1997 IEEE International Conference on Robotics and Automation, Albuquerque, NM, pp. 425-430, Apr. 1997.
Pirjanian et al., "Multi-Robot Target Acquisition using Multiple Objective Behavior Coordination," Proceedings of the 2000 IEEE International Conference on Robotics & Automation, San Francisco, CA, pp. 2696-2702, Apr. 2000.
Pirjanian, "Challenges for Standards for consumer Robotics," IEEE Workshop on Advanced Robotics and its Social impacts, pp. 260-264, Jun. 2005.
Pirjanian, "Reliable Reaction," Proceedings of the 1996 IEEE/SICE/RSJ International Conference on Multisensor Fusion and Integration for Intelligent Systems, pp. 158-165, 1996.
Prassler et al., "A Short History of Cleaning Robots," Autonomous Robots 9, 211-226, 2000, 16 pages.
Put Your Roomba . . . On, Automatic webpages: http://www.acomputeredge.com/roomba, 5 pages, accessed Apr. 2005.
Remazeilles et al., "Image based robot navigation in 3D environments," Proc. of *SPIE*, vol. 6052, pp. 1-14, Dec. 2005.
Rives et al., "Visual servoing based on ellipse features," *SPIE*, vol. 2056 Intelligent Robots and Computer Vision pp. 356-367, 1993.
Roboking—not just a vacuum cleaner, a robot!, Jan. 21, 2004, infocom.uz/2004/01/21/robokingne-prosto-pyilesos-a-robot/, accessed Oct. 10, 2011, 7 pages.
RoboMaid Sweeps Your Floors So You Won't Have to, the Official Site, website: Retrieved from the Internet: URL<http://therobomaid.com/>. 2 pages, accessed Mar. 2005.
Robot Buying Guide, "LG announces the first robotic vacuum cleaner for Korea," Retrieved from the Internet: URL<http://robotbg.corn/news/2003/04/22/lg_announces_the_first_robotic_vacu>. 1 page, Apr. 2003.
Robotics World, "A Clean Sweep," 5 pages, Jan. 2001.
Ronnback, "On Methods for Assistive Mobile Robots," Retrieved from the Internet: URL<http://www.openthesis.org/documents/methods-assistive-mobile-robots-595019.html>. 218 pages, Jan. 2006.
Roth-Tabak et al., "Environment Model for mobile Robots Indoor Navigation," *SPIE*, vol. 1388 Mobile Robots, pp. 453-463, 1990.
Sahin et al., "Development of a Visual Object Localization Module for Mobile Robots," 1999 Third European Workshop on Advanced Mobile Robots, (Eurobot '99), pp. 65-72, 1999.
Salomon et al., "Low-Cost Optical Indoor Localization system for Mobile Objects without Image Processing," IEEE Conference on Emerging Technologies and Factory Automation, 2006. (ETFA '06), pp. 629-632, Sep. 2006.
Sato, "Range Imaging Based on Moving Pattern Light and Spatio-Temporal Matched Filter," Proceedings International Conference on Image Processing, vol. 1., Lausanne, Switzerland, pp. 33-36, Sep. 1996.
Barker, "Navigation by the Stars—Ben Barker 4th Year Project" Power point pp. 1-20.
CleanMate 365, Intelligent Automatic Vacuum Cleaner, Model No. 00-1, User Manual www.metapo.com/support/user_manual.pdf 11 pages.
Euroflex intellegente Monstre Mauele (English only except).
Facts on the Trilobite, Retrieved from the Internet: URL< http://www.frc.ri.cmu.edu/~hpm/talks/Extras/trilobite.desc.html >. 2 pages, accessed Nov. 2011.
FloorBotics, VR-8 Floor Cleaning Robot, Product Description for Manufacturers, http://www.consensus.com.au/SoftwareAwards/CSAarchive/CSA2004/CSAart04/FloorBot/F.
Michelson "Autonomous Navigation", 2000 Yearbook of Science & Technology, McGraw-Hill, New York, ISBN 0-07-052771-7, pp. 28-30, 1999.
Office Action dated Aug. 17, 2010 for corresponding application EP 07783998.3.
Office Action dated Jul. 15, 2011 in corresponding U.S. Appl. No. 12/687,464.
Office Action dated May 27, 2010 in corresponding U.S. Appl. No. 11/751,470.
Office Action received for Korean Patent Application No. 10-2010-7025523, dated Feb. 15, 2011, 11 pages including English translation.
Radio Frequency Identification: Tracking ISS Consumables, Author Unknown, 41 pages.
Robotic Vacuum Cleaner-Blue, website: http://www.sharperimage.com/us/en/catalog/produetview.jhtml?sku=S1727BLU, accessed Mar. 18, 2005.
Written Opinion of the International Searching Authority, PCT/US2004/001504, dated Aug. 20, 2012, 9 pages.
Zoombot Remote Controlled Vaccum—RV-500 NEW Roomba 2, website: http://cgi.ebay.com/ws/eBayISAPI.dll?Viewitem&category=43526&item=4373497618&rd=1, accessed Apr. 20, 2005.
Betke, et al., "Mobile Robot localization using Landmarks" Proceedings of the IEEE/RSJ/GI International Conference on Intelligent Robots and Systems '94 "Advanced Robotic Systems and the Real World" (IROS '94), Apr. 22, 2009, 8 pages.
Everett, H.R. (1995). Sensors for Mobile Robots. AK Peters, Ltd., Wellesley, MA.
Honda Motor Co., Ltd., English Translation of JP11212642, Aug. 9, 1999, 31 pages.
Jones, J., Roth, D. (Jan. 2, 2004). Robot Programming: A Practical Guide to Behavior-Based Robotics. McGraw-Hill Education Tab; 288 pages.
Karcher, Product Manual Download, 2003, 16 pages.
Partial European Search Report in European Application No. 15201413, dated Oct. 26, 2016, 11 pages.
Prassler, et al., English Translation of DE19849978, Feb. 8, 2001, 16 pages.

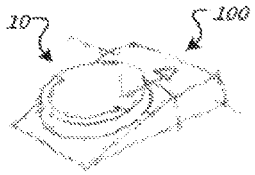
FIG. 14A
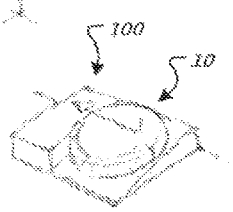
FIG. 14B
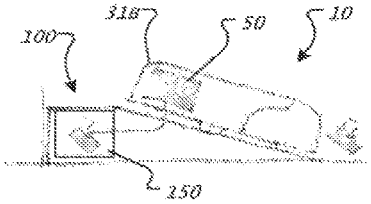
FIG. 14C
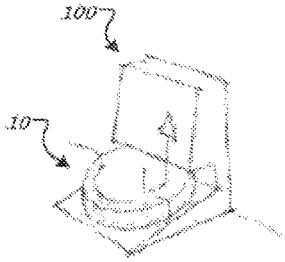
FIG. 15A
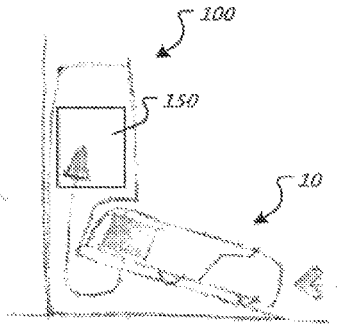
FIG. 15B
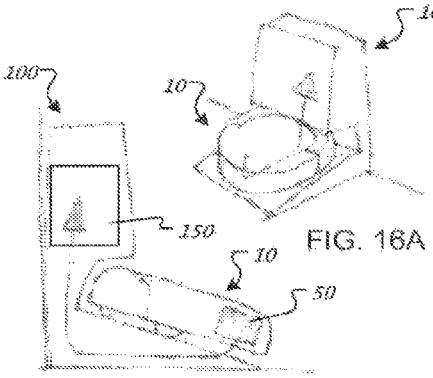
FIG. 16A
FIG. 16B
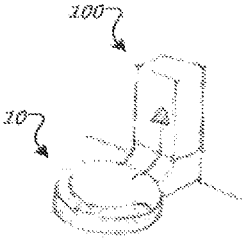
FIG. 17A
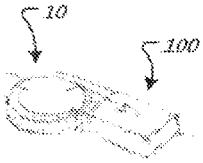
FIG. 17B
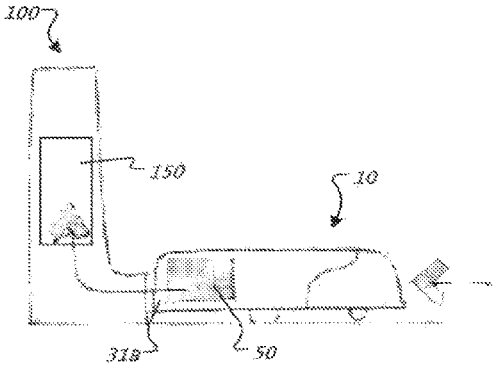
FIG. 17C STEP 1: homing and approach STEP 2: docking STEP 3: drop cartridge STEP 4 swap clean/dirty cartridge STEP 5: load cartridge STEP 6: undock and resume cleaning

REMOVING DEBRIS FROM CLEANING ROBOTS

CROSS-REFERENCE TO RELATED APPLICATIONS

This U.S. patent application is a continuation of Ser. No. 12/301,263, filed on Sep. 21, 2009, which is a U.S. National Phase of International Application Number PCT/US2007/069389, filed May 21, 2007, which claims priority under 35 U.S.C. 119(e) to U.S. provisional patent applications 60/747,791, filed on May 19, 2006, 60/803,504, filed on May 30, 2006 and 60/807,443, filed on Jul. 14, 2006. The entire contents of the aforementioned applications are hereby incorporated by reference.

TECHNICAL FIELD

This disclosure relates to cleaning systems for coverage robots.

BACKGROUND

Autonomous robots are robots which can perform desired tasks in unstructured environments without continuous human guidance. Many kinds of robots are autonomous to some degree. Different robots can be autonomous in different ways. An autonomous coverage robot traverses a work surface without continuous human guidance to perform one or more tasks. In the field of home, office and/or consumer-oriented robotics, mobile robots that perform household functions such as vacuum cleaning, floor washing, lawn cutting and other such tasks have become commercially available.

SUMMARY

In one aspect, a cleaning robot system includes a robot and a robot maintenance station. The robot includes a chassis, a drive system mounted on the chassis and configured to maneuver the robot as directed by a controller in communication with the drive system, and a cleaning assembly carried by the chassis. The cleaning assembly includes a cleaning assembly housing and a driven cleaning roller rotatably coupled to the cleaning assembly housing. The robot maintenance station includes a station housing and a docking platform carried by the station housing and configured to support the robot when docked. A mechanical agitator engages the roller of the robot with the robot docked. The agitator includes an agitator comb having multiple teeth configured to remove accumulated debris from the roller as the agitator comb and roller are moved relative to one another. The robot maintenance station includes a collection bin arranged to receive and hold debris removed by the mechanical agitator.

Implementations of this aspect of the disclosure may include one or more of the following features. In some examples, the robot maintenance station includes a station evacuation port configured to mate with the robot when the robot is received in the robot maintenance station for maintenance and a motorized vacuum pump in fluid communication with the collection bin and the station evacuation port. The motorized vacuum pump is configured to draw air into the vacuum pump and to evacuate accumulated debris removed by the mechanical agitator cleaning assembly into the collection bin. In some examples, the robot includes a downward facing cleaning agitator and the docking platform includes a locking assembly configured to secure the received robot to the platform so that the mechanical agitator cleaning assembly does not force the robot from the platform. The mechanical agitator cleaning assembly may include one or more blades configured to cut accumulated filaments off the roller. The mechanical agitator cleaning assembly may include an actuator configured to move the agitator of the docked robot. The cleaning robot system may include a vacuum assembly configured to evacuate cut filaments off the mechanical agitator cleaning assembly.

In another aspect, a cleaning robot system includes a robot and a robot maintenance station. The robot includes a chassis, a drive system mounted on the chassis and configured to maneuver the robot as directed by a controller in communication with the drive system, and a cleaning assembly carried by the chassis. The cleaning assembly includes a cleaning assembly housing and a driven cleaning roller rotatably coupled to the cleaning assembly housing. The robot includes a cleaning bin carried by the chassis. The robot maintenance includes a station housing configured to receive the robot for maintenance. The station housing defines a blower port and an evacuation port spaced from the blower port. The station blower port and the evacuation port are both arranged to be exposed to the robot cleaning bin when the robot is received in the maintenance station for maintenance. The robot maintenance includes a collection bin carried by the station housing and in fluid communication with the evacuation port and an air pump that blows air through the station blower port into the cleaning bin while drawing air through the station evacuation port and evacuating debris from the robot cleaning bin into the collection bin.

Implementations of this aspect of the disclosure may include one or more of the following features. In some examples, the robot maintenance station includes a mechanical agitator cleaning assembly arranged to engage a driven cleaning agitator of the cleaning head. The mechanical agitator cleaning assembly includes an agitator comb having multiple teeth configured to remove accumulated debris from the driven cleaning agitator as the agitator comb and driven cleaning a agitator are moved relative to one another. A collection bin receives accumulated debris from the agitator removed by the mechanical agitator cleaning assembly. The robot cleaning bin may be removable from the robot and the collection bin may be removable from the maintenance station. In some implementations, the cleaning head includes a vacuuming cleaning head configured to evacuate debris from the floor into the cleaning bin. In some implementations, the cleaning head includes a sweeping cleaning head configured to agitate debris from the floor and sweep the debris into the cleaning bin. The maintenance station may include a locking assembly configured to secure the robot with the station blower port and the station evacuation ports. The station blower port and the station evacuation ports are substantially sealed to the cleaning bin when the robot is received in the maintenance station for maintenance. In some implementations, the robot includes an internal bin maintenance sensor that monitors the contents of the robot cleaning bin for a maintenance condition. The controller of the robot causes the robot to begin seeking the maintenance station in order to dock and evacuate the robot cleaning bin in response to the maintenance condition.

In another aspect, a cleaning robot system includes a robot and a robot maintenance station. The robot includes a chassis, a drive system mounted on the chassis and configured to maneuver the robot as directed by a controller in communication with the drive system, a cleaning head carried by the chassis and including a mechanical agitator, and a cleaning bin carried by the chassis. The robot maintenance station includes a docking platform configured to support the robot with the robot docked for maintenance and an agitator comb arranged to engage the agitator of the docked robot and configured to remove accumulated debris from the agitator as the agitator comb and agitator are moved relative to one another. The robot maintenance station includes a collection bin disposed more than one foot above the docking platform and an air pump that pumps air past the agitator comb. The pumped air motivates debris removed by the agitator comb into the collection bin.

Implementations of this aspect of the disclosure may include one or more of the following features. In some examples, the air pump also moves a flow of air that evacuates debris from the robot cleaning bin. The mechanical agitator may include one or both of rotating bristle brush members and a rotating pliable beater members. The agitator comb may include one or both of rotating bristle brush members and a rotating pliable beater members. In some examples, the agitator comb includes blades for severing filaments among the debris. In other examples, the agitator comb includes slicker teeth for severing filaments among the debris. The agitator comb may be rotated relative to the mechanical agitator.

In yet another aspect, a cleaning robot system includes a robot and a robot docking station. The robot includes a chassis, a drive system mounted on the chassis and configured to maneuver the robot as directed by a controller in communication with the drive system, a driven cleaning head rotatably carried by the chassis, and a cleaning bin carried by the chassis and configured to receive debris from the cleaning head during cleaning. The robot docking station includes a docking station housing configured to receive the robot in a docked configuration for robot maintenance, a debris collection bin, and a motorized vacuum pump that draws air and debris from the robot cleaning bin to deposit the debris into the debris collection bin. The collection bin and vacuum pump are removable from the docking station housing as an assembly that also includes a graspable handle and forms a manually operable vacuum cleaner.

Implementations of this aspect of the disclosure may include one or more of the following features. In some examples, the housing of the docking station fluidly connects the motorized vacuum pump to the robot cleaning head to evacuate the robot cleaning head into the collection bin of the manually operable vacuum cleaner. In some implementations, the housing of the docking station fluidly connects the a vacuum cleaner cleaning head of the docking station to the robot cleaning head to evacuate the robot cleaning bin into the collection bin of the manually operable vacuum cleaner. In some examples, the robot cleaning head includes a mechanical agitator and the vacuum cleaner cleaning head includes at least one agitator comb. The housing of the docking station mechanically connecting the agitator comb of the vacuum cleaner cleaning head to the mechanical agitator of the robot cleaning head to remove accumulated debris from the mechanical agitator. The mechanical agitator may include one or both of rotating bristle brush members and a rotating pliable heater members. The agitator comb may include one or both of rotating bristle members and a rotating pliable beater members.

The details of one or more implementations of the disclosure are set fourth in the accompanying drawings and the description below. Other features, objects, and advantages will be apparent from the description and drawings, and from the claims.

DESCRIPTION OF DRAWINGS

FIG. 14A is a perspective view of a coverage robot docking with a maintenance station.

FIG. 14B is a perspective view of a coverage robot docking with a maintenance station.

FIG. 14C is a side view of a coverage robot docking with a maintenance station.

FIG. 15A is a perspective view of a coverage robot docking with a maintenance station.

FIG. 15B is a side view of a coverage robot docking with a maintenance station.

FIG. 16A is a perspective view of a coverage robot docking with a maintenance station.

FIG. 16B is a side view of a coverage robot docking with a maintenance station.

FIG. 17A is a perspective view of a coverage robot docking with a maintenance station.

FIG. 17B is a perspective view of a coverage robot docking with a maintenance station.

FIG. 17C is a side view of a coverage robot docking with a maintenance station.

FIG. 26A-27B are perspective views a maintenance station connectable to a house central vacuum system.

FIGS. 27A-27C are schematic views of an upright vacuum cleaner configured to evacuate a coverage robot bin.

Like reference symbols in the various drawings indicate like elements.

DETAILED DESCRIPTION

Figure 1:
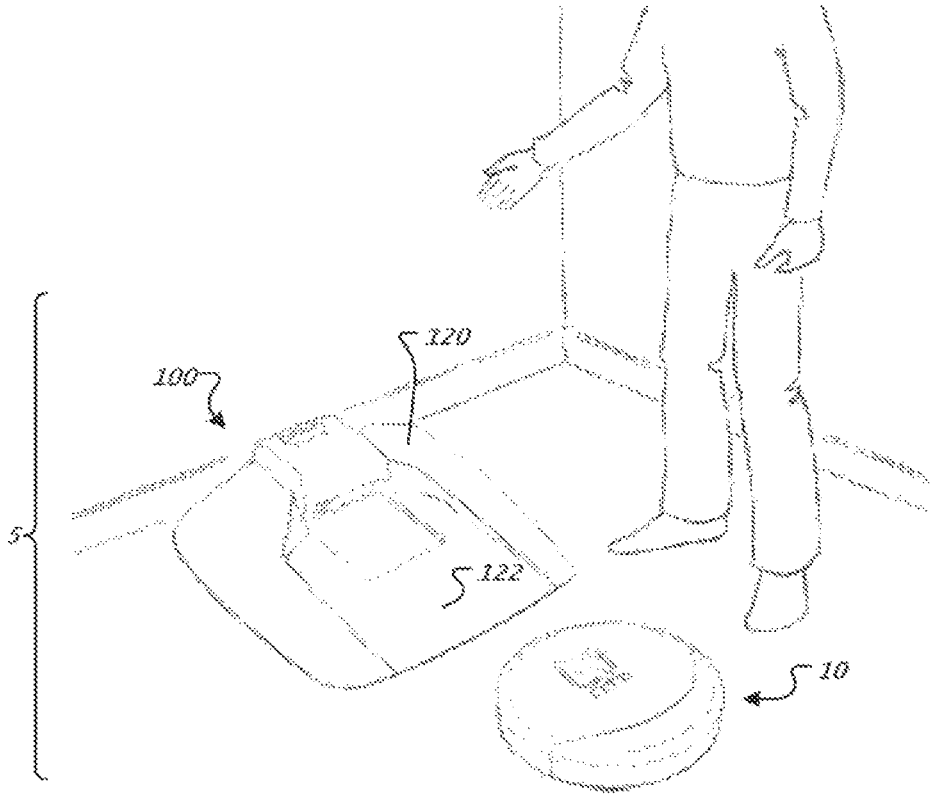
FIG. 1 is a perspective view of a maintenance station and a coverage robot.
Figure 2:
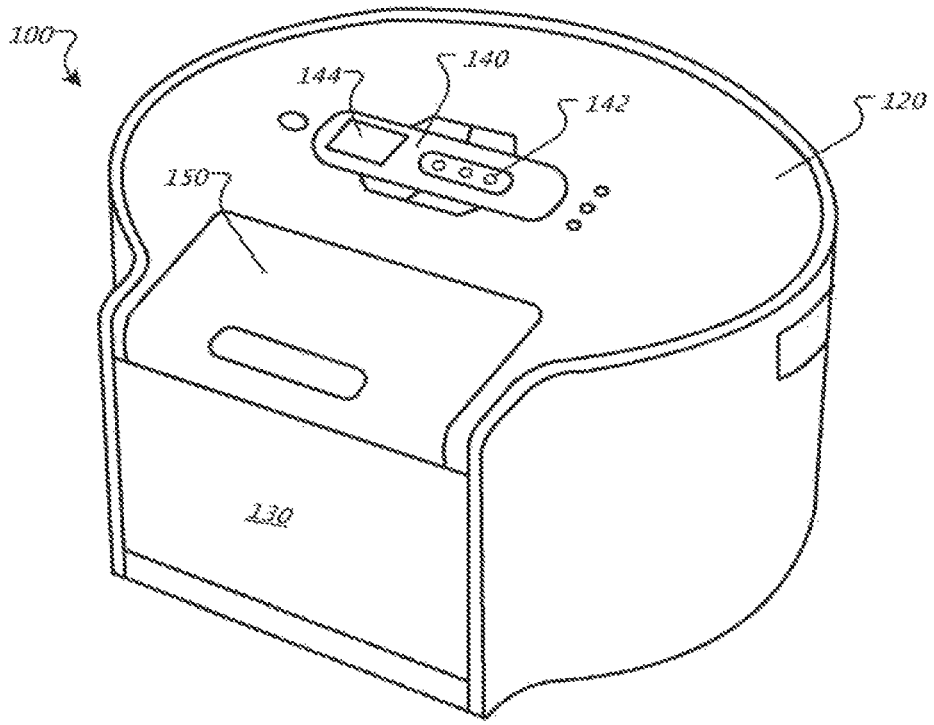
FIG. 2 is a perspective view of a maintenance station.
Figure 3:
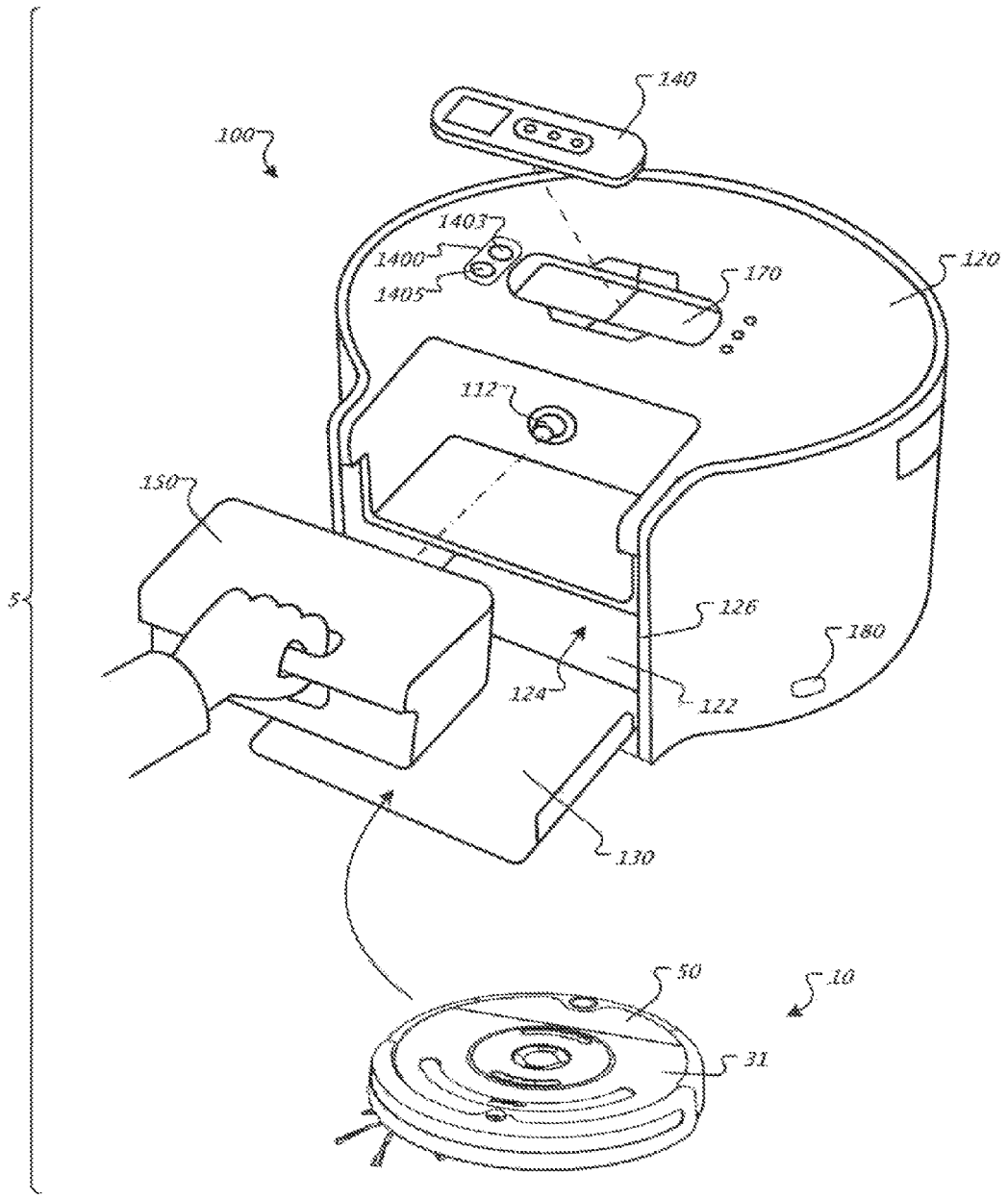
FIG. 3 is a perspective view of a maintenance station and a coverage robot.
Figure 4:
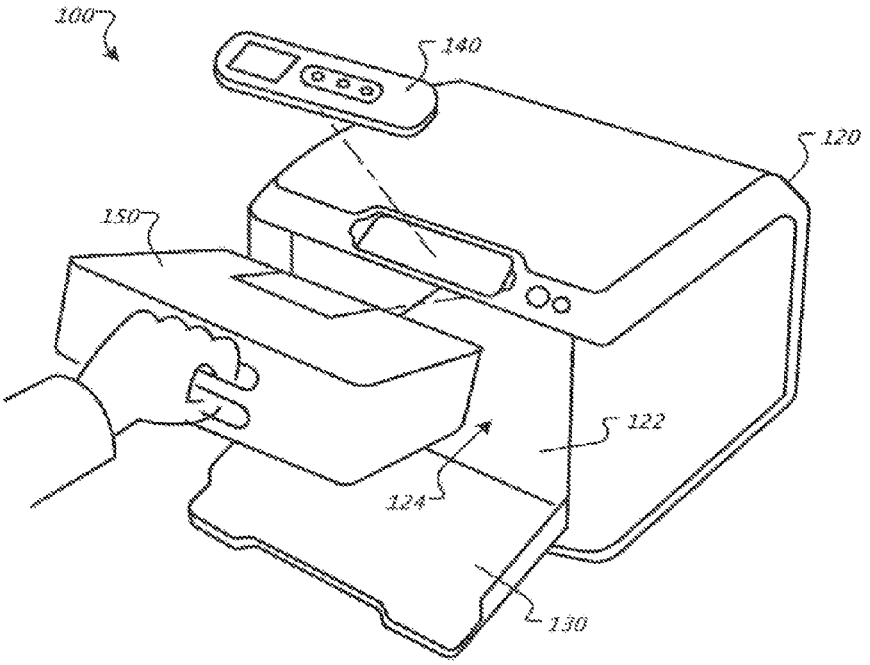
FIGS. 4-5 are exploded views of maintenance stations.

Referring to FIGS. 1-5, a maintenance station 100 for maintaining a robotic cleaner 10 includes a station housing 120 and a platform 122 on which the robot 10 is supported during servicing. In some examples, the maintenance station 100 defines an inner bay 124 enclosing the platform 122 for housing the robot 10 during servicing or for storage. A door 130 pivotally attached near the bottom of the maintenance station 100 encloses an opening 126 into the inner bay 124. The door 130 may be used as a ramp that the robot 10 maneuvers up to reach the platform 122 (e.g., as shown in FIG. 3). In some examples, the platform 120 includes an elevator configured to elevate the robot 10 up into the station 100 to a servicing position. The elevator may be a timing belt, four-bar linkage, walking beam, or other mechanical device. The elevator is most appropriate for robots having a brush or other mechanical cleaning implement primarily accessible via a lower surface of the robot. In such a case, the elevator elevates the robot 10 by a sufficient amount (i.e., at least one brush diameter, and preferably two brush diameters) such that mechanical servicing members and their driving apparatus can work beneath the robot. In examples where the platform 120 is not enclosed, e.g. FIG. 1, the platform 122 is inclined extending upward from the ground, allowing the robot 10 to maneuver up the platform 120 to a servicing position.

The maintenance station 100 may include a user interface 140 disposed on the housing 120. In some implementations, the user interface 140 is removably attachable to the housing 120 and configured to wirelessly (e.g., via radio frequencies—"RF"—or infrared emissions—"IR") communicate to a communication module 1400 on the maintenance station 100, and/or to a compatible communication facility on the robot 10. The communication module 1400 includes an emitter 1403 and a detector 1405 configured to emit and detect RF and/or IR signals, which are preferably modulated and encoded with information. Information to be transmitted from the communication module 1400 includes directional signals having a defined area of effect or direction (e.g., homing signals detectable by the robotic cleaner 10 and used to locate and/or drive towards the source of the homing signal), and command signals having encoded content including remote commands (e.g., command or cleaning a scheduling information detectable by the robot 10 or navigation devices for the robot 10). The user interface 140 includes buttons 142 and a display 144 allowing a user to input commands or instructions which are then processed by a controller 170 of the maintenance station 100 (or by the robot 10). The display 144 alerts the user to the status of the maintenance station 100 and provides visual feedback in response to commands and instructions inputted by the user. Preferably, the user interface 140 is removable and remotely operable external from the maintenance station 100 using the communication module 1400. In some examples, the user interface 140 is permanently installed on the maintenance station 100. Examples of indicators and controls that may be included on the user interface 140 include power on/off, a station bin full indicator, indicator for the robot on carpet or hardwood (allowing orbit self-adjusting to the surface demands), control to clean only the room the robot 10 or station 100 is placed in, return to station control, pause/resume cleaning, zone control, and scheduling.

The maintenance station 100 includes a collection bin 150 attached to the housing 120. The collection bin 150 is different from a (sweeper, vacuum, or combination) cleaner bin 50 located in the robot 10 in that its primary purpose is to collect and accumulate from the cleaner bin of a mobile robot 10. The collection bin 150 is three to ten times the volumetric capacity of the mobile robot bin 50. As shown in the examples illustrated in FIGS. 1-5, the collection bin 150 may be integral with the housing 120 (FIG. 1), removably attached to a top portion of the housing 120 to be disengaged substantially parallel to the ground (FIG. 3), removably attached to a front or overhanging portion of the housing 120 to be disengaged substantially parallel to the ground from underneath the overhang (FIG. 4), or removably attached to the top of the housing to be disengaged in a vertical direction (FIG. 5).

Figure 5:
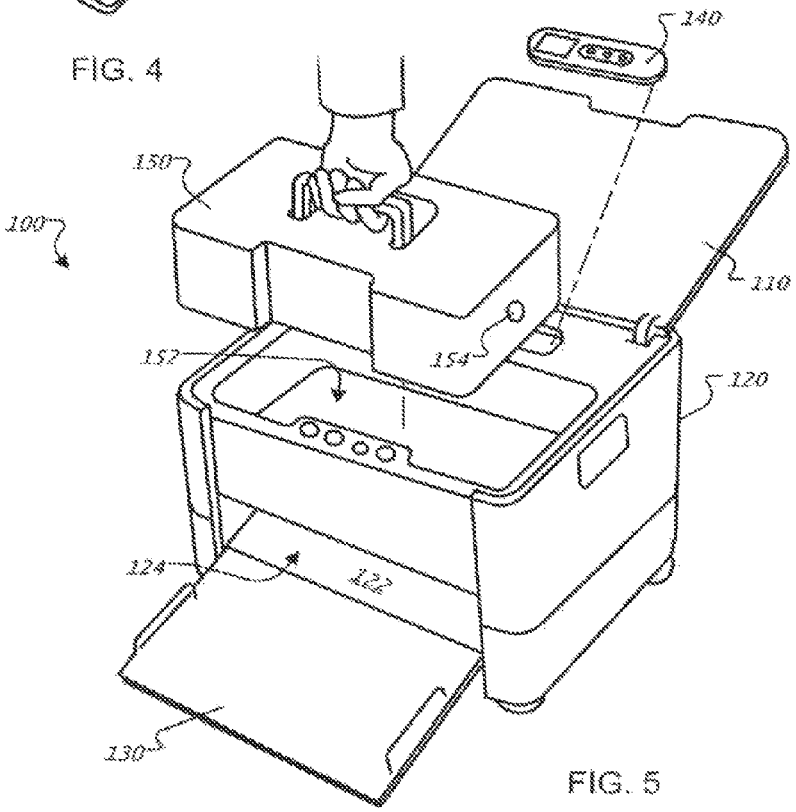

In the example shown in FIG. 5, the cleaning bin 150 is received by a bin receptacle 152 defined by the housing 120. A station cover 110 pivotally attached to the housing 120 enclosed the bin receptacle 152. In some cases, the top of the housing 120 defines the bin receptacle 152 and receives the station cover 110. In other cases, the rear or side of the housing 120 defines the bin receptacle 152 and receives the station cover 110. In some examples, the station cover 110 is unhinged from the housing 120 for servicing the bin 150.

In some implementations, the maintenance station 100 includes a communication port 180. The port 180 may be installed along a bottom side edge of the maintenance station 100 so as not to interfere with nearby internal components. Example configurations of the port 180 include RS232 serial, USB, Ethernet, etc. The primary purpose of the communication port is (i) permitting "flashing" of microcontroller code for controlling the maintenance station 100 and (ii) permitting accessories to the maintenance station 100 (such as an auxiliary brush cleaner discussed herein) to be connected to and controlled along with the maintenance station 100 and robot 10.

Referring to FIG. 3, the maintenance station 100 includes a bin connector 112 configured to mate with a corresponding bin connector 164 on the collection bin 150. The bin connectors 112, 154 provides a flow path for evacuating debris from the robot bin 50 to the maintenance station collection bin 150.

Figure 6A:
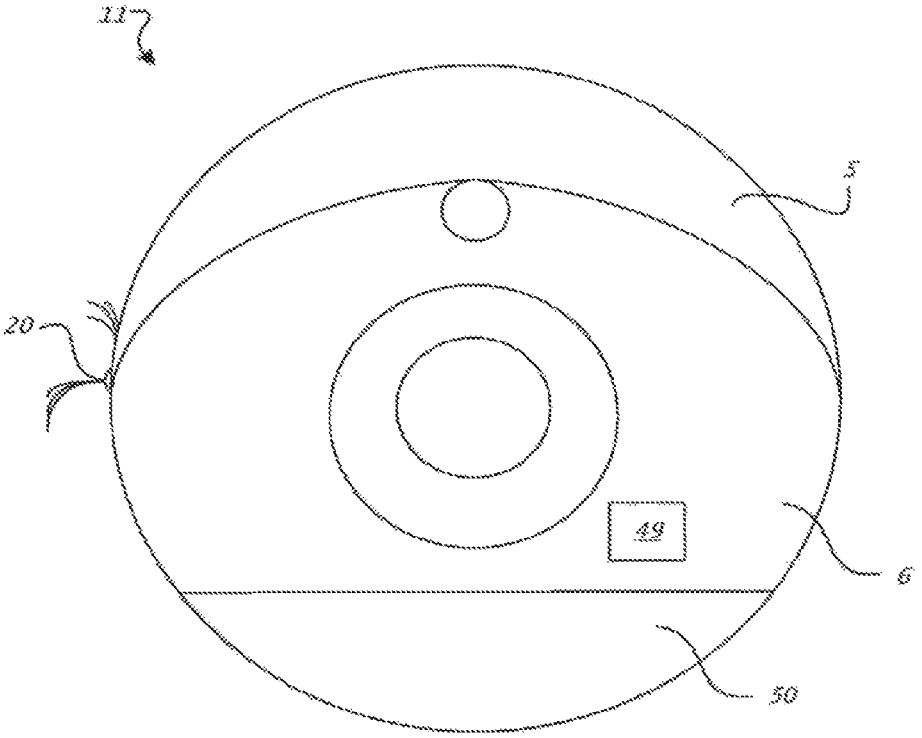
FIG. 6A is a top view of a coverage robot.
Figure 6B:
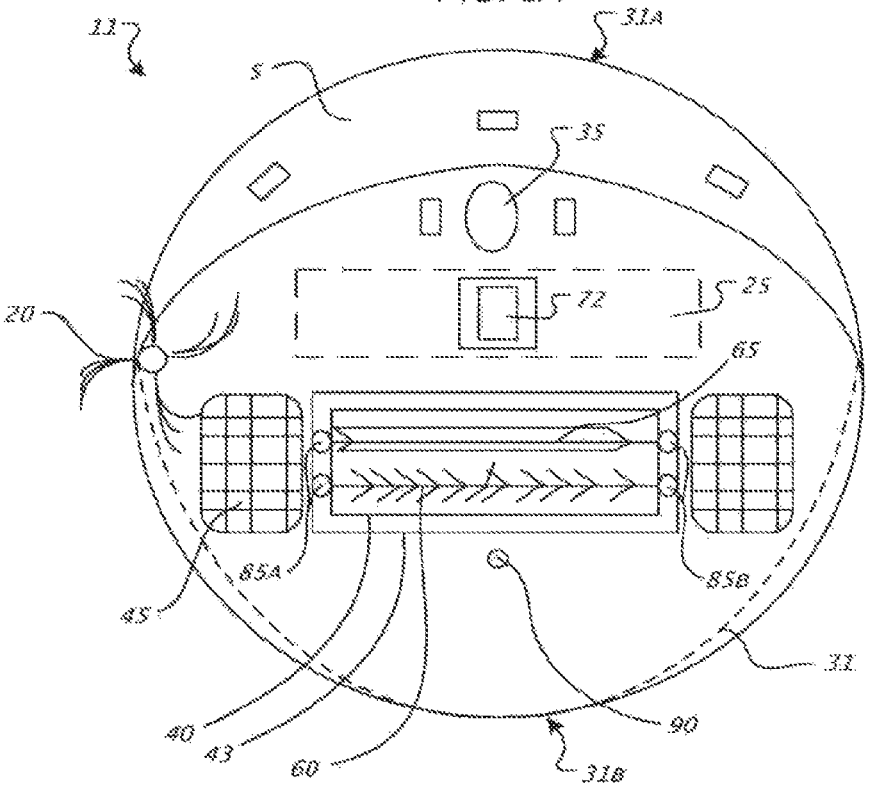
FIG. 6B is a bottom view of a coverage robot.

Referring to FIGS. 6A-6B, the autonomous robotic cleaner 10 includes a chassis 31 which carries an outer shell 6. FIG. 6A illustrates the outer shell 6 of the robot 10 connected to a bumper 5. The robot 10 may move in forward and reverse drive directions; consequently, the chassis 31 has corresponding forward and back ends, 31A and 31B respectively. The forward end 31A is fore in the direction of primary mobility and in the direction of the bumper 5; the robot 10 typically moves in the reverse direction primarily during escape, bounces, and obstacle avoidance. A cleaning head assembly 40 is located towards the middle of the robot 10 and installed within the chassis 31. The cleaning head assembly 40 includes a main brush 60 and a secondary parallel brush 65 (either of these brushes may be a pliable multi-vane beater or a have pliable beater flaps 61 between rows of brush bristles 62). A battery 25 is housed within the chassis 31 proximate the cleaning head 40. A controller 49 is housed within the chassis 31. In some examples, the main 65 and/or the secondary parallel brash 60 are removable. In other examples, the cleaning head assembly 40 includes a fixed main brush 65 and/or secondary parallel brush 60, where fixed refers to a brush permanently installed on the chassis 31. In some examples, the robot includes a vacuuming cleaning head 44 configured to evacuate debris from a floor into the cleaning bin 50.

Installed along either side of the chassis 31 are differentially driven wheels 45 that mobilize the robot 10 and provide two points of support. The forward end 31A of the chassis 31 includes a caster wheel 35 which provides additional support for the robot 10 as a third point of contact with the floor and does not hinder robot mobility. Installed along the side of the chassis 31 is a side brush 20 configured to rotate 360 degrees when the robot 10 is operational. The rotation of the side brush 20 allows the robot 10 to better clean areas adjacent the robot's side by brushing and flicking debris beyond the robot housing in front of the cleaning path, and areas otherwise unreachable by the centrally located cleaning head assembly 410. A removable cleaning bin 50 is located towards the back end 31B of the robot 10 and installed within the outer shell 6.

Figure 7:
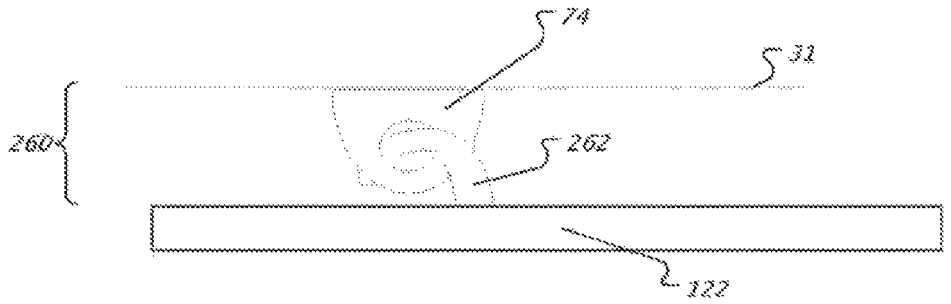
FIG. 7 is a side view of a locking assembly.
Figure 8:
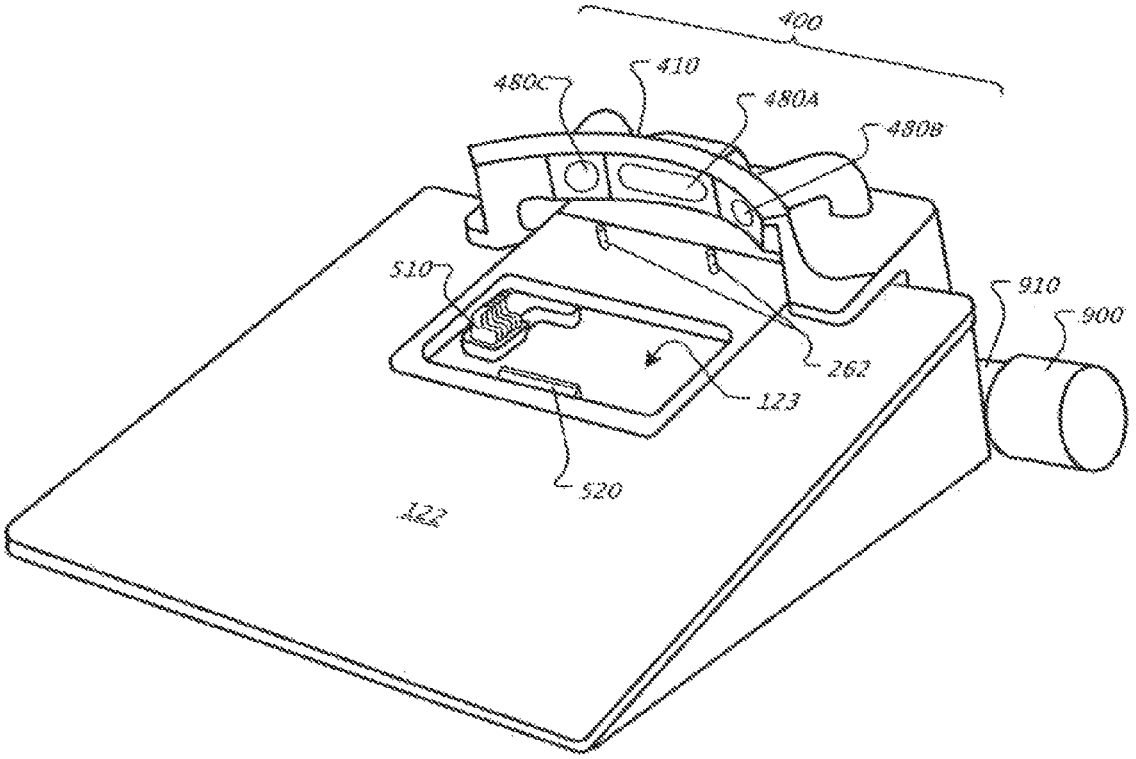
FIG. 8 is a perspective view of a cleaning assembly of a maintenance station.

Referring to FIG. 7, a lock assembly 260 may be installed on the platform 122 for securing the robotic cleaner 10 to the platform 122 via a corresponding lock assembly 72 on a bottom side of robot chassis 31. Referring to FIG. 7, in some implementations, a clip catch 74 is installed on the bottom of the robot chassis 34 and configured to mate with a clip 262 on the maintenance station 100. The clip 262 engages the catch 74 to lock the robot 10 in place during servicing of the bin 50 and/or brushes or rollers 60, 65. In order to service brushes or rollers 60, 65 in particular, if the robot 10 is elevated and the brushes 60, 65 available for service at the bottom of the robot 10, the upward force of rotating, reciprocating, or traversing cleaning tools as discussed herein may lift a relatively light weight robot (e.g., a 3-15 lb robot will be lifted by this much upward force). Accordingly, when the robot 10 is elevated or brought to a brush service position, the mating locking assemblies hold the robot 10 against this upward force. Referring to FIG. 8, in some implementations, the lock assembly 260 includes two protrusions or pegs 264 received by the robot lock assembly 72 to anchor the robot 10. The lock assembly 260 may provide communication (e.g. via the pegs 264) between the robot 10 and the maintenance station 100.

Once contacts on the underside of the robotic cleaner 10 connect with the contacts 264 on the platform 122, the maintenance station 100 may emit a command signal to the robotic cleaner 10 to cease driving. Alternatively, the robot's microcontroller and memory may exercise primary control of the maintenance station and robot combination. In response to the command signal, the robotic cleaner 10 stops driving forward and emits a return signal to the maintenance station 100 indicating that the drive system has shut down. The maintenance station 100 then commences a locking routine that mobilizes the locking assembly 260 to lock and secure the robotic cleaner 10 to the platform 122. Again, alternatively, the robot 10 may command the maintenance station to engage its locks.

Figure 9:
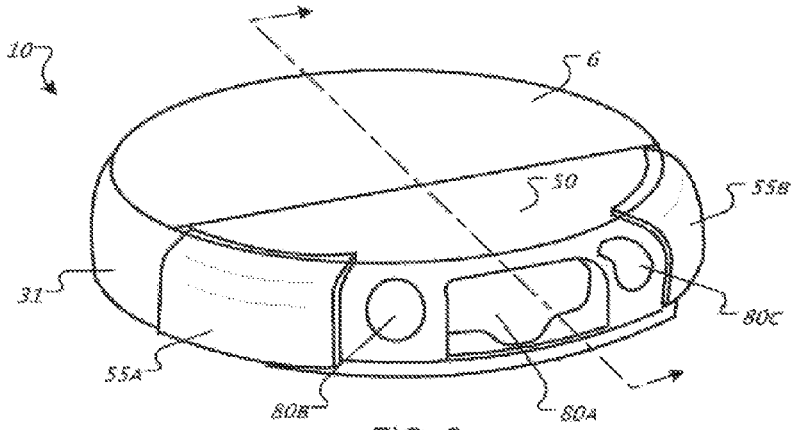
FIG. 9 is a perspective view of a coverage robot with bin evacuation ports.

Referring to FIG. 8, a cleaning assembly 300 is carried by the housing 120 and includes a bin evacuation (vacuuming) assembly 400 and a mechanical brush or roller cleaning assembly 500. The bin evacuation assembly 400 is secured to the platform 122 and positioned to engage an evacuation port assembly 80 of the cleaning bin 50, as shown in FIG. 9. The evacuation port assembly 80 may include a port cover 55. In some implementations, the port cover 55 includes a panel or panels 55A, 55B which may slide (or be otherwise translated) along a side wall of the chassis 31 and under or over side panels of the outer shell 6 to open the evacuation port assembly 80. The evacuation port assembly 80 is configured to mate with the corresponding evacuation assembly 400 on the maintenance station 100. In some implementations, the evacuation port assembly 80 is installed along an edge of the outer shell 6, on a top most portion of the outer shell 6, on the bottom of the chassis 31, or other similar placements where the evacuation port assembly 80 has ready access to the contents of the cleaning bin 50. In some implementations, the evacuation assembly 400 includes a manifold 410 defining a plurality of evacuation ports 80A, 80B, 80C that are distributed across the entire volume of the cleaning bin 50, e.g., center evacuation port 480A and two side evacuation ports 480B and 480C on either side. The evacuation ports 480A, 480B, 480C on the station 100 are configured to mate with corresponding evacuation ports 80A, 80B, 80C on the robot cleaning bin 50, preferably with a substantially air-tight vacuum seal. In some examples, the evacuation port assembly 80 is disposed on a top or bottom side of the cleaning bin 50. While evacuating from a top-side evacuation port assembly 80, a suction placed on at least one of the evacuation ports 80A, 80B, 80C tends to first draw loosely packed material off a top layer of debris, followed by successive layers of debris. Bin symmetry may aid bin evacuation.

Figure 10A:
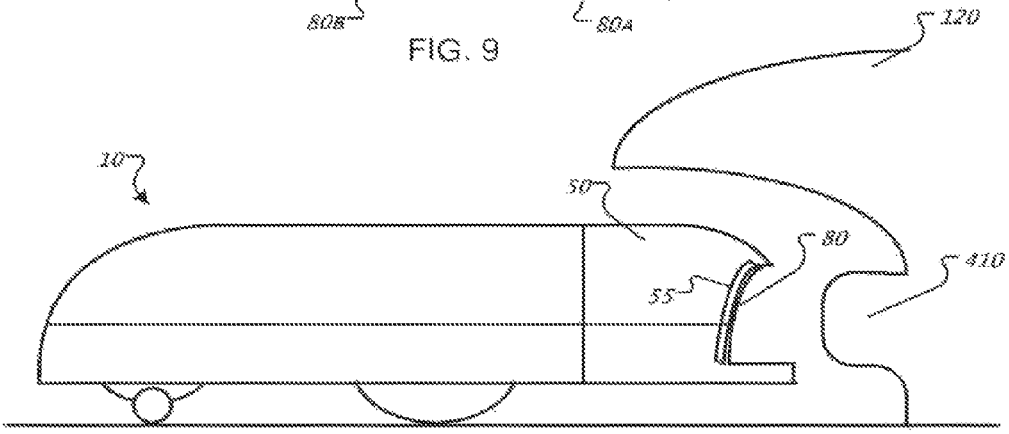
FIGS. 10A-10B are side views of a coverage robot docking with a maintenance station.
Figure 10B:
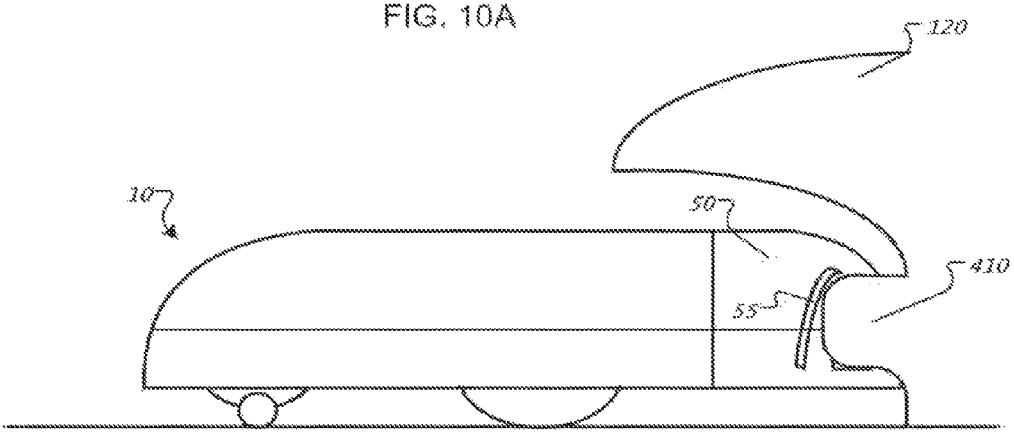

Referring to FIGS. 10A-10B, when the robot 10 maneuvers onto the platform 122 to dock with the station 100 for servicing, the robot 10 is guided or aligned so that the evacuation port assembly 80 on the robot cleaning bin 50 engages the station evacuation assembly 400. The robot 10 may be guided by a homing signal, tracks on the platform 122, guide rails, a lever, or other guiding devices. The evacuation assembly 400 disengages the port cover 55 on the robot cleaning bin 50, in some examples, when the robot 10 docks with the station 100. In some implementations, each evacuation port 480A, 480B, 480C draws debris out of the cleaning bin 50. In other implementations, one or more evacuation ports 480A, 480B, 480C blow air into the cleaning bin 50, while one or more evacuation ports 480A, 480B, 480C draw debris out of the cleaning bin 50. For example, evacuation ports 480B and 480C blow air into the cleaning bin 50, while evacuation port 480A draws debris out of the cleaning bin 50. The evacuation manifold 410 is connected to a debris line that directs evacuated debris to the station bin 150. A filter 910 may be disposed at the intake of a vacuum 900 that provides suction for the evacuation assembly 400.

Figure 11B:
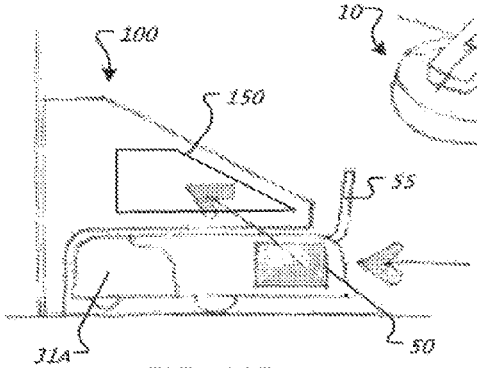
FIG. 11B is a side view of a coverage robot docking with a maintenance station.
Figure 11A:
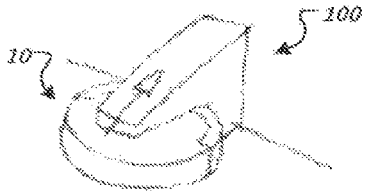
FIG. 11A is a perspective view of a coverage robot docking with a maintenance station.
Figure 12B:
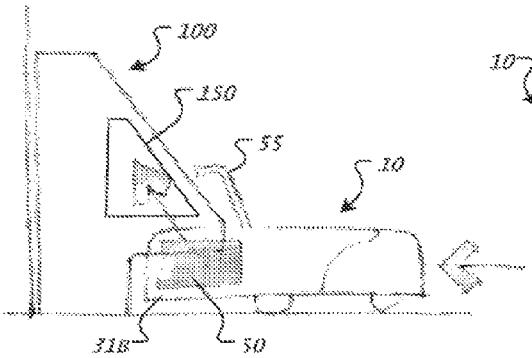
FIG. 12B is a side view of a coverage robot docking with a maintenance station.
Figure 12A:
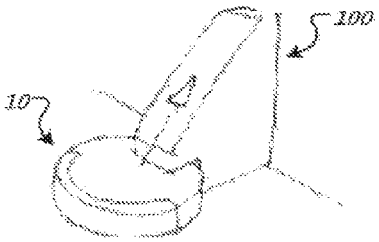
FIG. 12A is a perspective view of a coverage robot docking with a maintenance station.

Referring to FIGS. 11A-12B, in some implementations, the robot 10 includes a port cover 55 accessible on a top side on the robot 10 providing access to the cleaning bin 50. FIGS. 11A-11B illustrate an example where the robot 10 docks with the forward chassis end 31A facing toward the station 100. Upon docking, either the robot 10 or the station 100 opens the port cover 55 to evacuate debris up out of the top of the robot bin 50 and into the station bin 150. FIGS. 12A-12B illustrate an example where the robot 10 docks with the rear chassis end 31B facing toward the station 100 to evacuate debris up out of the top of the robot bin 50 and into the station bin 150. In both examples, the robot 10 maneuvers under a portion of the station 100, which gains access to a top portion of the robot bin 50. As shown in FIG. 12C, a robot 10 cleans along the floor in the manner described herein, driven and supported by wheels 35, 45. Within the outer shell 6, the primary brush 60 turns in a direction opposite to forward travel, and the parallel secondary brush 65 catches debris agitated by the primary brush 60 and ejects it up and over the primary brush 60 into the bin 50. A squeegee vacuum may trail the primary brush 60, part of the bin 50. A panel 55, in this configuration, may cover the top of the brushes, with an angled surface within the chassis 31 or panel 55 to angle debris from the brushes 60, 65 into the bin 50. Referring to FIG. 12C, in some instances, the bin 50 includes a bin-full detection system 700 for sensing an amount of debris present in the bin 50. In one implementation, the bin-full detection system includes an emitter 755 and a detector 760 housed in the bin 50 and in communication with the controller 49.

Figure 12C:
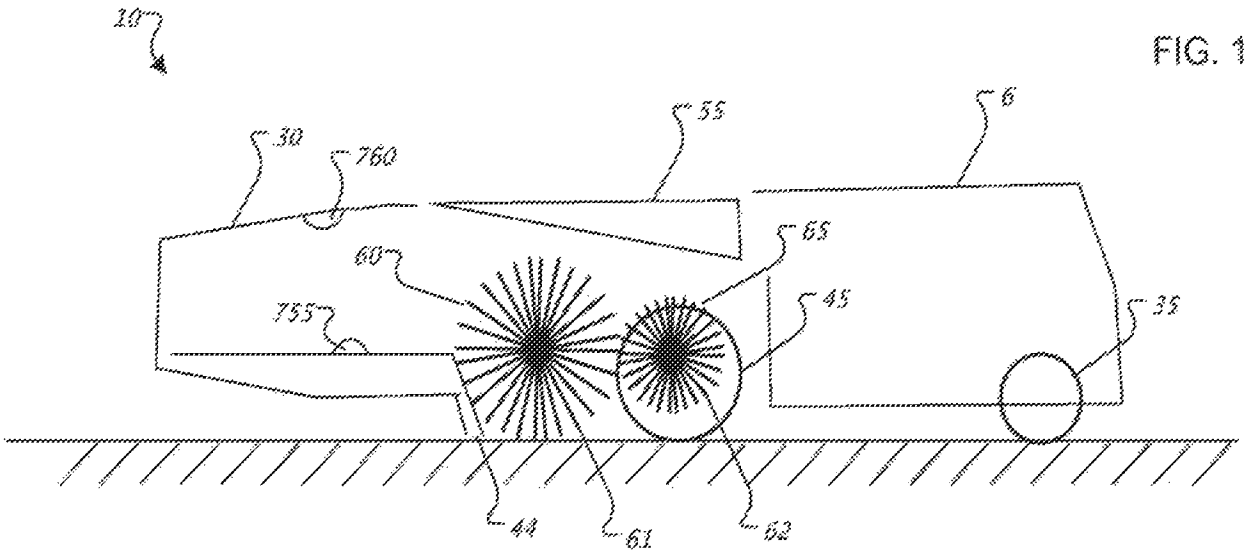
FIG. 12C is a schematic side view of a coverage robot having a cleaning bin cover panel operating to clean a floor.
Figure 12D:
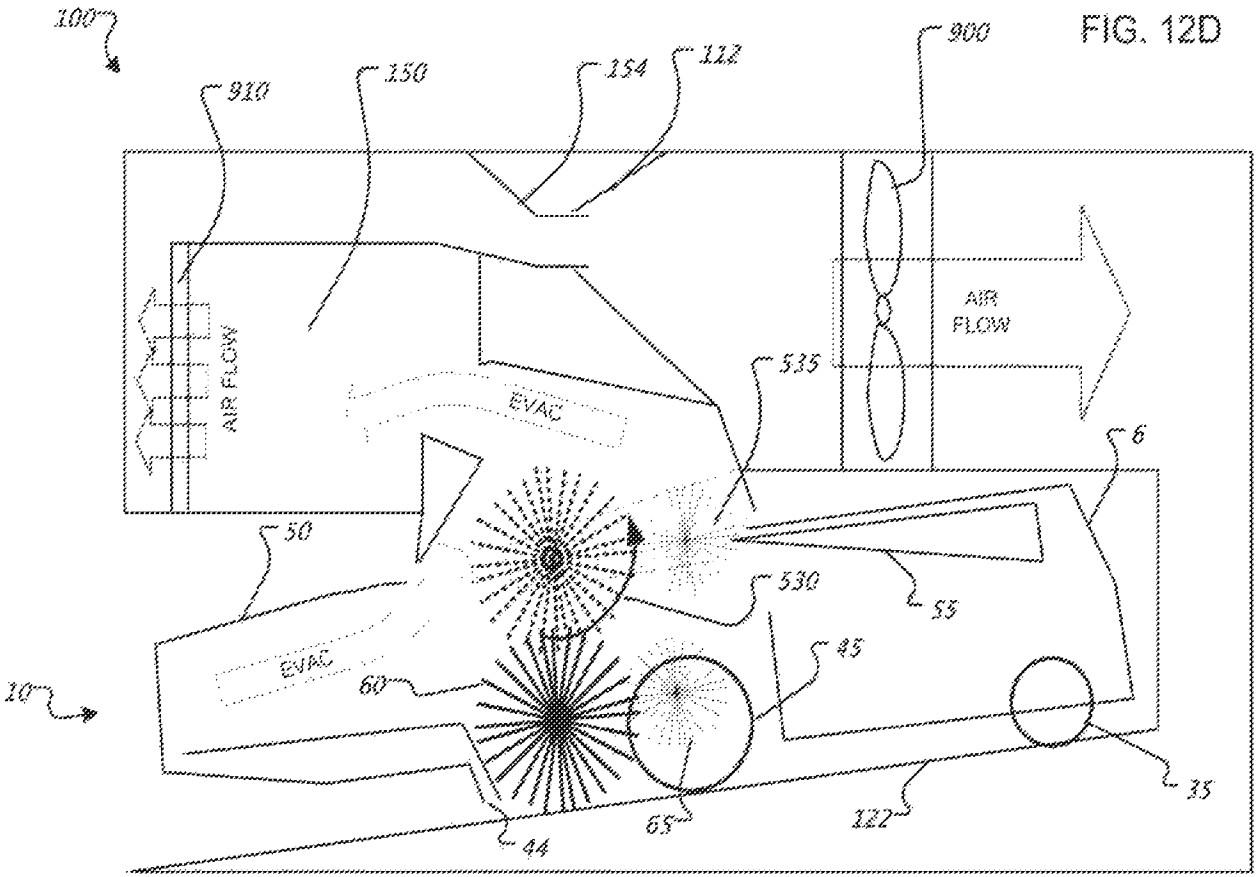
FIG. 12D is a schematic side view of a coverage robot having a cleaning bin cover panel docked with a maintenance station.

As shown in FIG. 12D (a variation upon FIGS. 11B and 12B), the robot 10 may follow a platform 122 into the maintenance station 100. Once within or engaged with the maintenance station 100, the panel 55 is moved aside to expose at least the primary brush 60 (to expose any brushes which may accumulate filaments or fuzz, including bristle type brushes). The maintenance station 100 may lower, or locate in predetermined positions, brush-cleaning brush or beater 530 and optionally parallel brush or beater 535. The brush cleaning member/mechanism 530 engages the primary cleaning brush 65, and is driven by a motor (not shown) in the maintenance station 100 (or uses the brush 60 motor) to clean the brush 60. The optional parallel brush 535 may catch the debris or filaments agitated by the brush cleaning brush 530 and eject them up and over the brush 530 to the collection bin 150 in the maintenance station 100. As discussed herein, the collection bin 150 may be a vacuum bin, and include a vacuum filter 910 removable with the bin; may engage the maintenance bin via ports 154, 112, and be evacuated by a vacuum motor 900 in the maintenance station 100. In the configuration shown in FIG. 12D, the vacuum 900 is a high powered vacuum (e.g., 6-12 amp) that pulls air through the filter 910, through the collection bin 150, over and through the brushes 530, 535, and optionally directly or diverted from the cleaning bin 30 of the robot 10. Optionally, the remaining areas of the robot 10 (e.g., circuit board areas) may benefit from evacuation as well, and are not sealed from the vacuum.

Figure 13A:
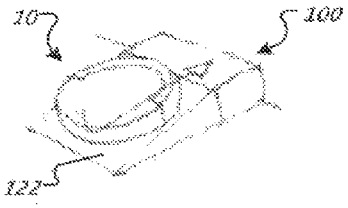
FIG. 13A is a perspective view of a coverage robot docking with a maintenance station.
Figure 13B:
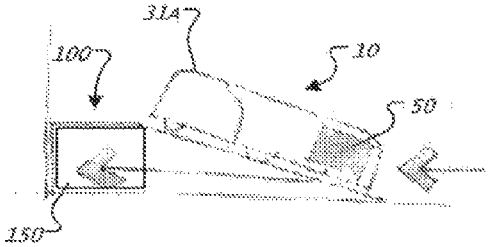
FIG. 13B is a side view of a coverage robot docking with a maintenance station.

Referring to FIGS. 13A-16B, in some implementations, the robot 10 maneuvers onto an inclined platform 122 of the station 100 to provide access to an underside of the robot 10 for servicing the cleaning bin 50. The station 100 evacuates debris down out of the robot bin 50 and into the station bin 150. FIGS. 13A-13B illustrate an example where the robot 10 docks with the station 100 with the forward chassis end 31A facing forward on the platform 122 and debris is evacuated down out of the bottom of the robot bin 50 into the station bin 150. FIGS. 14A-14C illustrate an example where the robot 10 docks with the station 100 with the rear chassis end 31B facing forward on the platform 122 and debris is evacuated down out of the bottom of the robot bin 50 into the station bin 150. FIGS. 15A-15B illustrate an example where the robot 10 docks with the station 100 with the rear chassis end 31B facing forward on the platform 122 and debris is evacuated down out of the bottom of the robot bin 50 and then up into the station bin 150. FIGS. 16A-16B illustrate an example where the robot 10 docks with the station 100 with the forward chassis end 31A facing forward on the platform 122 and debris is evacuated down out of the bottom of the robot bin 50 and then up into the station bin 150.

Referring to FIGS. 17A-17C, in some implementations, the robot 10 docks with the rear chassis end 31B facing toward the station 100 to evacuate debris out of the rear of the robot bin 50 and into the station bin 150. The station bin 150 may be located above, below, or level with the robot bin 50.

In any of the examples described, the evacuation station 100 may evacuate the robot bin to with a sweeper device (e.g. rotating brush or sweeper arm), in conjunction with or instead of vacuuming. In particular, the maintenance station mechanical service structures illustrated in FIGS. 8, 12D, 18A-18C may mechanically service brushes, flappers, beaters, or other rotating or reciprocating cleaning agitators in situ in the robot 10 from the top, bottom, or sides of the robot 10, and/or with the cleaning agitators being articulated to protrude from the robot 10; and/or wholly removed from the robot 10 as a cartridge unit or as a plain brush; and/or with the mechanical service structures being stationary or articulated to intrude into the shell 6 of the robot 10.

Referring to FIGS. 8 and 18A-18D, in some implementations, the platform 122 defines an opening 123 which provides access for the roller cleaning assembly 500 to the cleaning head assembly 40 of the robot 10 for servicing the main 65 brush and/or the secondary brush 60 (optionally included or the robot 10). The roller cleaning assembly 500 includes a driver linear slide guide 502 carrying a cleaning head cleaner 510 and/or a trimmer 520. In some examples, the driven linear slide guide 502 includes a guide mount or rail follower 503 carrying the cleaning head cleaner 510 and slidably secured to a shaft or rail 504. The rail follower 503 is driven by a motor 505 via a belt (as shown), lead screw, rack and pinion, or any other linear motion drive. A rotator 530 rotates the roller 60, 65 during cleaning. The maintenance station 100 includes a controller 1000 in communication with the communication module 1400 and the cleaning assembly 300 that may control the agitation and cleaning processes, set an order of events, and otherwise drive the mechanical and vacuum cleaning facilities described herein in an appropriate order.

The cleaning head cleaner 510, in some examples, includes a series of teeth or combs 512 configured to strip filament and debris from a roller 60, 65. In some implementations, the cleaning head cleaner 510 includes one or more flat, semi-tubular or quarter-tubular tools 511 having teeth 512, dematting rakes 514, combs, or slicker combs. The tubular tool 511 may be independently driven by one or more servo, step or other motors 505 and transmissions (which may be a belt, chain, worm, ball screw, spline, rack and pinion, or any other linear motion drive). In some examples, the roller 60, 65 and the cleaning head cleaner 510 are moved relative to one another. In other examples, the cleaning head cleaner 510 is fixed in place while the roller 60, 65 is moved over the cleaning head cleaner 510.

The roller 60, 65 is placed adjacent the cleaning head cleaner 510, either while in situ in the robot 10, in a removable cleaning head cartridge 40, or as a stand alone roller 60, 65 removed from the robot 10. If the roller 60, 65 is part of a removable cleaning head cartridge 40, the cleaning head cartridge 40 is removed from the robot 10 and placed in the station 100 for cleaning. Once the roller 60, 65 is positioned in the station 100 for cleaning, the station 100 commences a cleaning routine including traversing the cleaning head 510 over the roller 60, 65 such that the teeth 512, dematting rakes 514, combs, or slicker combs, separately or together, cut and remove filaments and debris from the roller 60, 65. In one example, as the cleaning head 510 traverses over the roller 60, 65, the teeth 512 are actuated in a rotating motion to facilitate removal of filaments and debris from the roller 60, 65. In some examples, an interference depth of the teeth 512 into the roller 60, 65 is variable and progressively increases with each subsequent pass of the cleaning head 510.

Figure 18A:
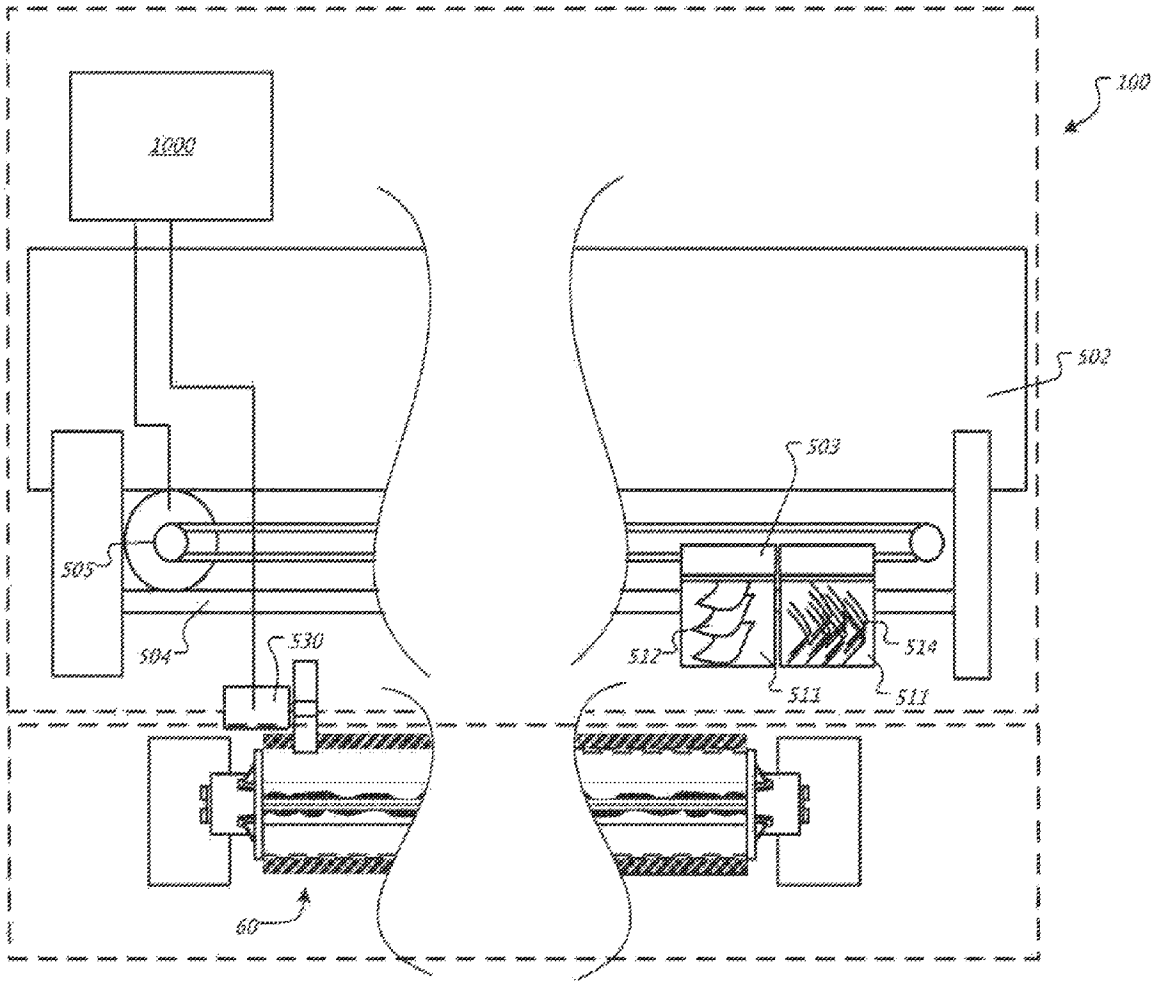
FIG. 18A is a top view of a roller cleaning system.
Figure 18B:
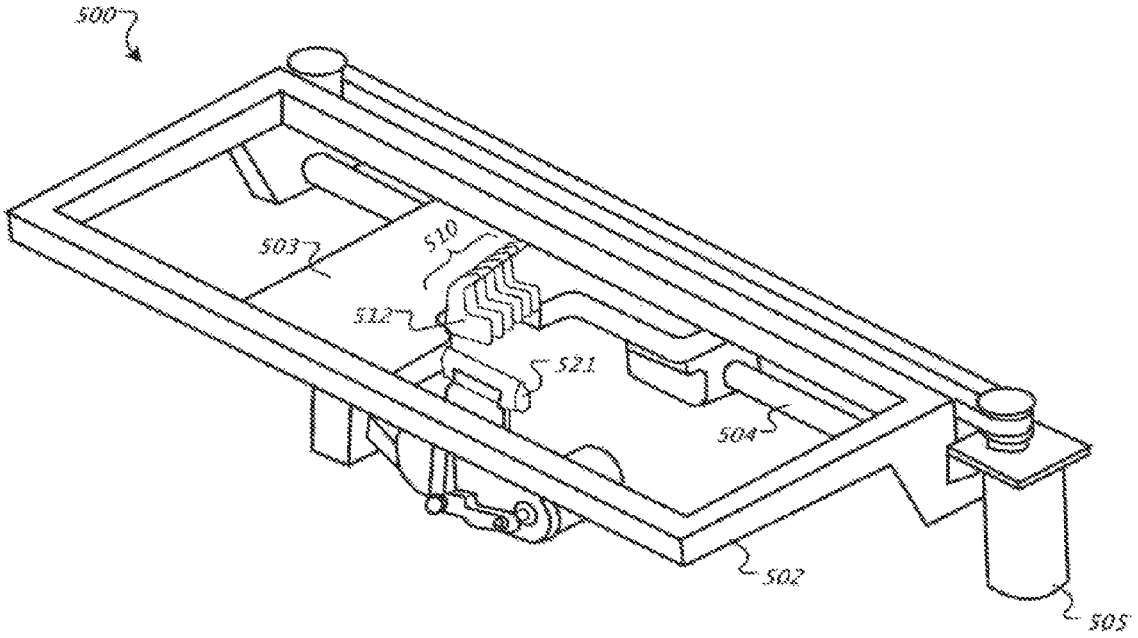
FIG. 18B is a perspective view of a roller cleaning system.
Figure 18C:
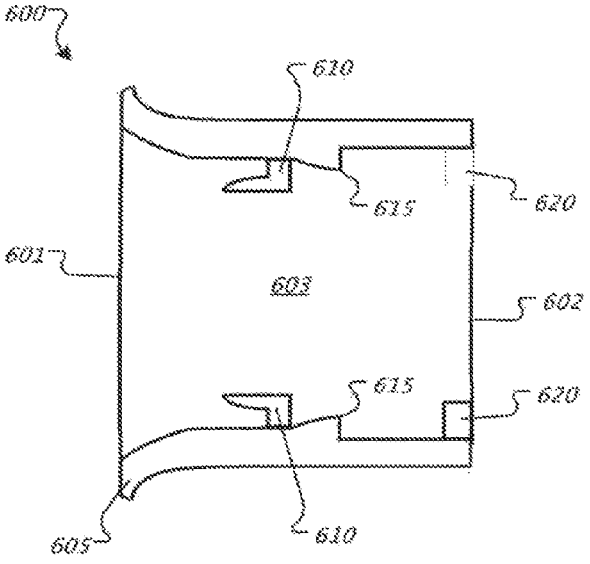
FIG. 18C is a side sectional view of a roller cleaning tool.

FIG. 18C illustrates an example semi-tubular tool 600 having first and second ends, 601 and 602 respectively. The first end 601 of the tool 600 defines a semi-bell shaped opening 605. The semi-tubular tool 600 includes teeth 610 disposed along an inner surface 603. In some implementations, the semi-tubular tool 600 includes trailing comb teeth 620, which may grab and trap remaining loose strands of hair or filaments missed or released by the teeth 610. The trailing comb teeth 620 may be more deformable, deeper, thinner, or harder (and vice versa) than the teeth 250 to scrape or sweep exterior surfaces of the roller 60.

Figure 18D:
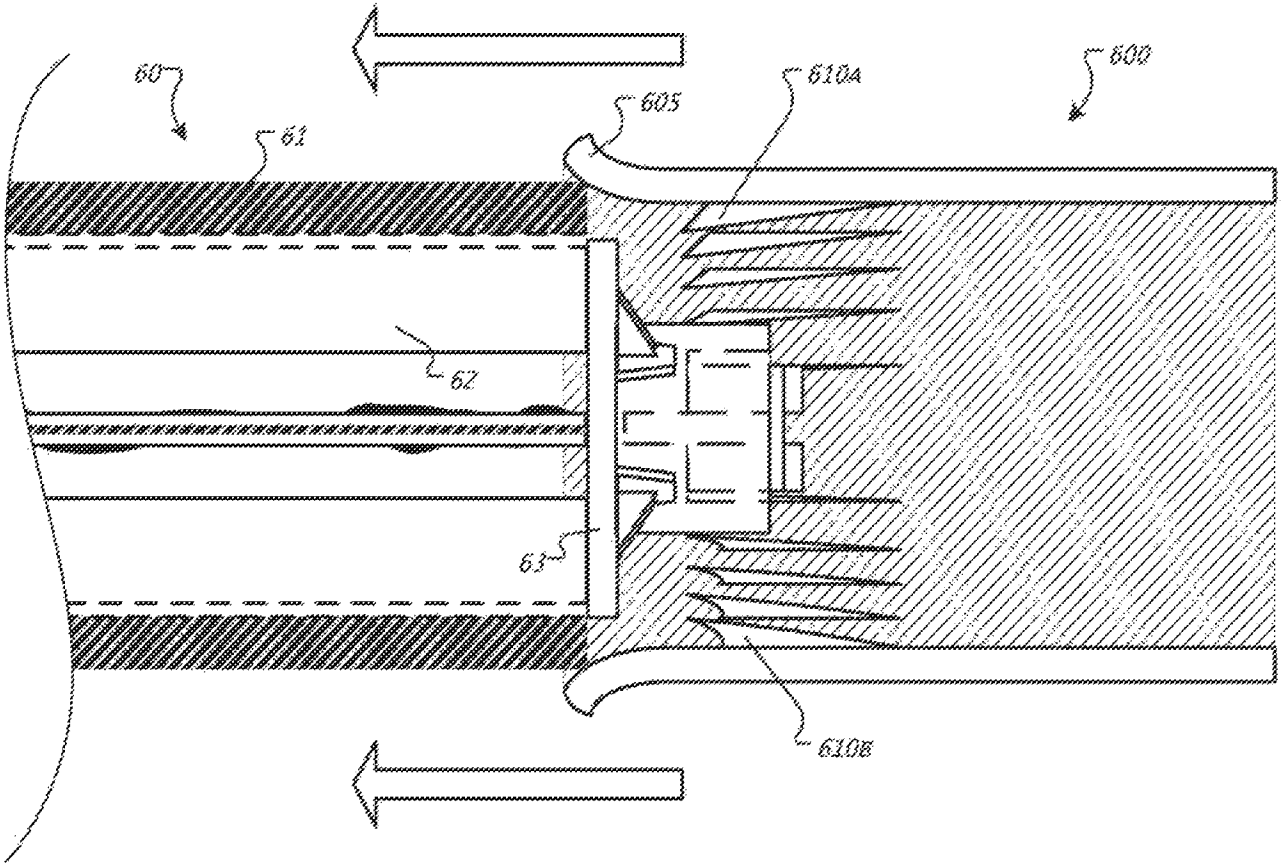
FIG. 18D is a side view of a roller cleaning tool.
Figure 19A:
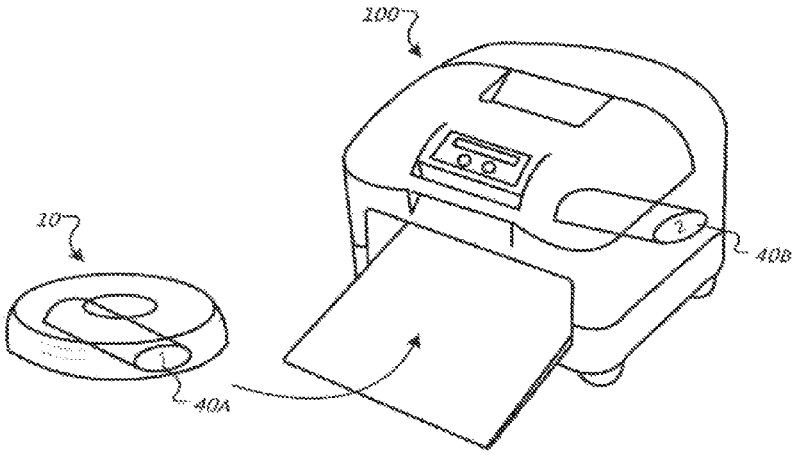
FIGS. 19A-19F are schematic views a coverage robot docking with a maintenance station for servicing.
Figure 19B:
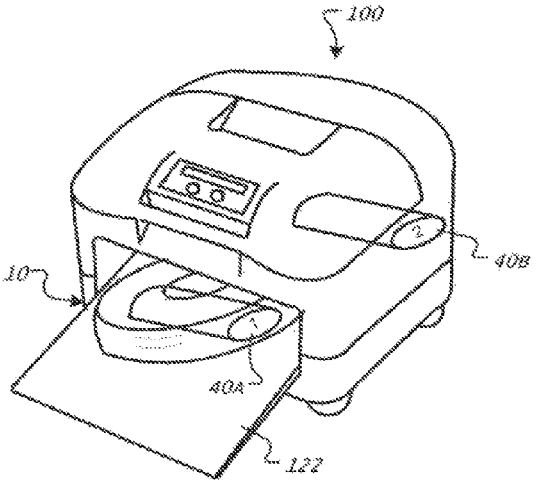
Figure 19C:
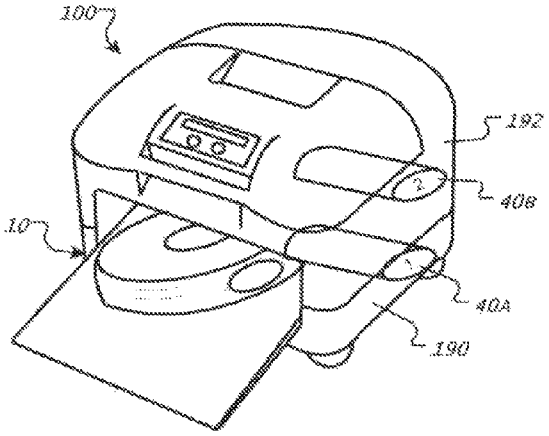
Figure 19D:
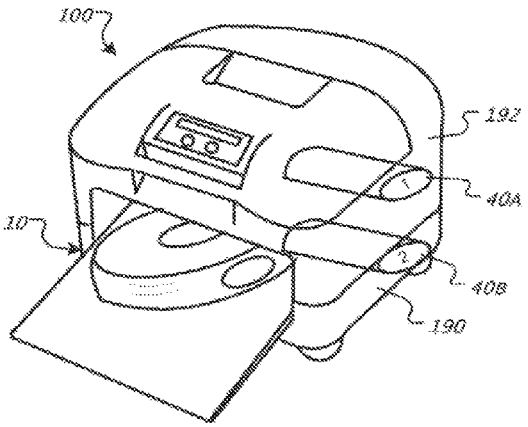
Figure 19E:
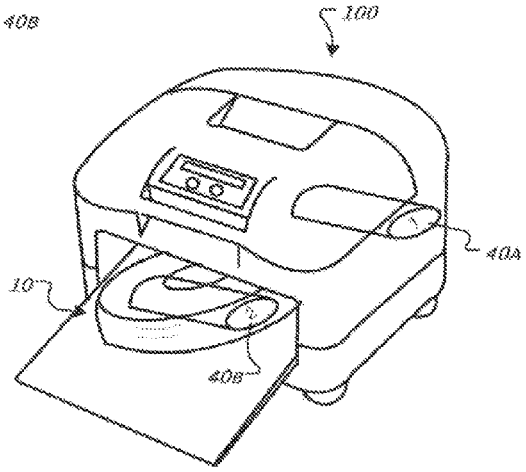
Figure 19F:
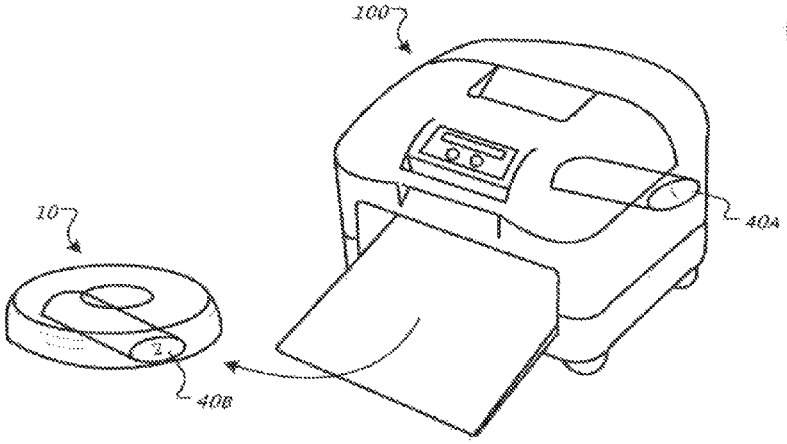
Figure 20A:
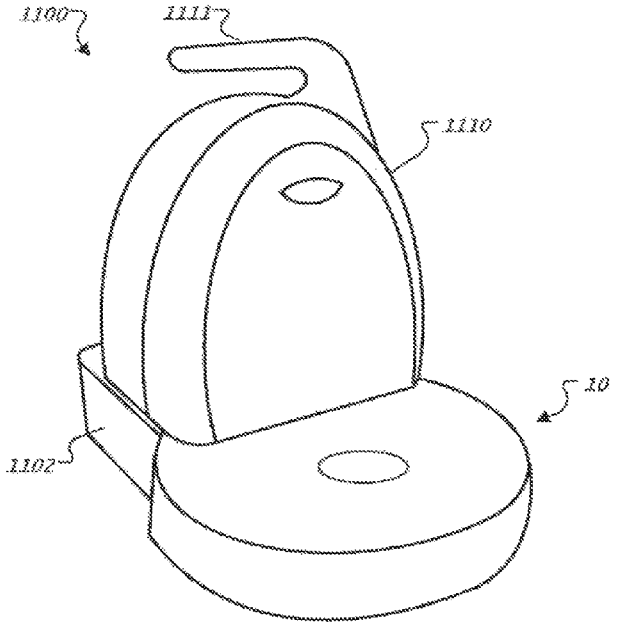
FIGS. 20A-21B are perspective views of maintenance stations.
Figure 20B:
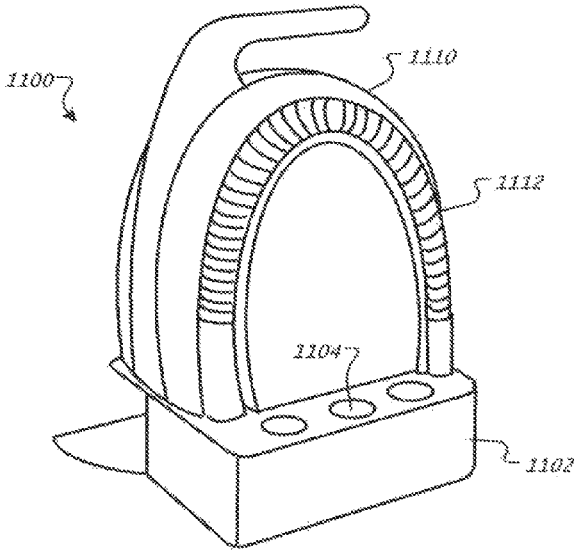

FIG. 18D demonstrates a semi-tubular tool 600 in use. The semi-bell shaped opening 605 of the tool 600 is applied toward the roller 60 having bristles 61, facilitating entry of the roller 60 into the tool 60. In cases where the roller 60 includes inner pliable flaps 62, the semi-bell shaped opening 605 is at least slightly larger in diameter than the axial extension or spooling diameter of inner pliable flaps 62. Along the length of the tool 60, the tool 60 narrows so a constant, main diameter, and the inner pliable flaps 62 are deformed by the main inner diameter of the tool 600. In some implementations, the tool 600 defines inner protrusions 615 to deform the bristles 61 and/or the inner pliable flaps 62. Any filaments or hairs collected about the spooling diameter are positioned where they will be caught by the approaching teeth 610 (which extend into the tool 60 to a point that is closer to the roller axis than the undeformed flaps 62, but farther away than an end cap 63). Two kinds of teeth 610 are shown in FIG. 18D, triangular forward canted teeth 610A with a straight leading profile, and shark-tooth forward canted teeth 610B with a curved entry portion or hook, e.g., a U or J-shaped profile on the leading edge of each tooth, opening toward the roller 60 in the direction of tube application. Either or both teeth 610A, 610B may be used, in groups or otherwise. After one or more passes of the tool 600 over the roller 60, the station 100 retracts the tool 600 to a position for tool cleaning and evacuation of debris off the tool 600 and into the station bin 150.

Referring back to FIG. 1B, in some implementations, the robot 10 includes a communication module 90 installed on the bottom of the chassis 31. The communication module 90 provides a communication link between the communication module 1400 on the maintenance station 100 and the robot 10. The communication module 90 of the robot 10, in some instances, includes both an emitter and a detector, and provides an alternative communication path while the robot 10 is located within the maintenance station 100. In some implementations, the robot 10 includes a roller full (brush service) sensor assembly 85 installed on either side of and proximate the cleaning head 40, with a detection path extending along the length of the brush or roller to detect accumulations of filaments or fuzz along the length of the brush or roller. The roller full (brush service) sensor assembly 85 provides user and system feedback regarding a degree of filament wound about the main brush 65, the secondary brush 60, or both. The roller full sensor assembly 85 includes an emitter 85A for emitting modulated beams and a detector 85B configured to detect the beams. The emitter 85A and detector 86B are positioned on opposite sides of the cleaning head roller 60, 65 and aligned to detect filament wound about the cleaning head roller 60, 65. The roller full sensor assembly 85 includes a signal processing circuit configured to receive and interpret detector output. In some examples, the roller full sensor system 85 detects when the roller 60, 65 has accumulated filaments, when roller effectiveness has declined, or when a bin is full (as disclosed in U.S. Provisional Patent No. 60/741,442, filed Dec. 2, 2005, and herein incorporated by reference in it entirety), trigging the return of the robot to a maintenance station 100, as described herein, and notifying the robot 10 or maintenance station 100 that the brush(es) 60, 65 require service or cleaning. As discussed herein, a head cleaning tool 600 configured to clear debris from the cleaning roller 60, 65 in response to a timer, a received command from a remote terminal, the roller full sensor system 85, or a button located on the chassis/body 31 of the robot 10.

Once a cleaning cycle is complete, either via the roller full sensor system 85 or visual observation, the user can open the wire bale and pull out the roller(s) 60, 65. The roller(s) 60, 65 can then be wiped clean off hair and inserted back in place.

Referring to FIGS. 19A-F, in some implementations, the robot 10 includes a removable cleaning head cartridge 40, which includes at least one cleaning roller 60, 65. When the robot 10 determines that cleaning head or cleaning head cartridge 40 needs servicing (e.g. via a bin service, brush service, or roller full detection system 85, a bin full detection system, or a timer) the robot 10 initiates a maintenance routine. Step S19-1, illustrated in FIG. 19A, entails the robot 10 approaching the cleaning station 100 with the aid of a navigation system. In one example, the robot 10 navigates to the cleaning station 100 in response to a received homing signal emitted by the station 100. Docking, confinement, home base, and homing technologies discussed in U.S. Pat. Nos. 7,196,487; 7,188,000 or U.S. Patent Application Publication No. 20050156562 are suitable homing technologies. In step S19-2, illustrated in FIG. 19B, the robot 10 docks with the station 100. In the example shown, the robot 10 maneuvers up a ramp 122 and is secured in place by a locking assembly 260. In step S19-3, illustrated in FIG. 19C, the dirty cartridge 40A is automatically unloaded from the robot 10, either by the robot 10 or the cleaning station 100, into a transfer bay 190 in the cleaning station 100. In some examples, the dirty cartridge 40A is manually unloaded from the robot 10 and placed in the transfer bay 190 by a user. In other examples, the dirty cartridge 40A is automatically unloaded/discharged from the robot 10, but manually placed in the transfer bay 190 by the user. In step S19-4, illustrated in FIG. 19D, the cleaning station 100 exchanges a clean cartridge 40B in a cleaning bay 192 with the dirty cartridge 40A in the transfer bay 190. In one example, the cartridge 40A, 40B are moved by automation in the station 100. In another example, the transfer bay 190 and associated dirty cartridge 40A is automatically swapped with the cleaning bay 192 and associated clean cartridge 40B. In step S19-5, illustrated in FIG. 19E, the cleaning station 100 automatically transfers the clean cartridge 40B from the transfer bay 190 into the robot 10. In step S19-6, illustrated in FIG. 19F, the robot 10 exits the station 100 and may continue a cleaning mission. Meanwhile, the dirty cartridge 40A in the station 100 is cleaned. The automated cleaning process may be slower than by hand, require less power, clean more thoroughly, and perform quietly (e.g. by taking many slow passes over the roller 60, 65).

Referring to FIGS. 20A-25B, a maintenance station 1100 evacuates the robot collection bin 50, but does not perform maintenance on the cleaning head assembly 40. FIGS. 20A-21B illustrate examples of the maintenance station 1100 including a station base 1102 and a handheld vacuum 1110 removably secured to the station base 1102. The base 1102 includes an evacuation assembly 400 in communication with the handheld vacuum 1110, while attached thereto.

The handheld vacuum 1110 having a handle 1111 either manually (e.g. via operator control) or automatically evacuates the robot bin 50, once the robot 10 docks with the maintenance station 1100. The station base 1102 may include a locking assembly 260 for securing and/or communicating with the robot 10. While detached from the station base 1102, the handheld vacuum 1110 functions as a normal vacuum cleaner. In some examples, the handheld vacuum 1110 includes a vacuum hose 1112 and/or a cleaning head 1105 for cleaning surfaces. The station base 1102 may defines receptacles 1104 for receiving and storing vacuum attachments 1114. In some implementations, the station base 1102 includes a separate station bin 1150 from the handheld vacuum 1110.

Figure 21A:
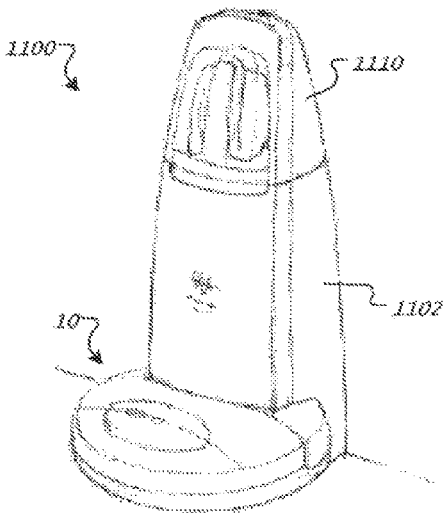
Figure 21B:
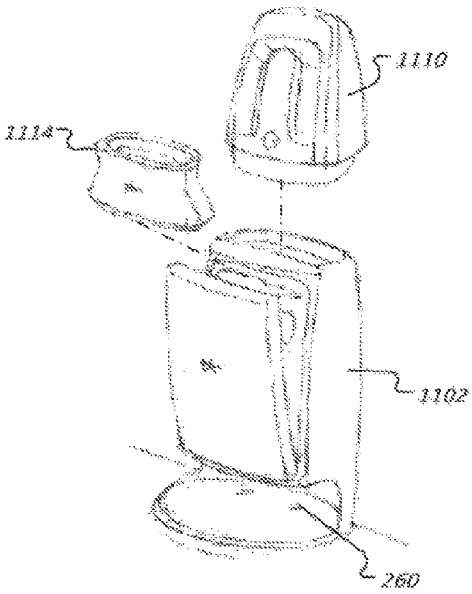
Figure 22A:
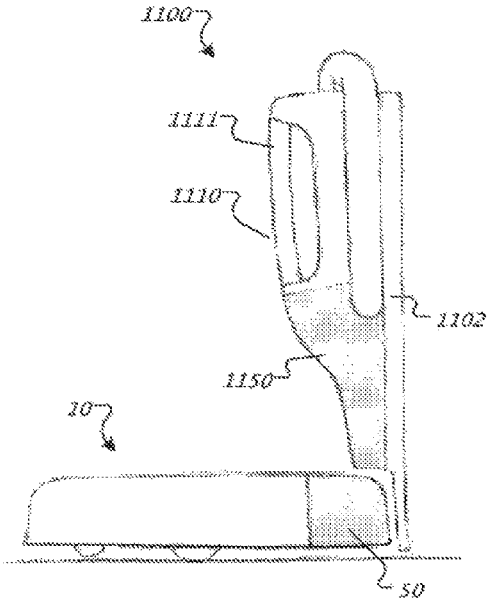
FIGS. 22A-22B are side views of maintenance stations and docked coverage robots.
Figure 22B:
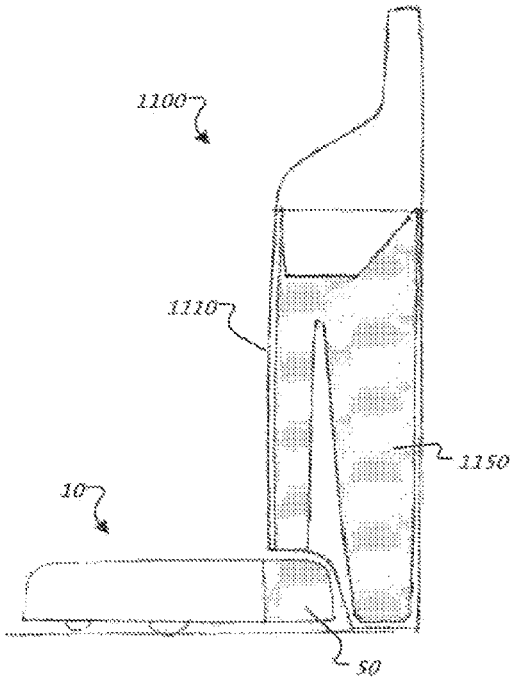
Figure 23A:
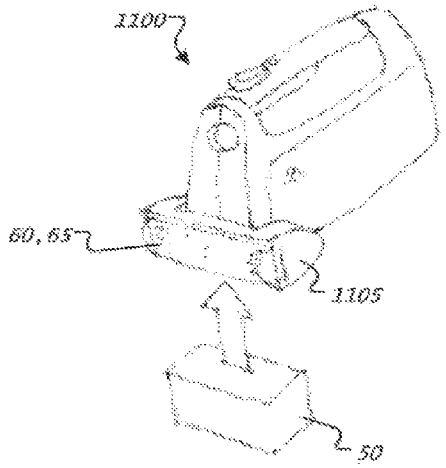
FIGS. 23A-24B are perspective views of hand held maintenance stations.
Figure 23B:
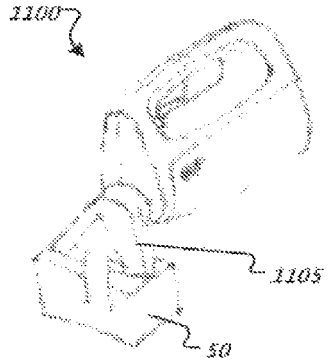
Figure 24A:
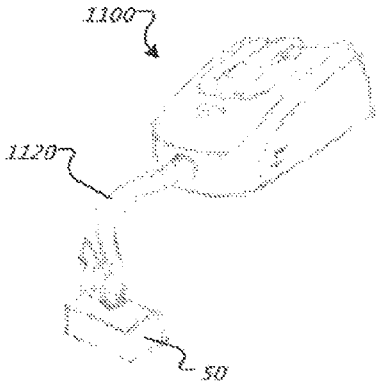
Figure 24B:
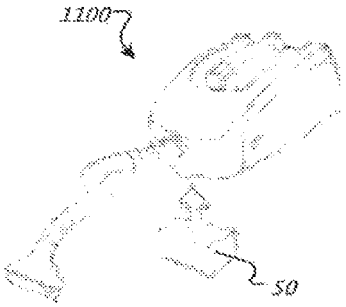

FIGS. 22A-24B illustrate an example of the maintenance station 1100 including a handheld vacuum 1110 configured to be received directly by the bin 50 of the robot 10 for evacuation of debris out of the bin 50 and into the station bin 1150. In FIG. 21A, the maintenance station 1100 includes a station base 1102. In FIGS. 21B-24B, the maintenance station 1100 does not include a station base 1102. Instead, the handheld vacuum 1110 either supports itself or is held by a user during bin evacuation. A house attachment 1120 may be used to aid bin evacuation.

Figure 25A:
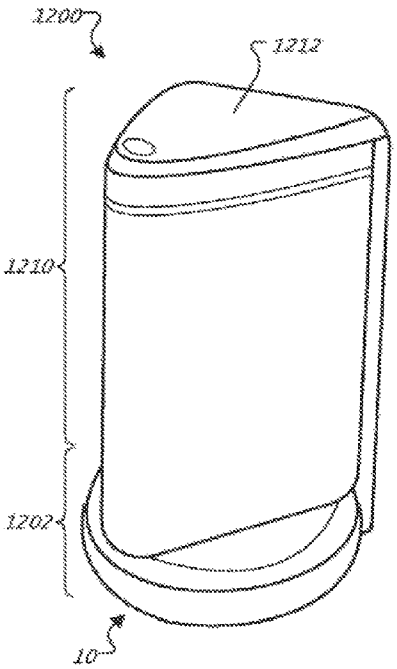
FIG. 25A is a perspective view of a maintenance station with a trash can portion.
Figure 25B:
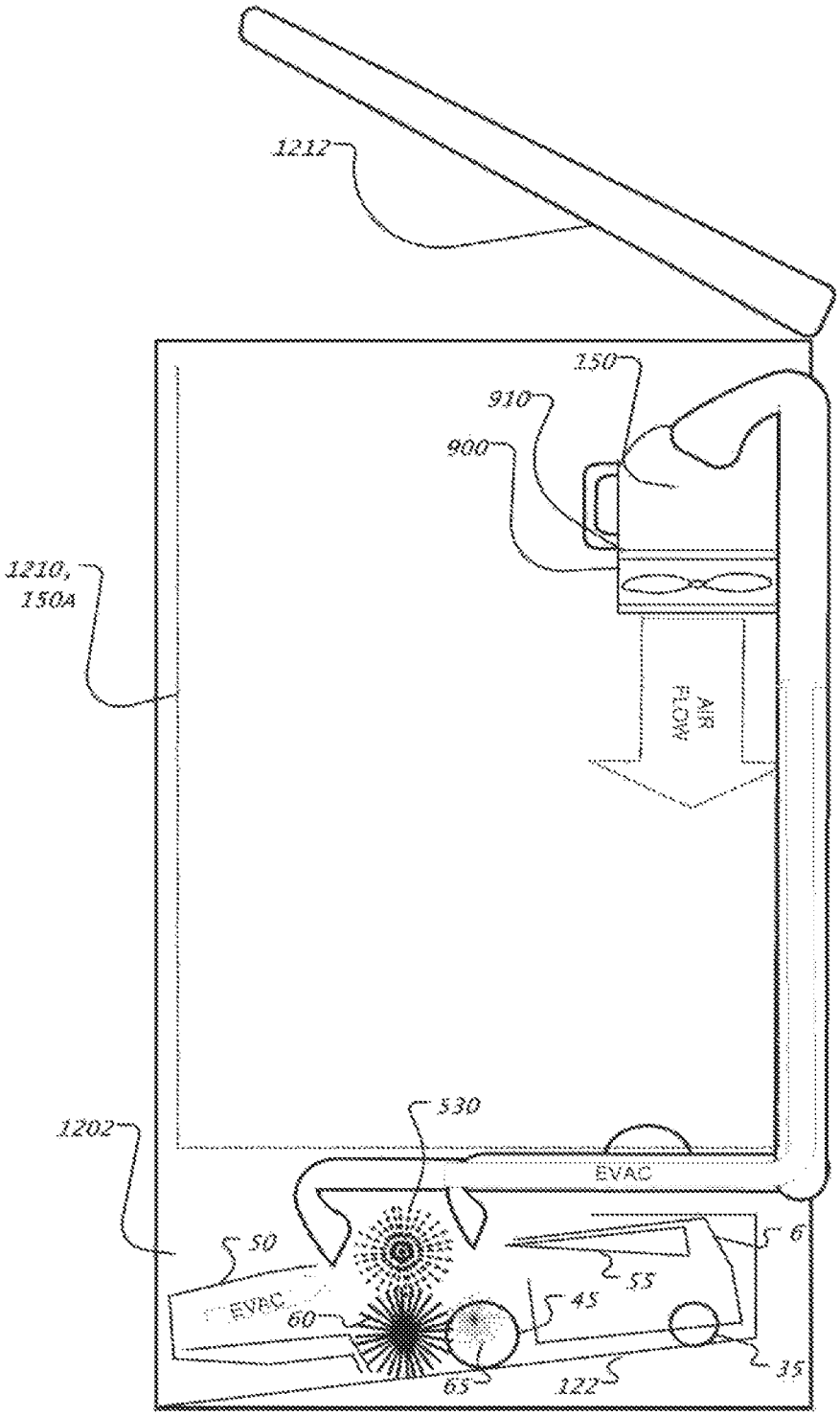
FIG. 25B is a schematic view of a maintenance station with a trash can portion.

FIGS. 25A-25B illustrates an example of a maintenance station 1200 configured as a trash container or other utility "furniture". The maintenance station 1200 includes a docking portion 1202 and a trash can portion 1210 including a trash can lid 1212. The docking portion 1202 is configured to evacuate debris from the docked robot bin 50 directly in to a trash receptacle of the trash can portion 1210. The trash receptacle is accessible by the user for depositing other refuse as well. In some implementations, the trash can portion 1210 includes a trash compactor that periodically (or upon user command) compacts refuse in the trash can portion 1210. In such a case, the robot 10 may follow a platform 122 into a maintenance station 100 that includes a trash can portion 1210 (in this case, the maintenance station 100 may also be wholly enclosed in or part of the trash can 1200). Once within or engaged with the maintenance station 100, the panel 55 is moved aside to expose at least the primary brush 60 (to expose any brushes which may accumulate filaments or fuzz, including bristle type brushes). The docking portion 1202 may lower, or locate in predetermined positions, brush-cleaning brush or beater 530. The brush cleaning member/mechanism 530 engages the primary cleaning brush 65 of the robot 10, and is driven by a motor (not shown) in the maintenance station 100. The debris or filaments agitated by the brush cleaning brush 530 are collected in the trash can portion via ducting and hoses, entering a collection bin 150. FIG. 25B depicts alternative or combinable variations: a variation in which the collection bin 150 is a smaller bin accessible by opening the trash can lid 1212 (i.e., proximate the lid 1212); and a variation in which the collection bin 150 is replaced by or auxiliary to a container or receptacle for ordinary bin liners 150A or, e.g., 30 liter kitchen bags. In either variation (and generally herein as a replacement for a vacuum-bag or filter vacuum, system), a cyclonic or other circulatory bagless vacuuming system that diverts debris using centripetal acceleration of debris may be used to divert the debris from the vacuum filter or flow. In each case, the smaller collection bin 150 may periodically (by timer, and/or full status as measured by a capacity sensor; and or every time the trash can lid 1212 is opened) be emptied into the main bin line 150, e.g., by opening a panel or door with a solenoid, motor, clutch, linkage to the lid 1212 and driven by lifting the lid 1212, or other actuator. As discussed herein, the collection bin 150 may be a vacuum bin, and include a vacuum filter 910 removable with the bin or removable separately from the trash can portion 1210 and is evacuated by a vacuum motor 900 in the maintenance station 100/trash can portion 1210. In the configuration shown in FIG. 25B, the vacuum 900 is a high powered vacuum (e.g., 6-12 amp) that pulls air through the filter 910 and via the collection but 150, through ducting and hoses along or within the trash can portion 1210, over and through the brush 530, and optionally directly or diverted from the cleaning bin 30 of the robot 10. Optionally, the remaining areas of the robot 10 (e.g., circuit board areas) may benefit from evacuation as well, and are not sealed from the vacuum.

Figure 26A:
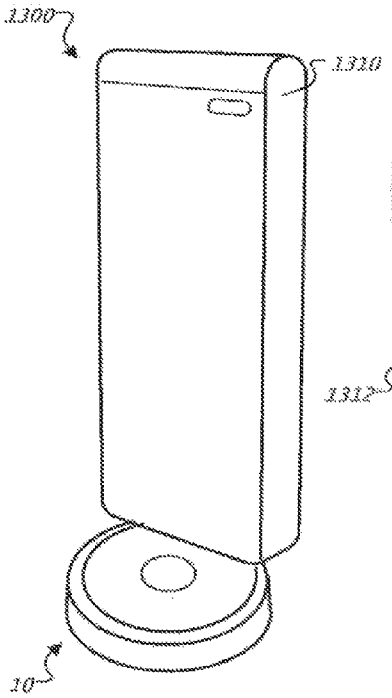
Figure 26B:
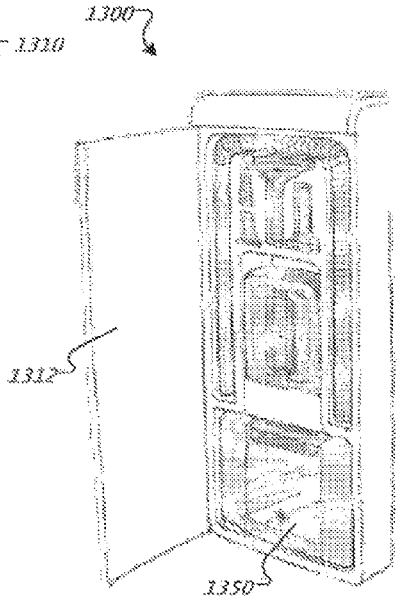

FIGS. 26A-26B illustrate an example of a wall mounted maintenance station 130 to which the robot 10 docks for bin evacuation. The wall mounted maintenance station 1300 may be connected to a central vacuum system of a house or stand alone with a station bin 1350. A door 1312 pivotally attached to a station housing 1310 provides access to interior portions of the station housing 1310, which may house the station bin 1350 (if not connected to a central vacuum system), hoses, and vacuum attachments.

Figure 27A:
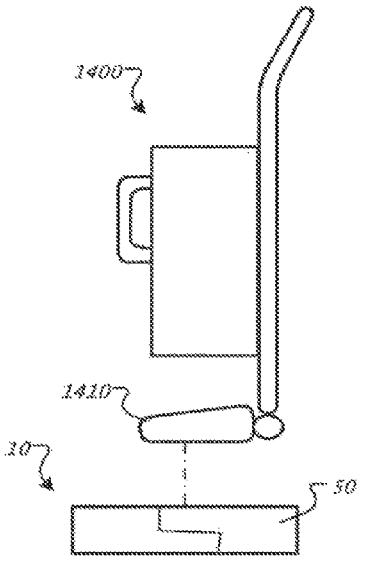
Figure 27B:
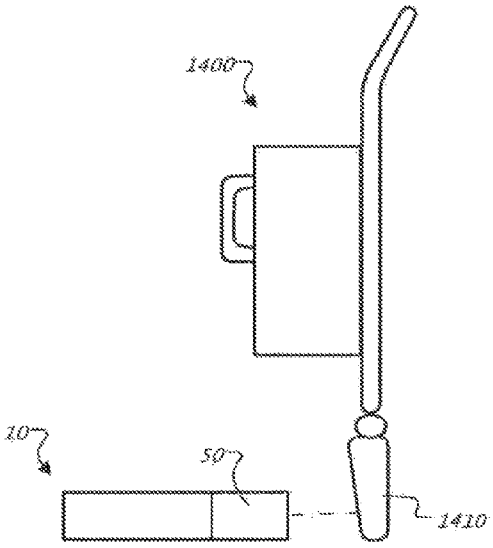
Figure 27C:
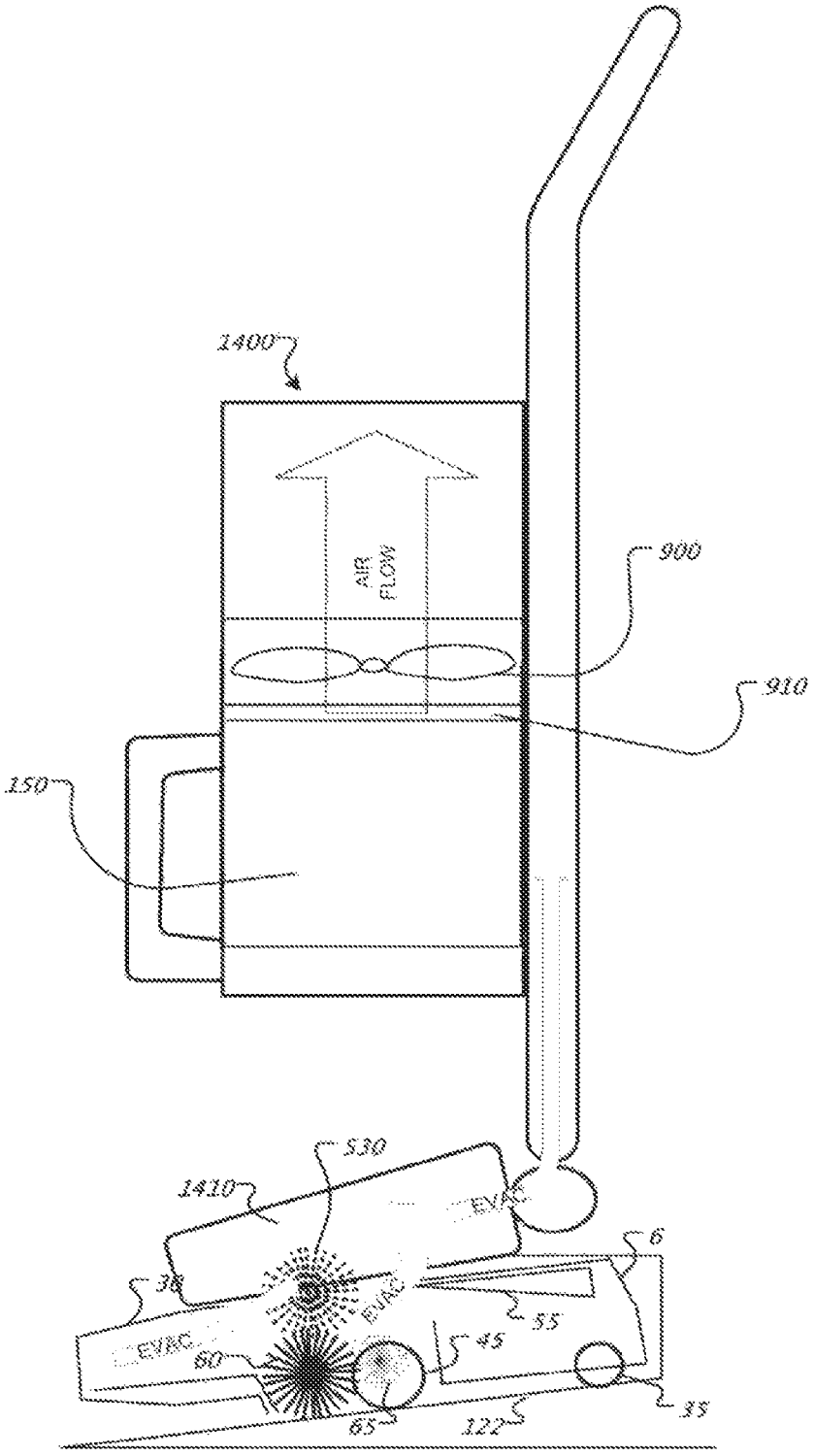

FIGS. 27A-27C illustrate an example where an upright vacuum cleaner 1400 is configured to evacuate the robot bin 50. The upright vacuum cleaner 1400 includes a vacuum head 1410 configured to mate with the robot bin 50 for evacuation of the bin 50. In such a case, the robot 10 may follow a platform 122 into a maintenance station 100 that receives the upright 1400 (in this case, the maintenance station 100 may also be wholly enclosed in or part of the upright 1400). Once within or engaged with the maintenance station 100, the panel 55 is moved aside to expose at least the primary brush 60 (to expose any brushes which may accumulate filaments or fuzz, including bristle type brushes). The maintenance station/upright 1400 may lower, or locate in predetermined positions, brush-cleaning brush or beater 530. The brush cleaning member/mechanism 530, in this case the upright's main cleaning brush or beater, engages the primary cleaning brush 65 of the robot 10, and is driven by a motor (not shown) in the maintenance station 100/upright 1400, the same motor usually used to rotate the brush cleaning member 530 in its role as the main beater or cleaning brush of the upright 1400. The debris or filaments agitated by the brush cleaning brush 530 are collected in the upright via ducting and hoses, entering the collection bin 150 in the maintenance station 100/upright 1400, in this case the collection bin 150 being the same as the main cleaning bin of the upright. As discussed herein, the collection bin 150 may be a vacuum bin, and include a vacuum filter 910 removable with the bin or removable separately from the upright 1400 and is evacuated by a vacuum motor 900 in the maintenance station 100. In the configuration shown in FIG. 27C, the vacuum 900 is a high powered vacuum (e.g., 6-12 amp) that pulls air through the filter 910 and via the collection bin 150, through ducting and hoses along or within the upright handle and cleaning head assembly, over and through the brush 530, and optionally directly or diverted from the cleaning bin 30 of the robot 10. Optionally, the remaining areas of the robot 10 (e.g., circuit board areas) may benefit from evacuation as well, and are not sealed from the vacuum.

Other details and features combinable with those described herein may be found in the following U.S. patent applications filed concurrently herewith, entitled "COVERAGE ROBOTS AND ASSOCIATED CLEANING BINS" having assigned Ser. No. 11/751,267; and "CLEANING ROBOT ROLLER PROCESSING" having assigned Ser. No. 11/751,413, the entire contents of the aforementioned applications are hereby incorporated by reference.

A number of implementations have been described. Nevertheless, it will be understood that various modifications may be made without departing from the spirit and scope of the disclosure. Accordingly, other implementations are within the scope of the following claims.

What is claimed is:

1. A system for maintaining a robotic cleaner comprising:

a maintenance station including a station housing and a platform on which the robotic cleaner is supported during servicing;

a collection bin removably attached to the housing, wherein the collection bin is different from a cleaner bin located in the robotic cleaner, the collection bin being configured to collect debris from the cleaner bin of the robotic cleaner; and a user interface device configured to wirelessly communicate to a communication module on the maintenance station and/or to a compatible communication facility on the robot, the user interface device including a maintenance station collection bin full indicator.

2. The maintenance station of claim 1, wherein the communication module includes an emitter and a detector configured to emit and detect RF and/or IR signals.

3. The maintenance station of claim 1, wherein the user interface device includes buttons and a display allowing a user to input commands or instructions which are then processed by a controller of the maintenance station or by the robot.

4. The maintenance station of claim 3, wherein the display is adapted to alert the user to a status of the maintenance station and to provide visual feedback in response to commands and instructions inputted by the user.

5. The maintenance station of claim 1, wherein the user interface device is remotely operable external from the maintenance station using the communication module.

6. The maintenance station of claim 1, wherein the platform is inclined extending upward from the ground allowing the robot to maneuver up the platform to a servicing position.

7. The maintenance station of claim 1, further comprising a communication port along a bottom side edge of the maintenance station.

8. The maintenance station of claim 7, wherein a configuration of the port includes one or more of a RS232 serial, USB, Ethernet port.

9. The maintenance station of claim 7, wherein the communication port (i) permits flashing of microcontroller code for controlling the maintenance station; and/or (ii) permits one or more accessories to the maintenance station to be connected to and controlled along with the maintenance station and the robotic cleaner robot.

10. The maintenance station of claim 1, wherein the collection bin is three to ten times the volumetric capacity of the bin of the robotic cleaner.

11. The maintenance station of claim 1, wherein the collection bin is removably attached to a top portion of the housing to be disengaged substantially parallel to the ground.

12. The maintenance station of claim 1, wherein the collection bin is removably attached to a front or overhanging portion of the housing to be disengaged substantially parallel to the ground from underneath the overhang.

13. The maintenance station of claim 1, wherein the collection bin is removably attached to the top of the housing to be disengaged in a vertical direction.

14. The maintenance station of claim 1, wherein the user interface device is disposed on the housing and is removably attached to the housing.

15. The maintenance station of claim 1, wherein the user interface device includes a control configured to cause the robotic cleaner to return to the maintenance station.

16. The maintenance station of claim 1, wherein the user interface device includes an indicator for the robot on carpet or hardwood, the robotic cleaner configured to self-adjust the orbit of the robotic cleaner based on surface demands.

17. The maintenance station of claim 1, wherein the user interface device includes a control to pause/resume cleaning of the robotic cleaner.

18. The maintenance station of claim 1, wherein the user interface device includes a control for scheduling cleaning of the robotic cleaner.

* * * * *